US011731029B2

(12) United States Patent
Zuijdwijk

(10) Patent No.: US 11,731,029 B2
(45) Date of Patent: Aug. 22, 2023

(54) SET OF COUPLING ASSEMBLIES FOR A BOARD FOR BOARD SPORTS

(71) Applicant: EMINENT BOARDSPORTS B.V., Amsterdam (NL)

(72) Inventor: Rik Zuijdwijk, Alkmaar (NL)

(73) Assignee: EMINENT BOARDSPORTS B.V., Amsterdam (NL)

( * ) Notice: Subject to any disclaimer, the term of this patent is extended or adjusted under 35 U.S.C. 154(b) by 108 days.

(21) Appl. No.: 17/420,533

(22) PCT Filed: Jan. 3, 2020

(86) PCT No.: PCT/NL2020/050002
§ 371 (c)(1),
(2) Date: Jul. 2, 2021

(87) PCT Pub. No.: WO2020/141979
PCT Pub. Date: Jul. 9, 2020

(65) Prior Publication Data

US 2022/0080289 A1 Mar. 17, 2022
US 2023/0103277 A9 Mar. 30, 2023

(30) Foreign Application Priority Data

Jan. 4, 2019 (NL) ..... 2022343
Jun. 25, 2019 (NL) ..... 2023380

(51) Int. Cl.
*A63C 10/12* (2012.01)
*B63B 32/40* (2020.01)
(Continued)

(52) U.S. Cl.
CPC ..... *A63C 10/12* (2013.01); *A63C 10/103* (2013.01); *A63C 10/14* (2013.01); *B63B 32/47* (2020.02)

(58) Field of Classification Search
CPC ..... A63C 10/12; A63C 10/103; A63C 10/14; A63C 10/28; B63B 32/47
See application file for complete search history.

(56) References Cited

U.S. PATENT DOCUMENTS 6,109,643 A * 8/2000 Bayer ..... A63C 9/086 280/607
6,209,904 B1 * 4/2001 Schnitzhofer ..... A63C 10/14 280/14.22

(Continued)

FOREIGN PATENT DOCUMENTS

EP 0350411 A2 1/1990
EP 0352662 A2 1/1990

OTHER PUBLICATIONS

International Search Report and Written Opinion dated Apr. 14, 2020 for PCT/NL2020/050002.

(Continued)

*Primary Examiner* — Brian L Swenson
(74) *Attorney, Agent, or Firm* — Patterson + Sheridan, LLP

(57) ABSTRACT

The present invention relates to a set of coupling assemblies comprising a right coupling assembly and a left coupling assembly being configured to be mounted on aboard for board sports and to receive respectively a right boot and a left boot, wherein the right and left coupling assembly comprise an inner receiving unit and outer receiving unit, wherein each inner receiving unit comprises a locking arm which is pivotable about a main inner pivot axis from a locked position to a released position and vice versa, wherein each inner receiving unit comprises a pull mechanism comprising:—at least one elongate interlink member which extends between the two inner receiving units, and—a link pull member configured to engage the boot or the inner boot coupling part and to receive a pull force from the boot or boot coupling part when the boot or boot coupling part is no longer held by the coupling assembly and moves away from the coupling assembly, and to be pulled over a pull distance by said boot or by the boot coupling part, wherein the pull mechanism is configured to transfer the pull force and the pull distance to the at least one elongate interlink member, and to convert the pull distance in an interlink pull distance of the elongate interlink member, and wherein said interlink pull distance pivots the locking arm of the other coupling assembly from the locking position to the released position, thereby releasing the other boot.

20 Claims, 33 Drawing Sheets

(51) Int. Cl.
*A63C 10/10* (2012.01)
*A63C 10/14* (2012.01)

(56) References Cited

U.S. PATENT DOCUMENTS

| | | | | |
|---|---|---|---|---|
| 6,257,614 | B1 * | 7/2001 | Duggan | A63C 10/14 441/74 |
| 6,279,924 | B1 * | 8/2001 | Murphy | A63C 10/10 280/14.22 |
| 2002/0036386 | A1 * | 3/2002 | Murphy | A63C 10/12 280/623 |
| 2002/0043782 | A1 * | 4/2002 | Okajima | A63C 10/24 280/613 |
| 2004/0232658 | A1 * | 11/2004 | Poscich | A63C 10/10 280/618 |
| 2011/0248457 | A1 * | 10/2011 | Kosmehl | A63C 5/003 280/14.22 |
| 2014/0162511 | A1 * | 6/2014 | Ball | A63C 10/12 280/611 |
| 2015/0202523 | A1 * | 7/2015 | Deutsch | A63C 5/06 280/618 |
| 2015/0238843 | A1 * | 8/2015 | Allenspach | A63C 10/18 280/613 |
| 2020/0129840 | A1 * | 4/2020 | Hennessy | A63C 10/06 |
| 2020/0346097 | A1 * | 11/2020 | Kloster | A63C 10/02 |

OTHER PUBLICATIONS

Netherlands Search Report and Written Opinion dated Sep. 17, 2019, corresponding to Application No. 2022343.

* cited by examiner 166
38
166
21
36
20Ro, 20Lo 39
45
49
39
65
160
18Ri, 18Li
28
34
42
150
161
55
56
12,14
48
22
54
24
19

34
49
39
Ft
42
36
50
28
32
19
155
22
150

58
162
161
54
60
21
158
24
30
18Ri, 18Li
55
47
160
45
12,14
20Ro, 20Lo
30
47

18
32
19
160
156
46
C
21
20
161
C
39
162
12,14
60
156
46

43
25
37
36
Ft
34
39
22
44
42
32

12,14
18
19
161
162
50
58
55
46

49
18
37
36
Ft
12,14
43
39

22
19
150
32
160
21
42
20
26
58
55
28
44
46

10
14

18L
18R
12
14B
20L
20R 14B
14
36
49
50
22
25
M
39
19
54
42
48
57
24
60
43
12
46

14
36
37
39
42
57
19M
32
49
22
12
46
20
60
54
55
A
48
56
62
68
20

22
102
36
136
20
101
150,151
19
49
42
70
24
98
58

136
20
36
49
42
101
102

58
160
19
24
98

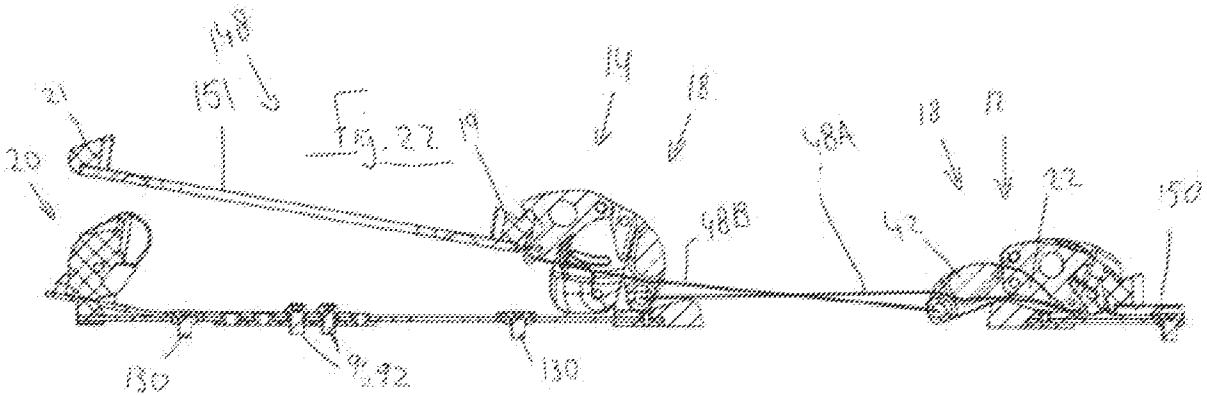
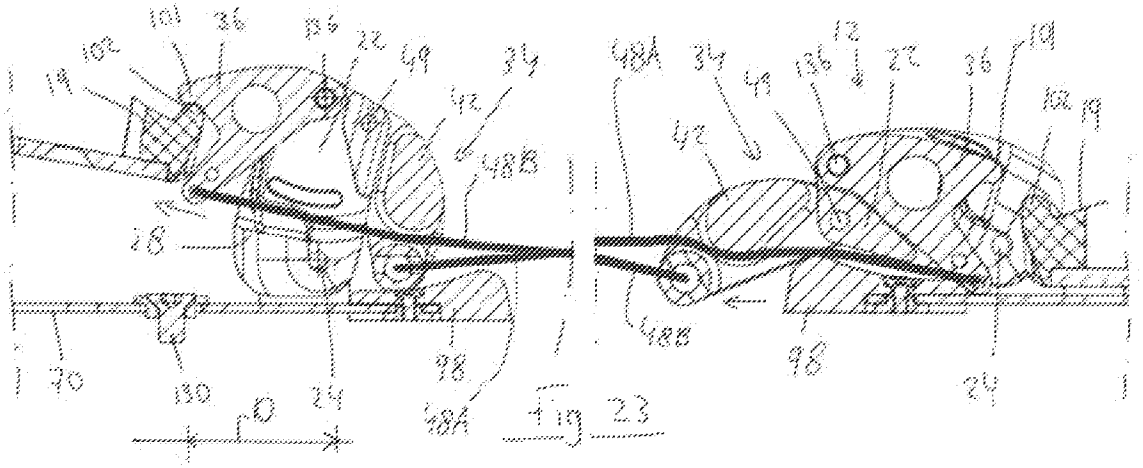

40
21
102
19
150
160
166
70
71
72A
72B
32

SET OF COUPLING ASSEMBLIES FOR A BOARD FOR BOARD SPORTS

FIELD OF THE INVENTION

The present invention relates to a set of coupling assemblies for a board for board sports in which two feet of the user are connected to the board. The set of coupling assemblies is in particular suitable for wakeboards, kitesurf boards, snowboards and monoski's. Such sets of coupling assemblies are known in the prior art.

BACKGROUND OF THE INVENTION

It is known that wake boarding or kite surfing brings along with it a risk of crashes and associated injuries. Injuries may occur in particular if the wakeboard or kite surfboard "hooks" into the water with one of the edges and subsequently exerts a large pulling force on the body of the wakeboarder or kite surfer. Typical injuries are knee injuries or neck injuries. There is not much that a wakeboarder or kite surfer can do to mitigate this risk.

In the field of the art, several attempts have been made to create a solution to this problem. These attempts are based on the idea that the board should come loose from the feet of the user when the forces between the board and the feet become too large. To this end, special coupling assemblies have been developed.

However, many requirements apply and to this date, to our knowledge no one has achieved a product that complies with all the requirements.

A first requirement is that both feet should come loose simultaneously or almost simultaneously.

Another requirement is that the coupling assemblies should be resistant to sand and salt water, and the functioning of the coupling assemblies should not be disadvantageously affected by sand or salt water. In particular ingress of sand between mechanical parts should not result in malfunctioning.

Another requirement is that the coupling assemblies should be relatively small and lightweight. If the coupling assembly is too bulky or too heavy, it would negatively affect the performance.

Another requirement is that the operation should be quite easy. In particular when a wakeboarder or kite surfer (or generally user) starts, it should be relatively easy to position the boots in the couplings and to fasten the couplings to the boots. This is in particular the case because sometimes, a user needs to do this on the water, where the wakeboard or kite surfboard has no grip on its surroundings. Any attempt to put the feet on the board with some pressure on the board will result in pushing the board away. This is quite different from a ski binding. The user is also in a relatively uncomfortable position, having his feet quite high.

Furthermore, the board itself may flex during use. This flex should not disadvantageously affect the safety couplings. Further, vice versa, the safety coupling should also not negatively affect the flex. Flex of the board is very important in most board sports. The safety coupling should also not disadvantageously affect the control which the user has over the board, because control over the board is also important.

One system known from the prior art is disclosed in U.S. Pat. No. 5,029,890. This system is based on having one coupling at the toe end of the boot, and one coupling at the heel end of the boot. It was recognized in the present invention that this is not a very good solution. In particular the couplings are far removed from the location of the attachment points of boards in board sport, which are near the centreline of the board. Also in case of a user with large feet but a small board, the coupling may extend beyond the edge of the board which is undesirable.

Furthermore, the system of U.S. Pat. No. 5,029,890 is quite complicated. In particular when the boots come loose and need to be reconnected to the coupling assemblies underwater, this is quite difficult. Furthermore, the adapter connected to the boot is quite cumbersome and makes it difficult to walk on the boot, see FIG. 3.

Furthermore, the system of U.S. Pat. No. 5,029,890 may get jammed as a result of sand entering the spaces around the holding pin 14*a* and the locking pin 18. This creates a risk that when one boot comes loose from the coupling, the other coupling does not come loose. It was recognized in the present invention that one of the causes of this problem is the operating principle of U.S. Pat. No. 5,029,890. The system of U.S. Pat. No. 5,029,890 is based on a pretensioned push force for the locking pin 18. When the shoe comes loose, the pretensioned push force created by the compression spring 16 releases. However, the shoe itself or the adapter connected to the shoe doesn't do anything besides coming loose and releasing the pretension.

WO2012074864A1 discloses another system. This system is based on compression forces created by compression springs, see for instance FIGS. 5-7. It was recognized in the present invention that systems based on compression forces and compression springs are unreliable, because the compression springs can deteriorate over time, resulting in a reduced compression force. Furthermore, sand may enter the cavities of the system and can jam the various mechanical parts of the system, resulting in a risk of injuries.

EP0397969A1 discloses another system. In this system, when a boot comes loose, it has no further function in the working of the system. The system itself creates a pull force in order to release the other coupling. However, the pull force is created by a pretension delivered by springs, see FIG. 4. Such springs can deteriorate over time and loose spring force. Such a deterioration will result in an unreliable system, and risk of injuries.

FR2630922 discloses another system based on similar operating principles as the previous systems.

EP0350411A2 discloses a releasable binding assembly for a gliding board such as a monoski or snowboard which includes a par of binding elements, each of which includes a mechanism for elastically retaining a shoe or boot and for releasing the shoe or boot upon the exertion of a biasing force exceeding a predetermined threshold. A disadvantage of the assembly is that it contains a complex system of springs and moving parts which may compromise the coupled release of the bindings. When for example one of the springs fails due to for example dirt or sand inside one of the binding elements, the binding element may not open. The disadvantages of EP0350411A2 are similar to those of reference U.S. Pat. No. 5,029,890.

SUMMARY OF THE INVENTION

The invention provides a set of coupling assemblies comprising a right coupling assembly and a left coupling assembly, the set of coupling assemblies being configured to be mounted on a board for board sports in which both feet of a user are connected to a single board, wherein the board is in particular a wakeboard, a kiteboard, a snowboard, or a monoski, wherein the right coupling assembly is configured to receive a right boot and comprises:

a right inner receiving unit configured to receive and engage an inner boot coupling part which is positioned on a left side of the right boot, a right outer receiving unit configured to receive and engage an outer boot coupling part which is positioned on a right side of the right boot, wherein the left coupling assembly is configured to receive a left boot and comprises:

a left inner receiving unit configured to receive and engage an inner boot coupling part which is positioned on a right side of the left boot, a left outer receiving unit configured to receive and engage an outer boot coupling part which is positioned on a left side of the left boot, wherein each outer receiving unit comprises an outer locking element configured to engage the outer boot coupling part and to hold the outer boot coupling part in place, characterized in that each inner receiving unit comprises a locking arm which is pivotable about a main inner pivot axis from a locked position to a released position and vice versa, wherein the locking arm comprises an inner locking cam configured to engage the inner boot coupling part and to hold the inner boot coupling part in place, wherein each inner receiving unit comprises a pull mechanism connected to the locking arm, the pull mechanism comprising:

at least one elongate interlink member which extends between the two inner receiving units and interlinks the two inner receiving units, and a link pull member configured to engage the boot or the inner boot coupling part and to receive a pull force from the boot or boot coupling part when the boot or boot coupling part is no longer held by the coupling assembly and moves away from the coupling assembly, and to be pulled over a pull distance by said boot or by the boot coupling part, wherein the pull mechanism is configured to transfer the pull force and the pull distance to the at least one elongate interlink member, and to convert the pull distance in an interlink pull distance of the elongate interlink member, and wherein said interlink pull distance pivots the locking arm of the other coupling assembly from the locking position to the released position, thereby releasing the other boot.

The set of coupling assemblies is based on the principle that the boot from the released coupling assembly pulls the other coupling assembly to the released state. The pulling action is safer and provides a better guarantee that the other coupling assembly releases. The boot which is released is able to generate a considerable force. This force is effectively used to release the other coupling.

An advantage of the set is that the one boot causes a direct, or at least more direct than the previously mentioned references, release of the other boot. This is because the locking arm holding the other boot is directly, or more directly connected to the one boot moving away from the coupling assembly via the elongate interlink member. Hence, the set allows for a coupled release between one boot and the other boot which is more direct, robust, and therefore safer than the previously mentioned references.

In an embodiment, wherein each inner receiving unit comprises a release arm pivotably connected to the locking arm and being pivotable relative to the locking arm about a release arm pivot axis, wherein each release arm comprises a cable connector to which an end of an elongate interlink member is connected.

In an embodiment the set comprises a first elongate interlink member and a second elongate interlink member, wherein the first elongate interlink member is connected at one end to the link pull member of the right coupling assembly and connected at the opposite end to the release arm of the left coupling assembly and wherein the second elongate interlink member is connected at one end to the link pull member of the left coupling assembly and connected at the opposite end to the release arm of the right coupling assembly. An opposite end of that elongate interlink member is connected to the release arm of the inner receiving unit of the other coupling assembly, and wherein the pull force exerted by the elongate interlink member pivots the release arm of that other inner receiving unit relative to the associated locking arm, and wherein the release arm in turn pulls the locking arm of that other inner receiving unit from the locked position to the released position.

In an embodiment, the inner or outer receiving unit of each coupling assembly comprises a force release mechanism configured to release the inner locking cam or outer locking element when a force on the locking cam or the outer locking element exceeds a threshold force. The force release mechanism ensures that the coupling assemblies releases the boot when necessary. In an alternative embodiment, the force release mechanism does not form part of the coupling assembly but is part of a boot adapter.

In an embodiment, the link pull member of each coupling assembly comprises a pull protrusion configured to be pulled by the inner boot coupling part, in particular in a direction away from the locking arm.

In an embodiment, the force release mechanism of the inner or outer receiving unit comprises:

a leaf spring, the leaf spring comprising a fixed part which is configured to be fixed to the board and a movable part, wherein the movable part is not fixed to the board, wherein the movable part of the leaf spring is configured to move in a direction away from the board when a force is exerted on the movable part of the leaf spring, said force flexing the leaf spring, a stop configured to be fixed to the board, wherein the outer or inner receiving unit comprises:

a hold and release component being connected to the movable part of the leaf spring, the hold and release component comprising the locking cam configured to engage the outer or inner boot coupling part and to hold the outer boot coupling part in place, a threshold part configured to engage the stop, and wherein when the force on the movable part of the leaf spring is below the threshold force the hold and release component is held in place by the stop which acts on the threshold part, and when the force on the movable part of the leaf spring exceeds the threshold force, the threshold part disengages from the stop and the hold and release component releases the inner or outer boot coupling part.

The present invention further relates to a boot adapter set comprising a right boot adapter and a left boot adapter configured to be connected to or to be integrated with respectively a right boot and a left boot, wherein the right and left boot adapter are each configured to be connected to a coupling assembly on a wakeboard, kiteboard, snowboard, or a monoski, each of the right and left boot adapter comprising:

an inner boot coupling part configured to be positioned at an inner side of the boot and configured to engage an inner receiving unit of a coupling assembly for a board, wherein the inner boot coupling part comprises an inner contact surface which faces upward, an outer boot coupling part configured to be positioned at an outer side of the boot and configured to engage an outer receiving unit of a coupling assembly for a board, wherein the outer boot coupling part comprises an outer contact surface which faces upward.

The boot adapter set is configured to work with the set of coupling assemblies according to the invention.

In a separate, independent aspect, a coupling assembly is provided for a ski or board for board sports, the coupling assembly comprising at least one receiving unit for receiving a boot coupling part connected to a boot or integrated with a boot, the coupling assembly comprising a force release mechanism comprising:

a leaf spring, the leaf spring comprising a fixed part which is configured to be fixed to the board and a movable part, wherein the movable part is not fixed to the board, wherein the movable part of the leaf spring is configured to move in a direction away from the board when a force is exerted on the movable part of the leaf spring, said force flexing the leaf spring, a stop configured to be fixed to the board, wherein the at least one receiving unit comprises:

a hold and release component being connected to the movable part of the leaf spring, the hold and release component comprising the locking cam configured to engage the boot coupling part and to hold the boot coupling part in place, a threshold part configured to engage the stop, and wherein when the force on the movable part of the leaf spring is below the threshold force the hold and release component is held in place by the stop which acts on the threshold part, and when the force on the movable part of the leaf spring exceeds the threshold force, the threshold part disengages from the stop and the hold and release component releases the boot coupling part.

The coupling assembly provides a robust and reliable way of releasably coupling a boot to a ski or to a board for board sports.

These and other aspects of the invention will be more readily appreciated as the same becomes better understood by reference to the following detailed description and considered in connection with the accompanying drawings in which like reference symbols designate like parts.

SHORT DESCRIPTION OF THE FIGURES

FIGS. 22 and 23 show sectional side views of the releasing set of coupling assemblies.

DETAILED DESCRIPTION OF THE FIGURES

Figure 1:
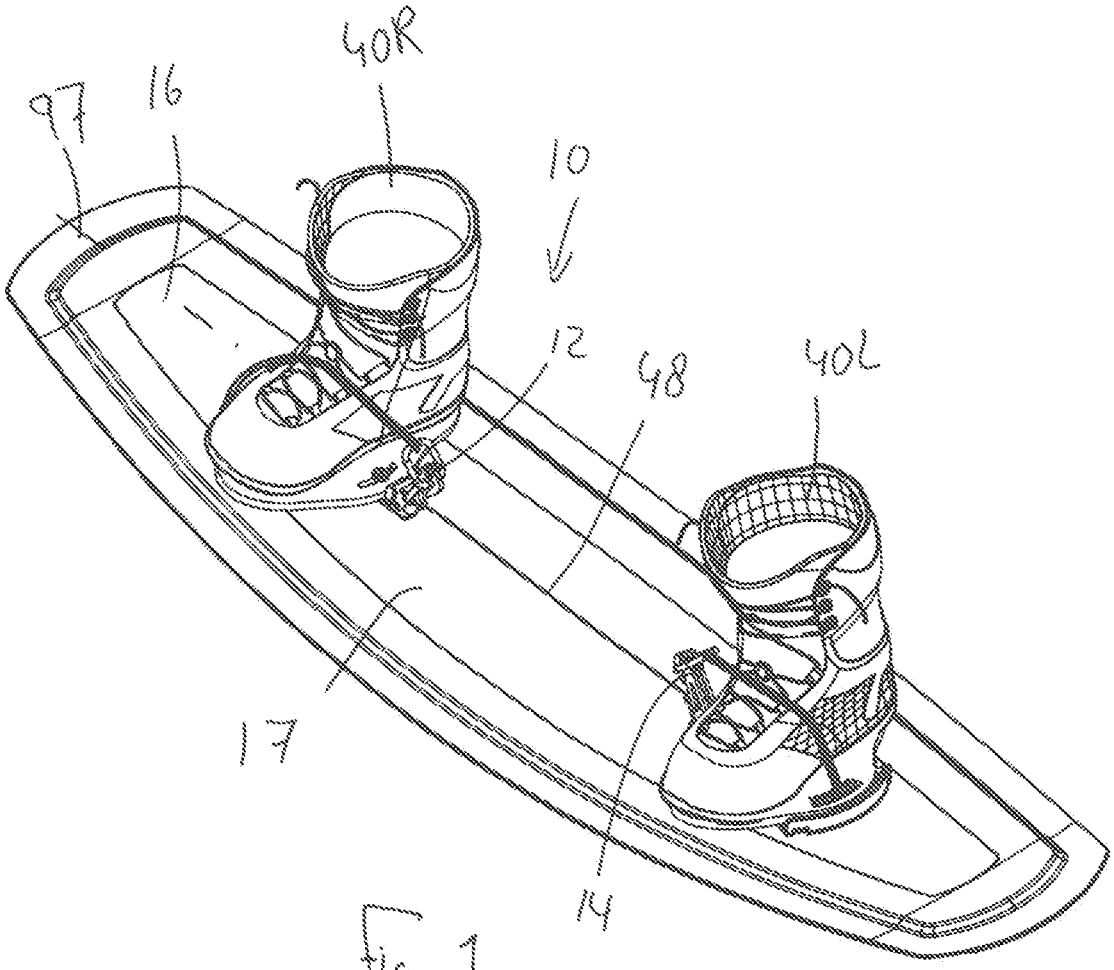
FIG. 1 shows an isometric view of a set of a first embodiment of the invention, the set comprising a board, boots and coupling assemblies.
Figure 2:
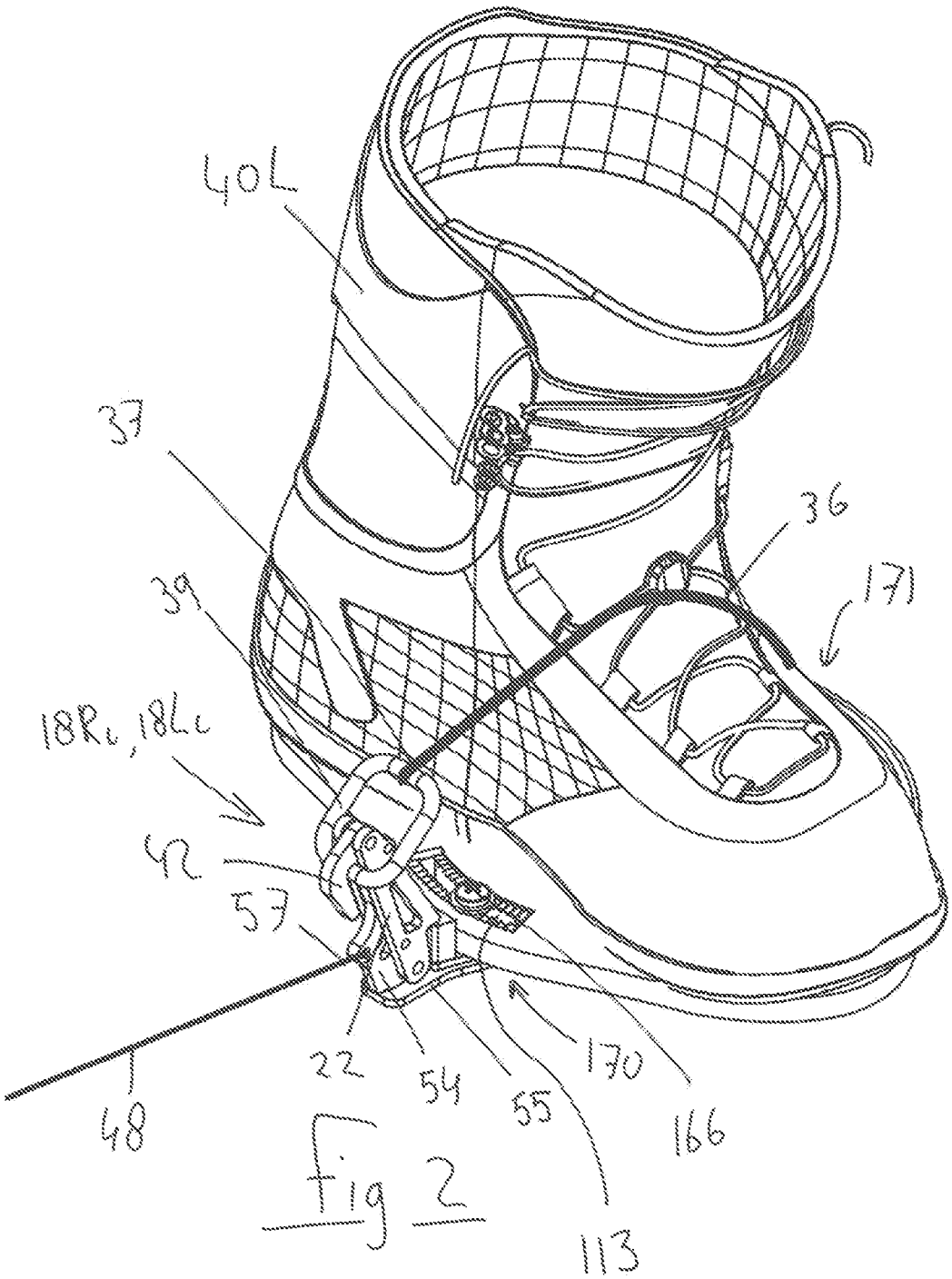
FIG. 2 shows an isometric view of the boot and the coupling assembly of the first embodiment.
Figure 3:
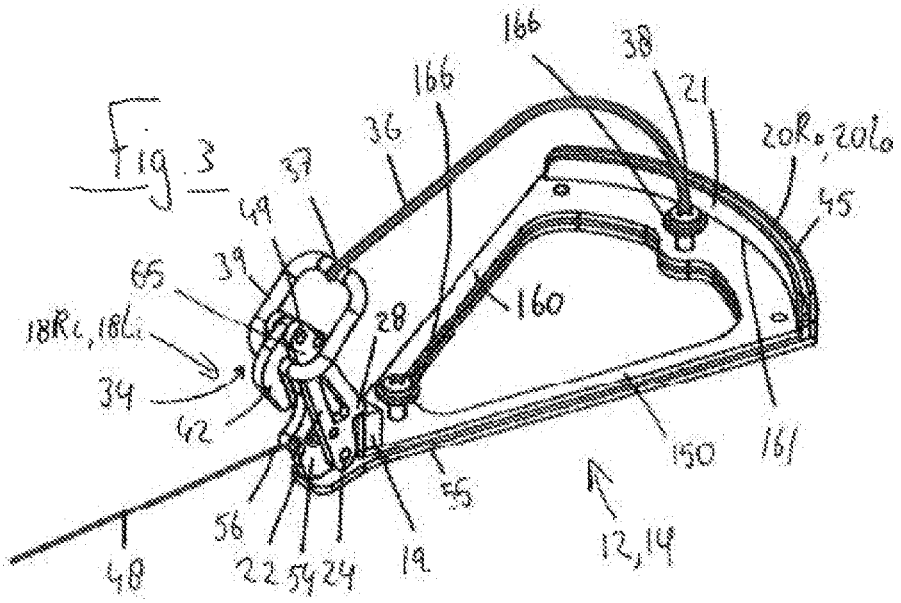
FIG. 3 shows an isometric view of the coupling assembly and the boot adapter of the first embodiment.
Figure 4:
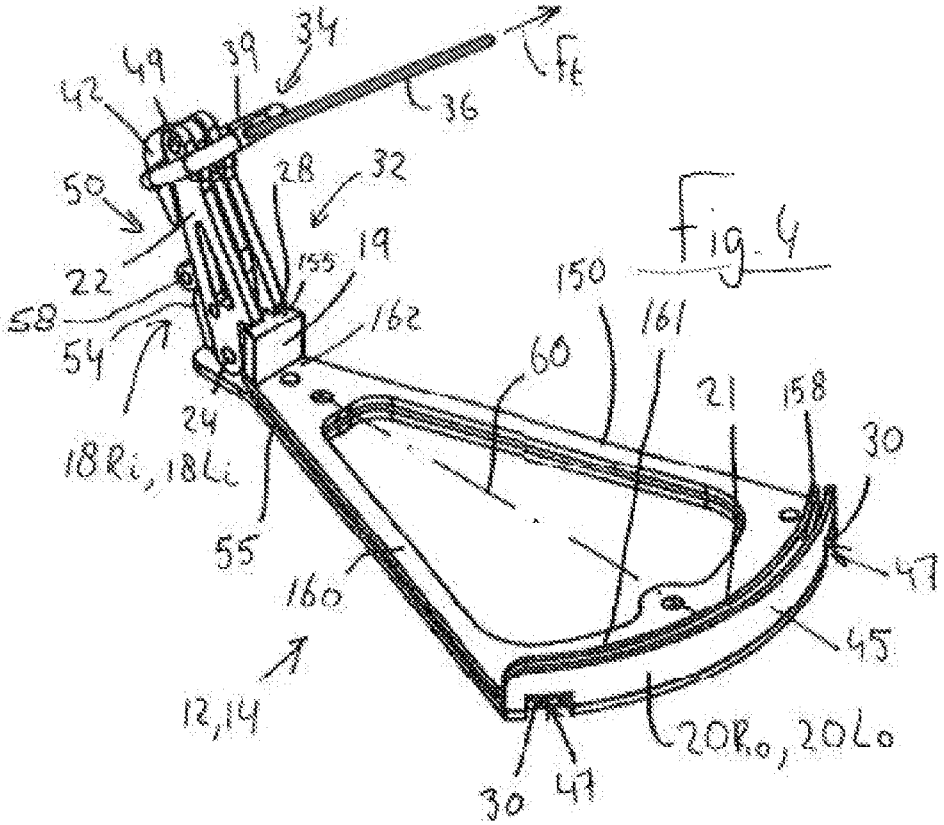
FIG. 4 shows another isometric view of the coupling assembly and the boot adapter of the first embodiment.
Figure 5:
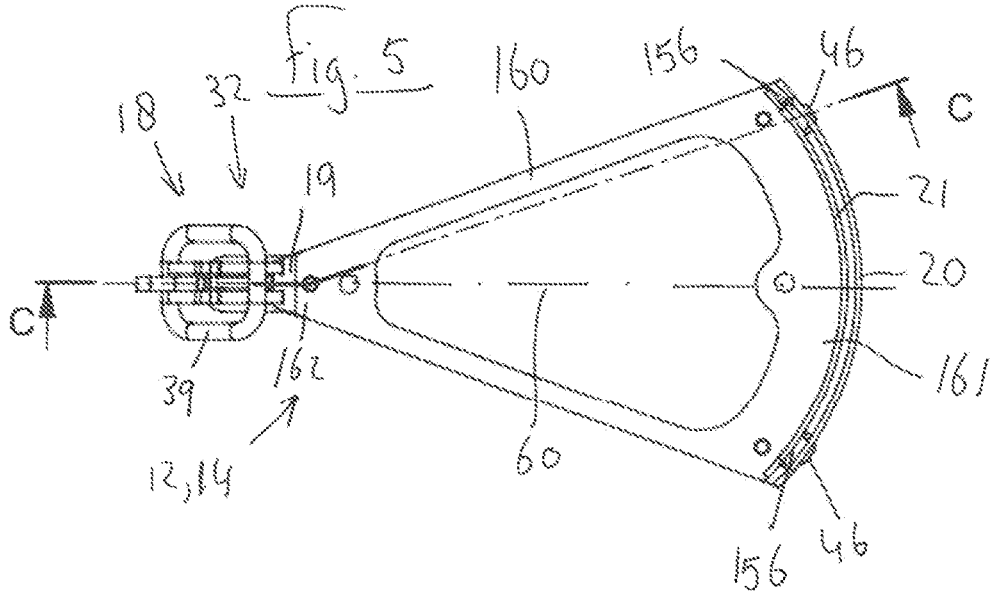
FIG. 5 shows a top view of a coupling assembly and a boot adapter of the first embodiment.
Figure 6:
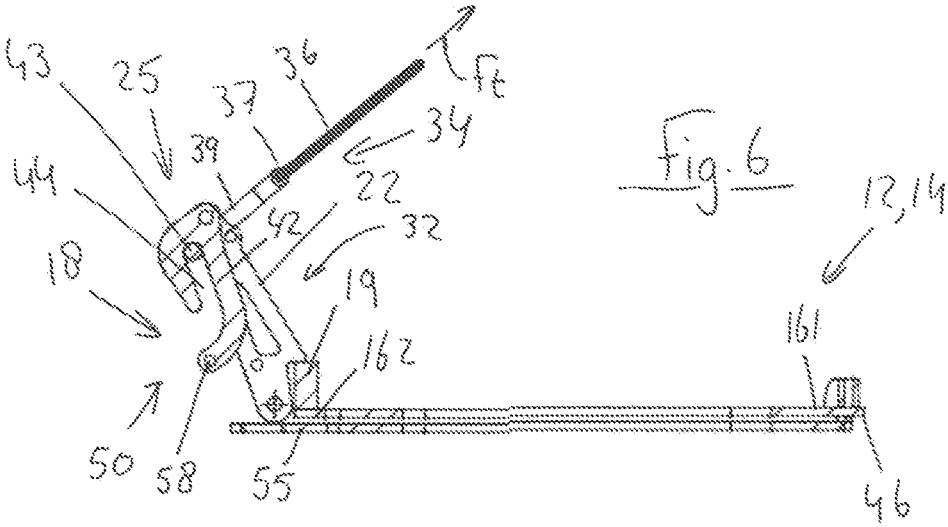
FIGS. 6 and 7 show sectional side views of the coupling assembly and the boot adapter of the first embodiment.

Turning to FIGS. 1 through 11B, the present invention relates to a set 10 of coupling assemblies comprising a right coupling assembly 12 and a left coupling assembly 14. The set may further comprise a board 16. The board 16 is a board for board sports in which both feet of a user are connected to a single board, e.g. a wakeboard, a kiteboard, a snowboard, or a monoski. The set 10 of coupling assemblies 12, 14 is configured to be mounted on the board 16.

The right coupling assembly 12 comprises:

- a right inner receiving unit 18Ri configured to receive and engage an inner boot coupling part 19 which is positioned on a left side of the right boot,
- a right outer receiving unit 20Ro configured to receive and engage an outer boot coupling part 21 which is positioned on a right side of the right boot, The left coupling assembly 14 comprises:

- a left inner receiving unit 18Li configured to receive and engage an inner boot coupling part 19 which is positioned on a right side of the left boot,
- a left outer receiving unit 20Lo configured to receive and engage an outer boot coupling part 21 which is positioned on a left side of the left boot.

The inner receiving units are commonly denoted as 18. The outer receiving units are commonly denoted as 20. The inner boot coupling part 19 is attached to the boot 40 or forms a part of the boot. The outer boot coupling part 21 is also attached to the boot or forms a part of the boot 40.

The set 10 can be used with a boot adapter set 148 comprising a right boot adapter 150 and a left boot adapter 151. Each boot adapter 150, 151 is configured to be connected to respectively a right boot 40R and a left boot 40L. The right and left boot adapter 150, 151 are each configured to be connected to one of the coupling assemblies 12, 14 on the wakeboard, kiteboard, snowboard, or a monoski.

Each of the right and left boot adapter 150, 151 comprises:

- an inner boot coupling part 19 configured to be positioned at an inner side of the boot and configured to engage the inner receiving unit 18, wherein the inner boot coupling part comprises an inner contact surface 155 which faces upward,
- an outer boot coupling part 21 configured to be positioned at an outer side of the boot and configured to engage an outer receiving unit of a coupling assembly for a board, wherein the outer boot coupling part 21 comprises an outer contact surface 156 which faces upward.

A side 158 of the outer boot coupling part 21 is curved.

The outer boot coupling part 21 and the inner boot coupling part 19 are interconnected by a rigid plate 160, in particular a steel plate, configured to extend underneath the boot 40 from a right side 170 of the boot to a left side 171 of the boot and to project outwards on the left side and the right side of the boot when seen in top view. The outer and inner boot coupling parts 21,19 are connected to opposite outer ends 161, 162 of the rigid plate and extend upward from the rigid plate and are configured to be positioned at a right side 170 and a left side 171 of the boot 40 and configured to engage and be held by an outer receiving unit 20 of a coupling assembly 12, 14 which is mounted on the board.

The plate 160 is configured to be connected to the boot via bolts 166. The bolts can extend through slots or holes 113 in the boot. The slots may comprise relief to increase the grip of the bolts.

Each coupling assembly 12, 14 comprises a coupling base 55 via which the coupling assembly can be mounted to the board 16. The coupling base may comprise mounting holes for bolts 130. In this embodiment, the coupling base also interconnects the inner and outer receiving unit. However, it is also conceivable that the inner and outer receiving unit are not interconnected, but separate. In such an embodiment, both the inner and outer receiving unit would have a separate coupling base.

Each inner receiving unit comprises a locking arm 22 which is pivotable from a locked position 25 to a released position 26 and vice versa about a main inner pivot axis 24. The locking arm is connected to the coupling base via the main inner pivot axis 24 and two inner struts 280. The main inner pivot axis 24 of the right and left coupling assembly is oriented horizontally.

The locking arm 22 comprises an inner locking cam 28 configured to engage the inner boot coupling part 19 and to hold the inner boot coupling part in place. In the locked position 25 of the locking arm the inner locking cam 28 faces downward.

Each outer receiving unit 20 comprises an outer locking element 30 configured to engage the outer boot coupling part 21 and to hold the outer boot coupling part in place. In this embodiment the outer locking element 30 comprises two openings 47 in a plate 45. The plate 45 is curved. The outer boot coupling part 21 comprises two projections 46 which are inserted in the openings 47. Obviously, a mechanical inversion is also possible.

Each inner receiving unit 18 comprises a release arm 42 pivotably connected to the locking arm 22 and being pivotable relative to the locking arm about the release arm pivot axis 49. The release arm 42 is connected to an upper end 65 of the locking arm. The main inner pivot axis 24 and the release arm pivot axis 49 are located at opposite ends of the locking arm 22. The release arm pivot axis 49 of the right and left coupling assembly is oriented horizontally. The main inner pivot axis 24 and the release arm pivot axis 49 are parallel.

The release arm comprises a slot 44 having a stop 61 at one end and an opening 62 at the opposite end, wherein the boot strap comprises a slider 43 configured to be accommodated in the slot, wherein in the first position 50 the slider 43 engages the stop 61 and is held in place by the stop, and wherein in the second position 51 the slider leaves the slot via the opening thereof.

The release arm pivot axis 49 of the right and left coupling assembly is oriented transverse, in particular orthogonal to a main coupling axis 60 (see FIG. 5) which extends from the inner receiving unit 18 to the outer receiving unit 20.

Each coupling assembly 12, 14 further comprises a boot strap 36 (also indicated with the functional term link pull member 36 because of its function to pull the elongate interlink member 48). The boot strap 36 is configured to extend over the boot 40 (right boot 40R, left boot 40L). The boot strap 36 is resilient. One end 37 of the boot strap 36 is connected (indirectly) to the locking arm 22. The opposite end 38 of the boot strap is connected to the outer receiving unit 20. In an alternative embodiment, the opposite end 38 may be connected to the boot 40 itself. The end 37 is connected to the locking arm 22 via a bracket 39 and the release arm 42. The boot strap 36 is configured to provide pretension on the locking arm 22, wherein the pretension keeps the locking arm in the locked position.

The release arm 42 is pivotable relative to the locking arm between a first position 50 in which the release arm holds the boot strap 36 taut, and a second position 51 (see left side of FIG. 11). The first position 50 of the release arm 42 is associated with the locked position of the locking arm 22. The second position 51 of the release arm is associated with the released position of the locking arm 22. When both the locking arm 22 and the release arm 42 are in the locked position, the locking arm 22 extends upwards from the coupling base 55 and the release arm 42 extends downwards from the upper end 65 of the locking arm.

The coupling assembly further comprises a release arm stop 54 connected to the coupling base 55. In the first position 50 of the release arm 42, the release arm rests against the release arm stop 54 and is kept in said first position by the release arm stop. The slot 44 and the release arm 42 are curved and wherein the release arm stop 54 is curved in a corresponding manner.

The inner receiving unit 18 of each coupling assembly comprises the release arm 42 comprising a strap holder, in the form of a slot 44, configured for holding an end of a boot strap 36.

The set 10 further comprises an elongate interlink member 48 which is connected at one end 56 thereof to the release arm 42 of the right coupling assembly 12 and at the opposite end 57 thereof to the release arm of the left coupling assembly 14. Each release 42 arm comprises a cable connector 55 to which the end of the elongate interlink member 48 is connected. The cable connector 55 is located at a free end of the release arm 42.

The various parts of each coupling assembly form two mechanisms which each performs a specific function and which cooperate with one another: a force release mechanism 32 and a pull mechanism 34. The force release mechanism 32 is configured to maintain the coupling assembly in the secured position when a force exerted by one of the boot coupling parts on the coupling assembly stays below a threshold force and to release the coupling assembly when a force exerted by one of the boot coupling parts on the coupling assembly exceeds a threshold force. The pull mechanism 34 is configured to ensure that when the coupling assembly releases, the other coupling assembly also releases. This prevents a situation in which one foot of the user stays attached to the board.

Some parts belong to the force release mechanism 32, some parts belong to the pull mechanism 34 and some parts belong to both the force release mechanism 32 and the pull mechanism 34.

In this embodiment the force release mechanism 32 is associated with the inner receiving unit 20 of each coupling assembly 12, 14. The force release mechanism 32 is configured to release the inner locking cam 28 when a force on the locking cam exceeds the threshold force. The force release mechanism 32 comprises at least the locking arm 22, the inner locking cam 28 and the boot strap 36. The bracket 39 including the slider 43 and the release arm 42 are also considered to form part of the force release mechanism 32.

The pull mechanism 34 is also associated with—and incorporated in—the inner receiving unit 18. The pull mechanism is connected to the locking arm 22. The pull mechanism 34 comprises:

- the at least one elongate interlink member 48 which extends between the two inner receiving units 18 and interlinks the two inner receiving units, and
- the boot strap 36 (also indicated with the functional term link pull member 36 because of its function to pull the elongate interlink member 48) configured to engage the boot 40 to receive a pull force from the boot or boot coupling part which is no longer held by the force release mechanism and to be pulled over a pull distance D by said boot or by the boot coupling part,
- the bracket 39 and slider 43,
- the release arm 42.

The pull mechanism 34 is configured to transfer the pull force Ft from the boot strap 36 (the link pull member) to the at least one elongate interlink member 48, and to convert the pull force Ft into an interlink pull force in the elongate interlink member 48. The pull mechanism also converts the distance over which the boot strap 36 pulls the slider 43 to a distance D over which the release arm 48 pulls the elongate interlink member 48. In this way, the locking arm 22 of the other coupling assembly is pivoted from the locking position to the released position, thereby releasing the other boot. The distance D is difficult to indicate in a figure because the elongate link member also moves upward as a result of the pivoting movement of the release arm 48.

Operation of First Embodiment

In operation, when both coupling assemblies are secured (FIGS. 1-6, 8-9), the tension force (Ft) in the boot strap 36 holds the locking arm 22 in place and ensures that the inner locking cam 28 holds the inner boot coupling part 19 secured in its place. In this state the user can safely do board sports with both feet secured to the board. The coupling assemblies 12, 14 can take serious loads without releasing.

Figure 7:
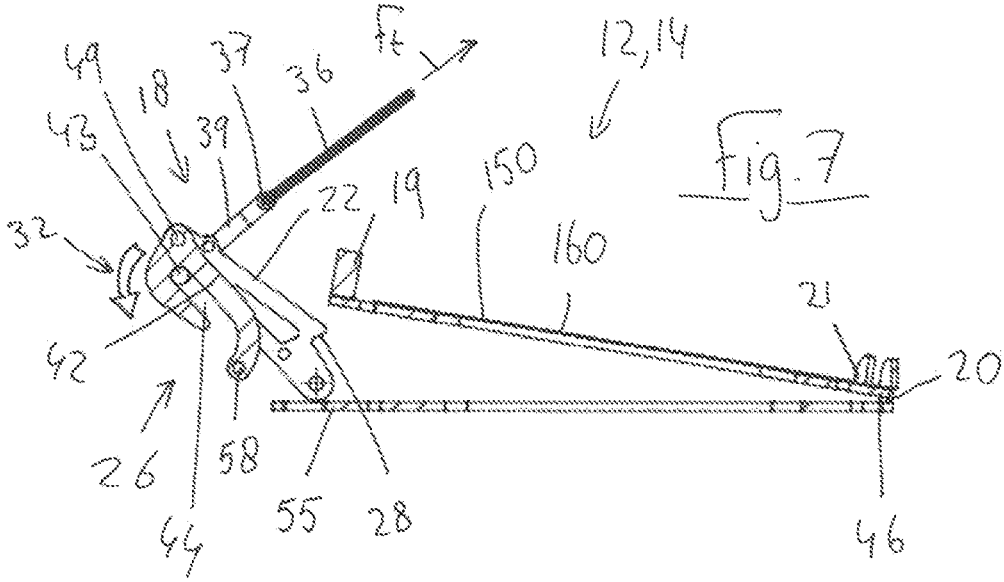
Figure 8:
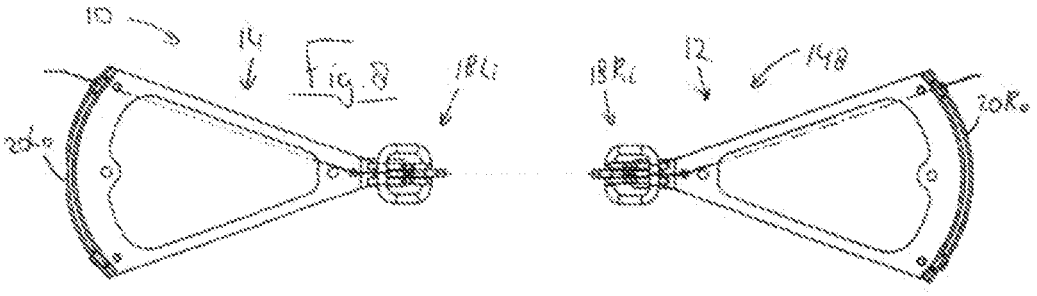
FIGS. 8, 9 and 10 show respectively a top view, side view and sectional view of a set of the first embodiment.

Turning to FIG. 7, when the inner boot coupling part 19 exerts a force on the inner locking cam 28 which exceeds a certain threshold force, the locking arm 22 is initially pivoted against the pretension of the boot strap 36, the locking arm 22 pivots from the locked position 25 to the released position 26. During this movement the inner locking cam 28 moves away from the inner boot coupling part 19 and the inner boot coupling part 19 is released from under the inner locking cam 28.

Figure 10:
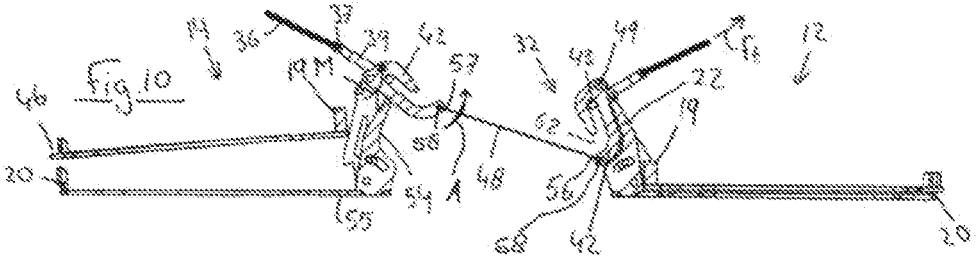
Figure 11A:
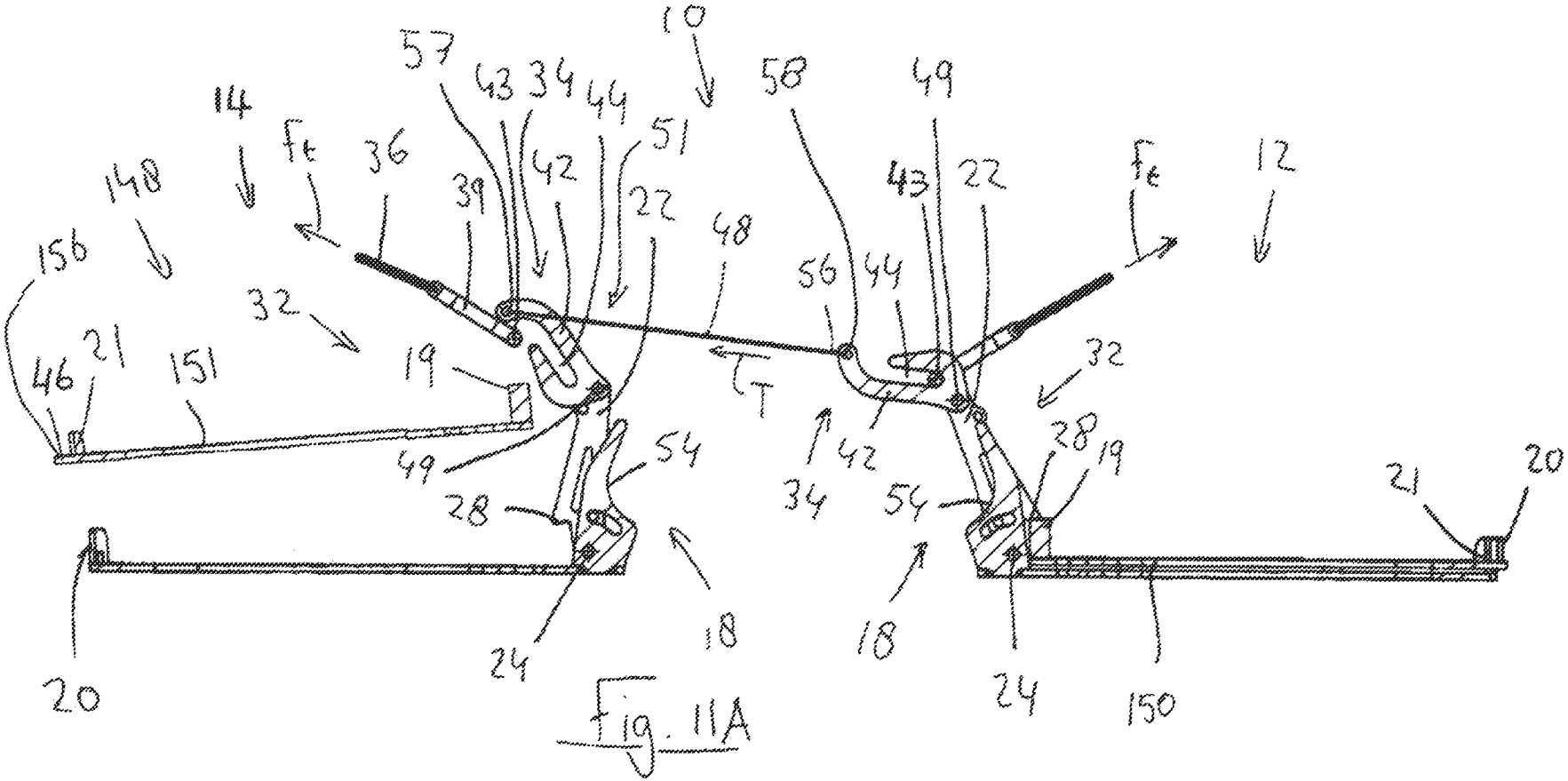
FIGS. 11A and 11B show sectional side views of the set when being released.
Figure 11B:
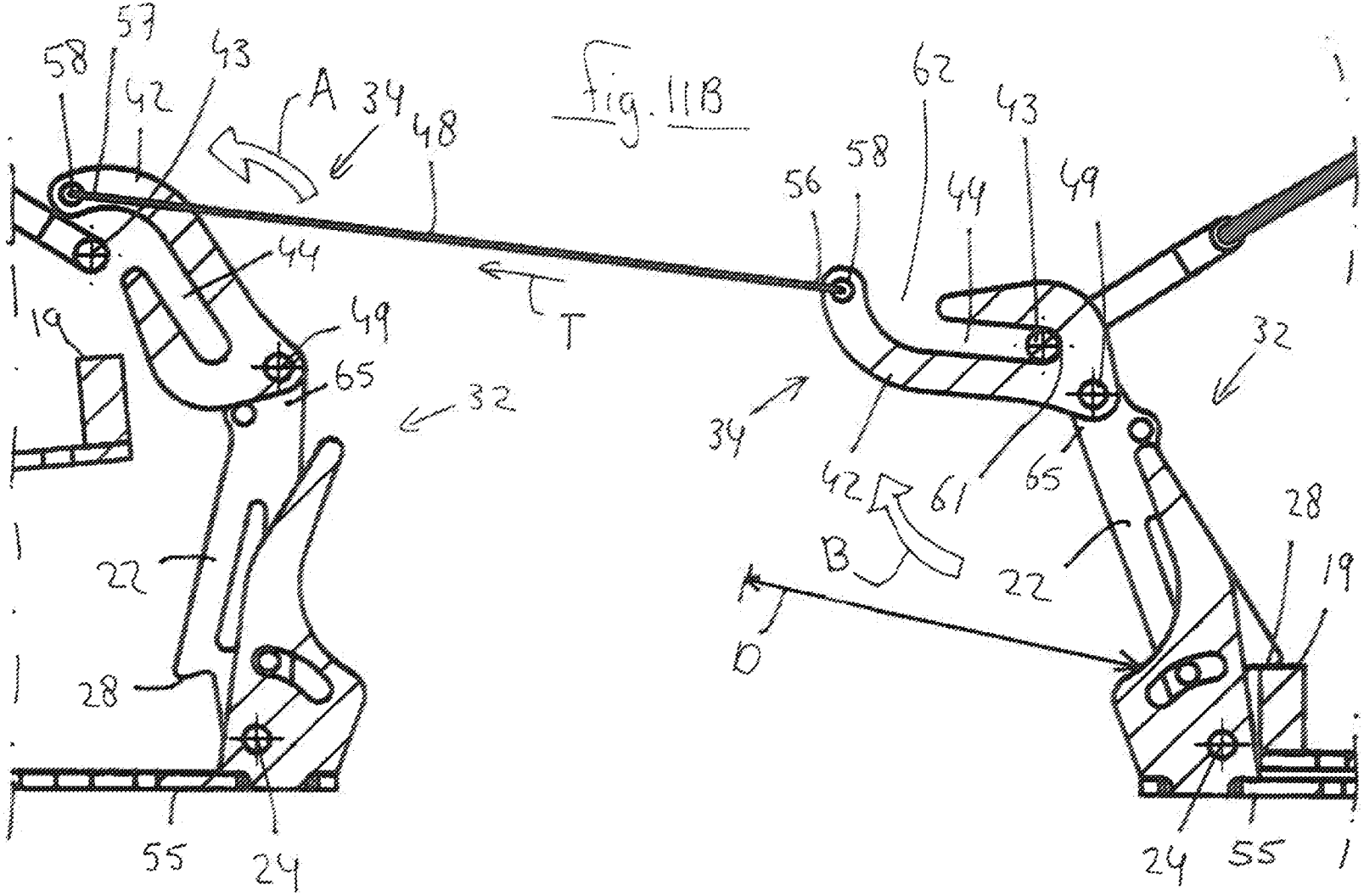
Figure 12:
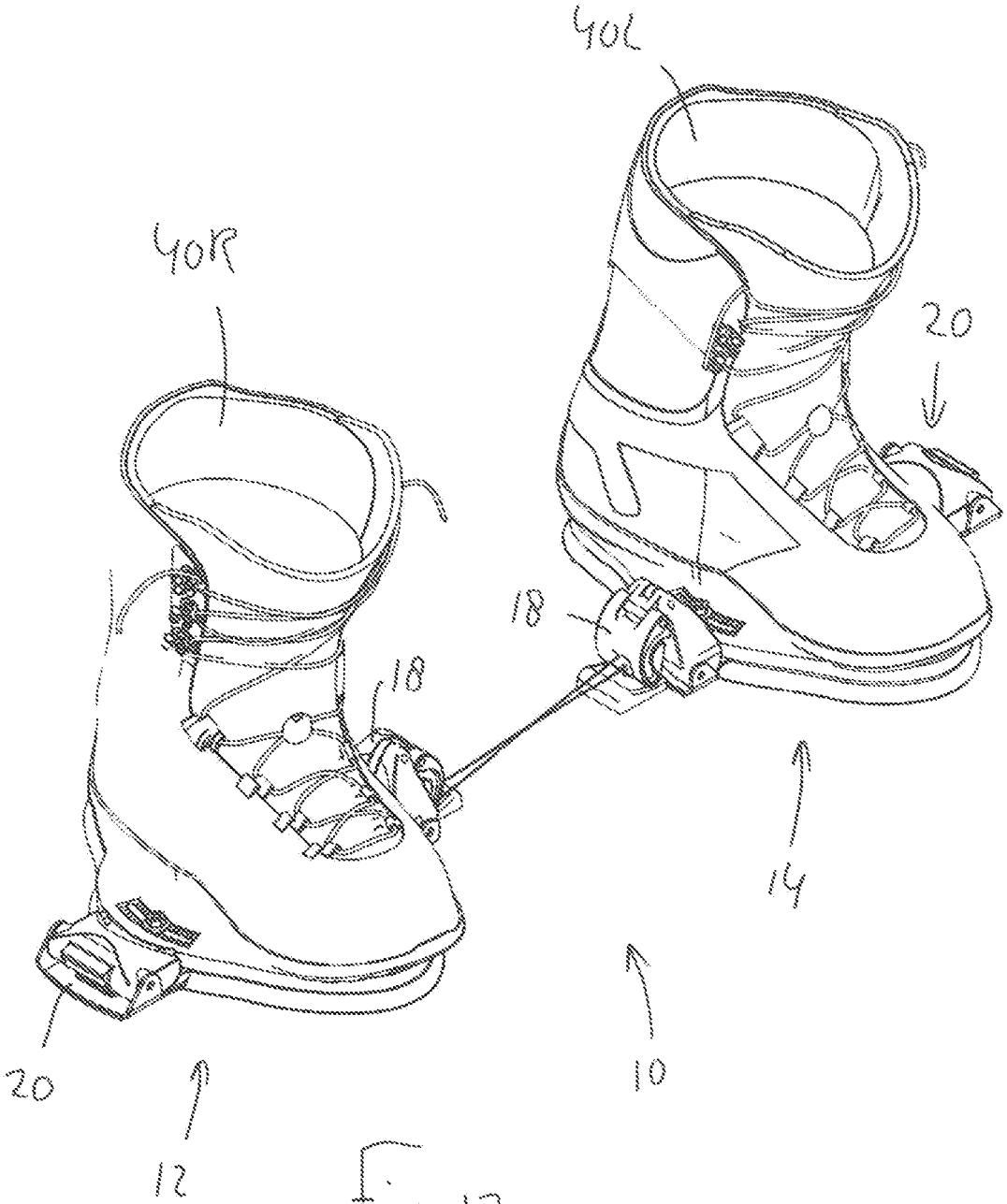
FIG. 12 shows an isometric view of a second embodiment of the invention.
Figure 13:
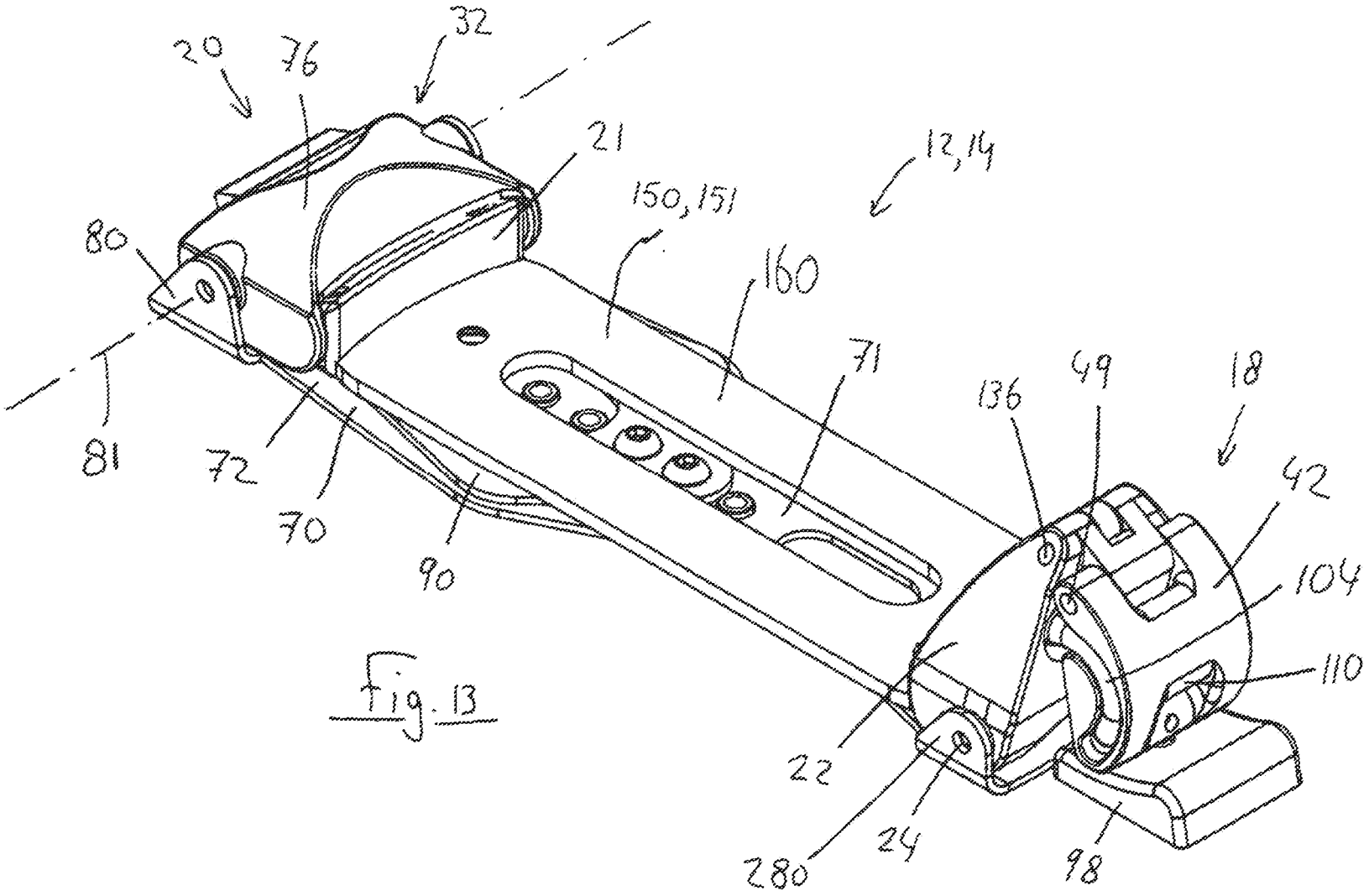
FIG. 13 shows an isometric view of a the coupling assembly of the second embodiment.
Figure 14A:
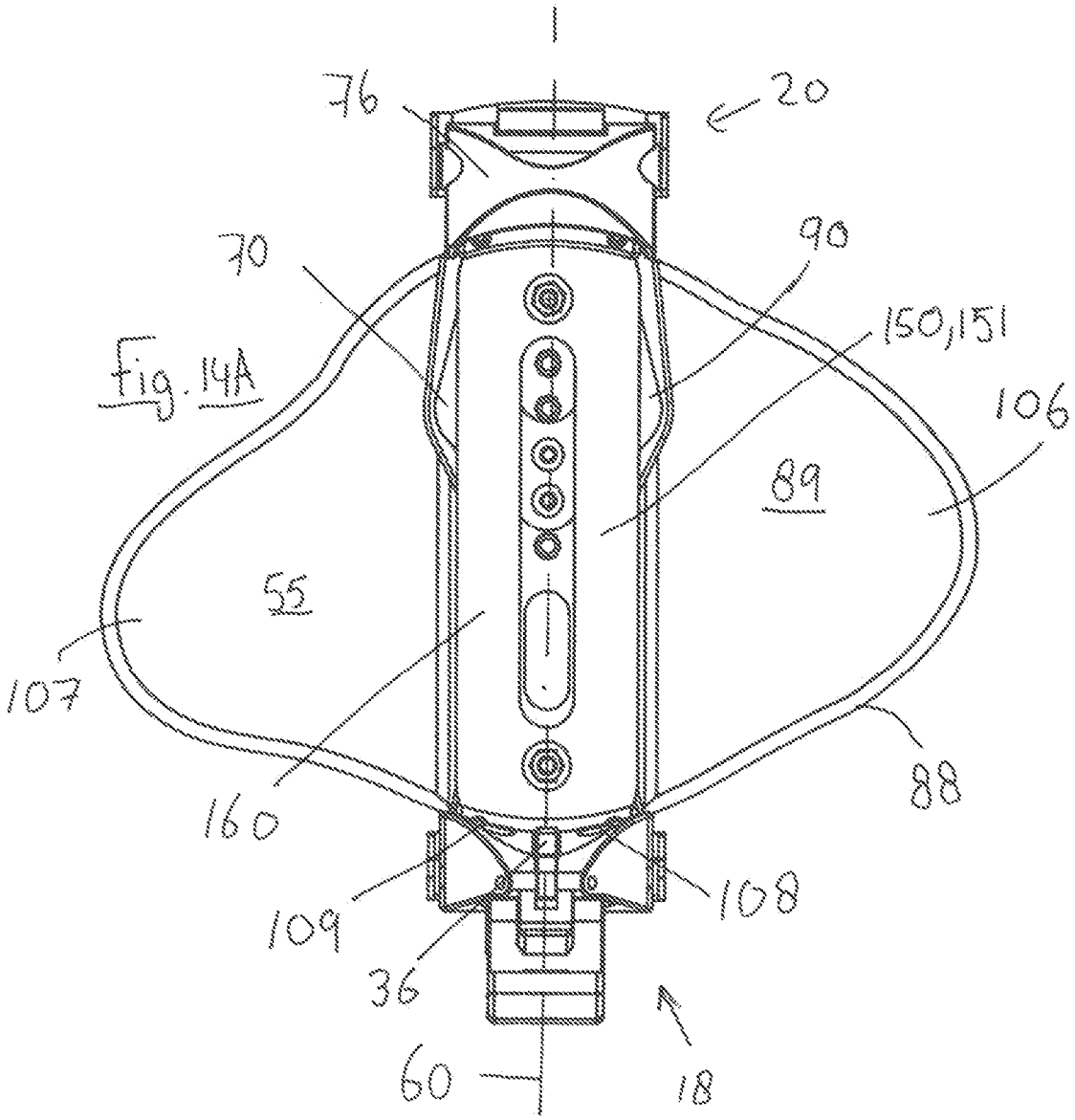
FIGS. 14A and 14B show a top view and a side view of the coupling assembly.
Figure 14B:
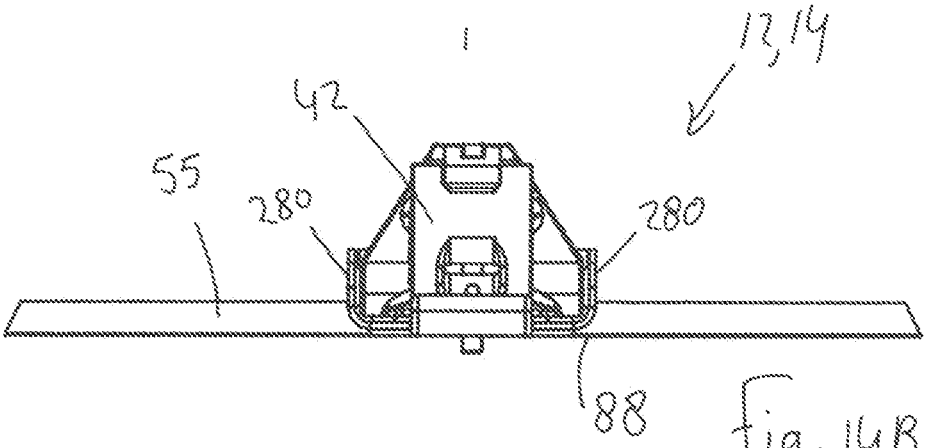

Turning to FIGS. 10, 11A and 11B, subsequently the locking arm 22 is pivoted in the opposite direction under the pretension of the boot strap 36. During this movement the release arm 42 pivots about the locking arm from the first position 50 to the second position 51 as indicated by arrow A, thereby pulling the elongate interlink member 48 as indicated by arrow T in order to uncouple the other coupling assembly.

During the pivoting movement the release arm 42 also releases the boot strap 36. The boot strap 36 is released because the opening in the slot is turned in the direction from which the boot strap pulls and as a result the bracket 39 slides out of the slot 44. FIG. 10, left side, shows the release arm 42 in an intermediate position during the pivoting movement from the first position 50 to the second position 51.

Figure 9:
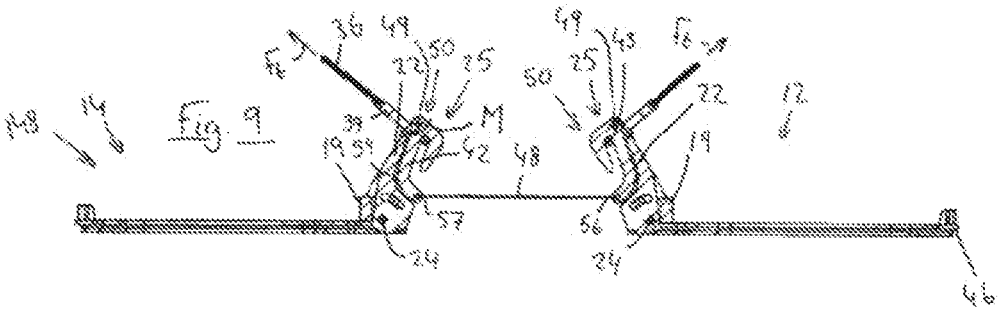

During the movement of the release arm 42 from the first position 50 to the second position 51 a moment M which is exerted by the force Ft from boot strap 36 on the release arm 42 about the release arm pivot axis 49 reverses as a result of a change in position of a force axis of the force Ft relative to the release arm pivot axis 49. In FIG. 9, this moment is clockwise, thereby pressing the release arm 42 against the release arm stop 54. In FIG. 10, this moment is counter clockwise, thereby pulling the release arm 42 in a counter clockwise direction away from the release arm stop 54, upwards and over the locking arm 22 as indicated by arrow A.

The pull force exerted by the elongate interlink member pivots the release arm 42 of that other inner receiving unit relative to the associated locking arm 22. The release arm 42 in turn pulls the locking arm 22 of the other inner receiving unit 18 from the locked position to the released position by pulling the release arm 42 as shown in FIGS. 11A and 11B.

The set 10 may comprise only the coupling assemblies 12,14. The set may also include the board 16 itself, wherein the right coupling assembly 12 and the left coupling assembly 14 are mounted on the board and wherein the right and left coupling assembly are interconnected via the at least one elongate interlink member 48. The set 10 may also comprise the coupling assemblies and the boot adapters, or the coupling assemblies, the boot adapters and the board and/or the boots.

When the coupling assemblies are mounted on the board, wherein the main inner pivot axis 24 of the right and left coupling assembly is oriented transverse to a longitudinal axis of the board. The main inner pivot axis 24 extends horizontally.

When the coupling assemblies are mounted on the board, the elongate interlink member is not under tension or under compression. This allows flexing of the board without the coupling assemblies being released. The set of coupling assemblies does not comprise a compression spring.

Second Embodiment

Turning to FIGS. 12-23, another embodiment of a set 10 of coupling assemblies 12, 14 according to the invention is shown. In this embodiment, the force release mechanism 32 and the pull mechanism 34 are separate. The force release mechanism 32 is associated with the outer receiving unit 20 and the pull mechanism 34 is associated with the inner receiving unit 18. In this embodiment the inner receiving unit 18 does not comprise a force release mechanism 32. Each coupling assembly 12, 14 is configured to hold the boot 40 (via the boot coupling parts) only on the left and right side thereof and not on the heal end and on the toe end of the boot.

The force release mechanism 32 comprises a leaf spring 70. The leaf spring 70 is part of the coupling base 55 and interconnects the inner and outer receiving unit. However, it is also possible that the inner and outer receiving units are separate and not interconnected. It is also possible that the inner and outer receiving unit 18, 20 are interconnected by a plate or other member which is separate from the leaf spring 70.

The leaf spring 70 comprises a fixed part 71 which is configured to be fixed to the board and a movable part 72, wherein the movable part is not fixed to the board. The movable part 72 of the leaf spring 70 is connected to the outer receiving unit 20, and wherein when seen in top view the movable part of the leaf spring is directed away from the inner receiving unit 18.

The movable part 72 of the leaf spring is configured to move in a direction 83 away from the board when a force is exerted on the movable part of the leaf spring, said force flexing the leaf spring 70. Each coupling assembly 12, 14 comprises only a single leaf spring 70.

The force release mechanism 32 comprises a stop 75 configured to be fixed to the board. The stop 75 is connected to the fixed part 71 of the leaf spring 70, but may be fixed to the board in a different way.

The force release mechanism 32 further comprises a hold and release component 76 which is connected to the movable 72 part of the leaf spring. The hold and release component comprising the outer locking element 30 configured to engage the outer boot coupling part 21 and to hold the outer boot coupling 21 part in place. The hold and release component 76 is pivotably connected to the movable 72 part of the leaf spring 70 via two outer struts 80 and a hold and release axis 81.

The hold and release component 76 is pivotable about the hold and release pivot axis 81. The hold and release pivot axis extends in particular substantially parallel to a main upper side 82 of the leaf spring 70 and extends transverse to a main longitudinal direction of the leaf spring.

The hold and release component 76 further comprises a threshold part 78 configured to engage the stop 75. An upward force exerted on the boot coupling part 21 by the boot is transferred into the hold and release component 76 via the outer locking element 30. The upward force is then transferred onto the movable part 72 of the leaf spring 70 via the hold and release axis and the outer struts 80 which are connected to the movable part 72.

The hold and release component 76 is pivotable between a secured position 84 and a released position 85. In the secured position 84 the threshold part 78 engages the stop 75, thereby preventing the hold and release component 76 from pivoting. In said secured position the boot holding surface holds the inner or outer boot coupling part in place. When the force on the movable part 72 of the leaf spring is below the threshold force the leaf spring may deform somewhat in the direction 83 as a result of which the hold and release component 76 moves upward, but not enough to release the force release mechanism 32.

The hold and release component 76 is biased to the secured position. This is carried out by the curvature of the surface 175 which adjoins the threshold part 78. The surface 175 has a curvature with a varying radius from the axis 81. Near the threshold pat 78 the radius r1 is relatively small and the radius increases to a larger radius r2 when traveling away from the threshold part. Due to the curvature, the hold and release component will be urged to the secured position. It is also possible to use an extra spring.

In the released position 85 the threshold part moves upward as indicated by arrow 83 until it is located above the stop 75 and is no longer engaged with the stop, allowing the hold and release component 76 to pivot in the direction of arrow 73 and to release the outer boot coupling part by the pivoting movement.

The leaf spring 70 comprises one or more mounting holes 86 via which it can be mounted to the board 16. The leaf spring 70 is configured to be mounted on the board with the main upper side 87 thereof oriented parallel to an upper side 17 of the board, and wherein to this end the main upper side 87 of the leaf spring extends substantially parallel to an underside 88 of the coupling base 55.

When seen in top view the fixed part 71 of the leaf spring is positioned at least partially and in particular completely between the inner receiving unit 18 and the outer receiving unit 20. When seen in top view the movable part 72 of the spring leaf extends outwardly from a location between the inner receiving unit 18 and outer receiving unit 20 to a location beyond a contour 88 of a boot position 89. The contour 88 of the boot position may be defined by the outer contour of the coupling base 55 but essentially this contour is defined by a boot 40 when the boot is positioned in the coupling assembly.

The configuration with the leaf spring 70, the hold and release component 76 and the stop 75 can be applied independently of other aspects of the present invention, for instance in a coupling of a ski.

Figure 15A:
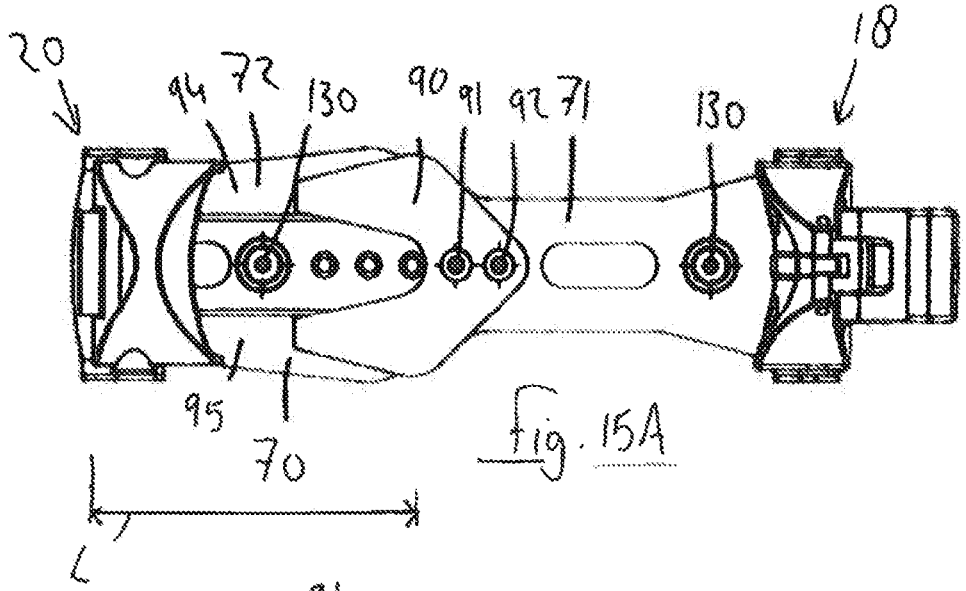
FIGS. 15A, 15B and 15C show top views of the leaf spring.
Figure 15B:
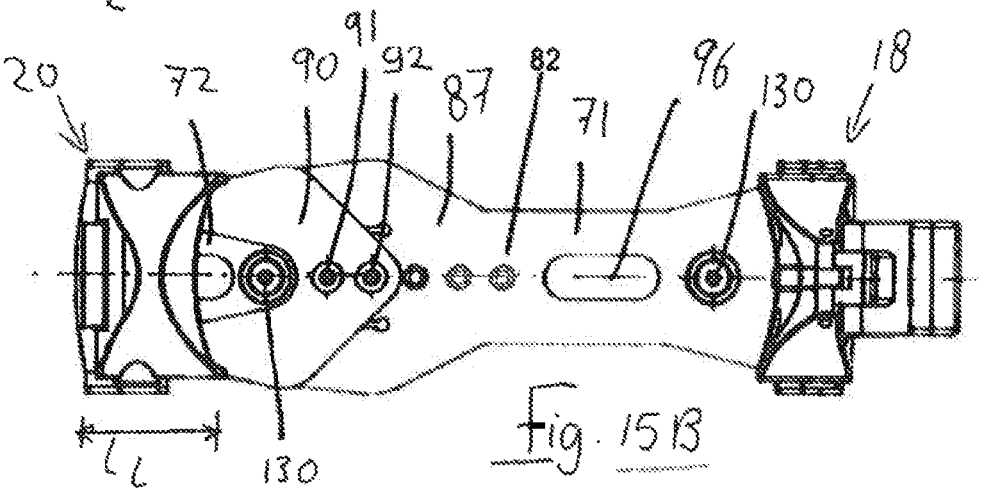
Figure 15C:
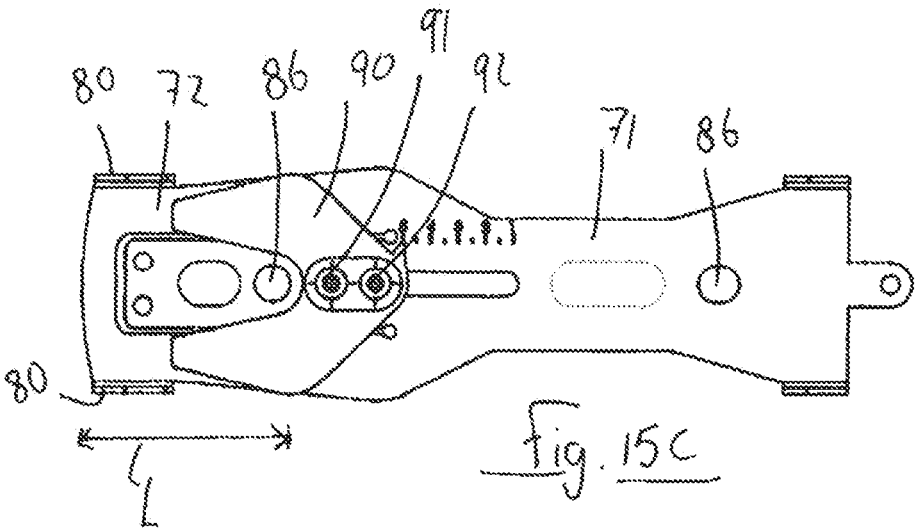
Figure 16:
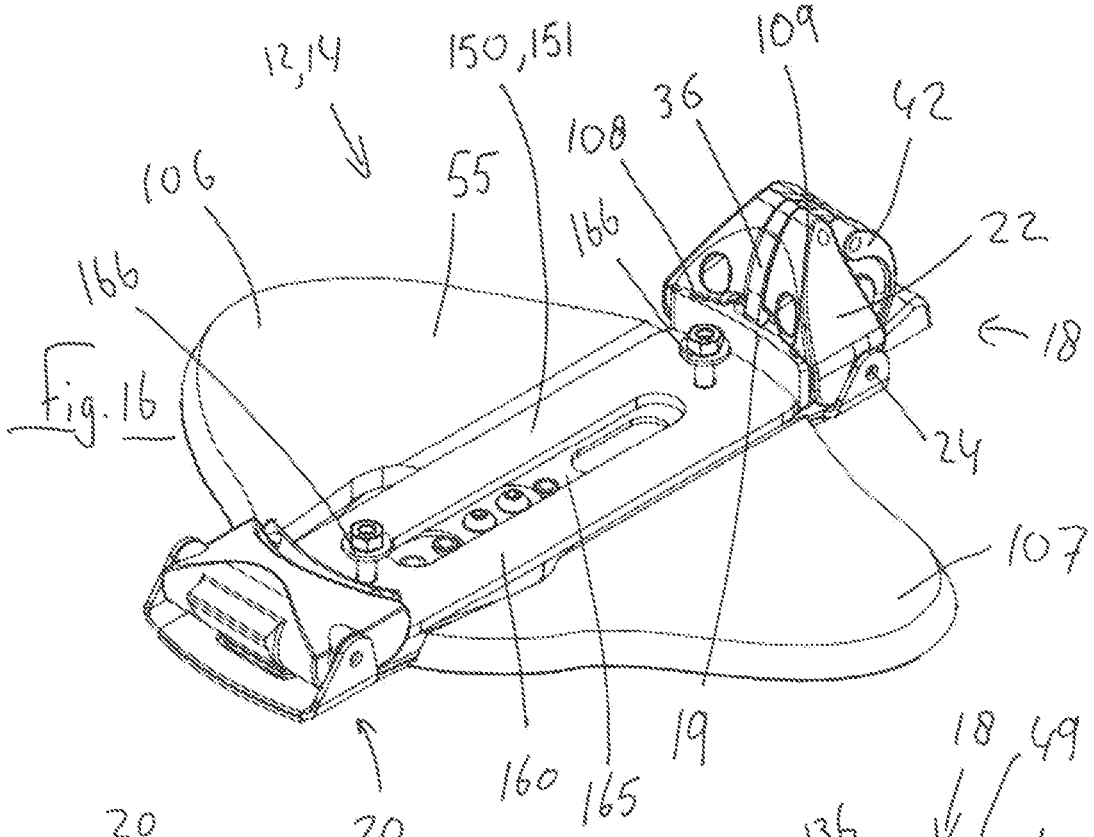
FIG. 16 shows another isometric view of a the coupling assembly of the second embodiment.
Figure 17:
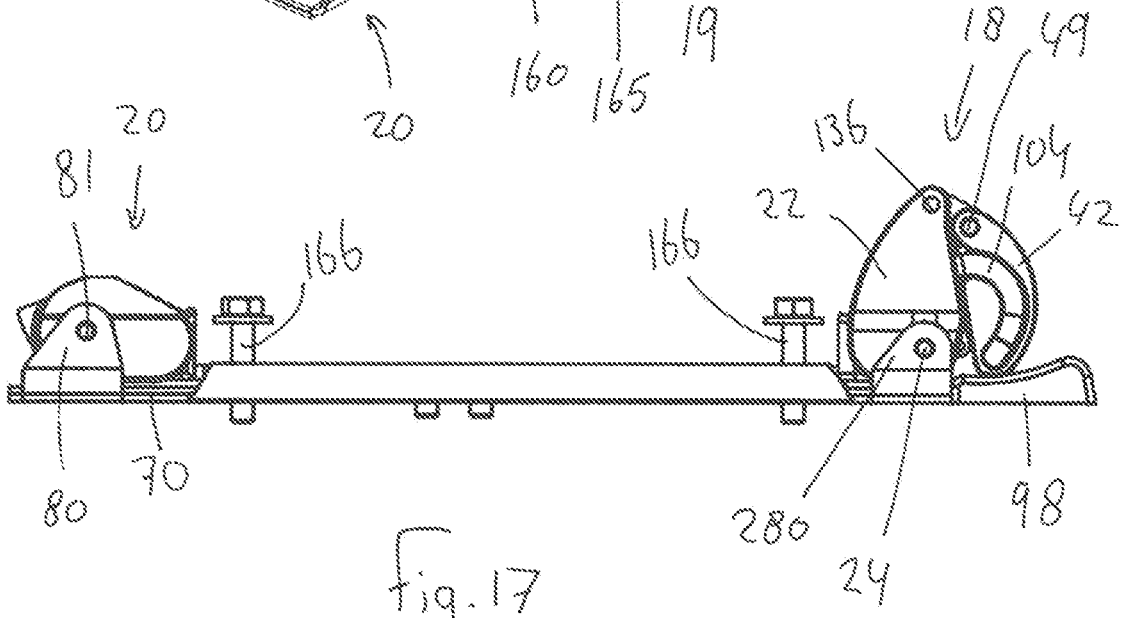
FIG. 17 shows a sectional side view of the coupling assembly of the $2^{nd}$ embodiment.
Figure 18:
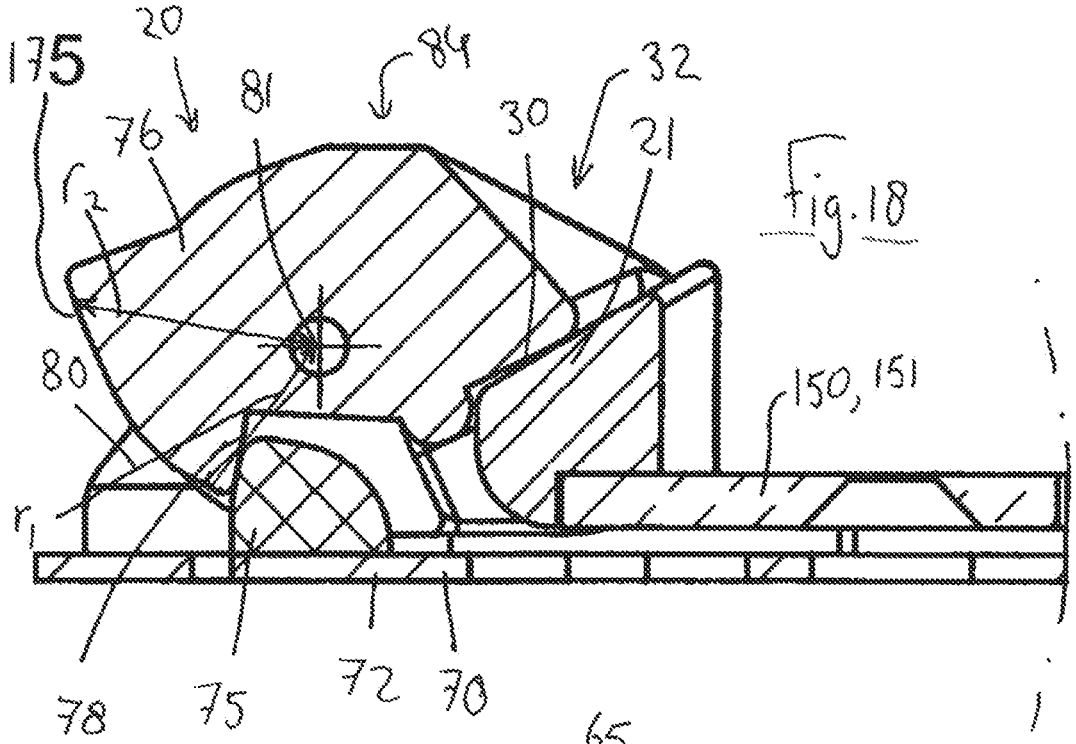
FIG. 18 shows a detailed sectional side view of the outer receiving unit of the $2^{nd}$ embodiment.
Figure 19A:
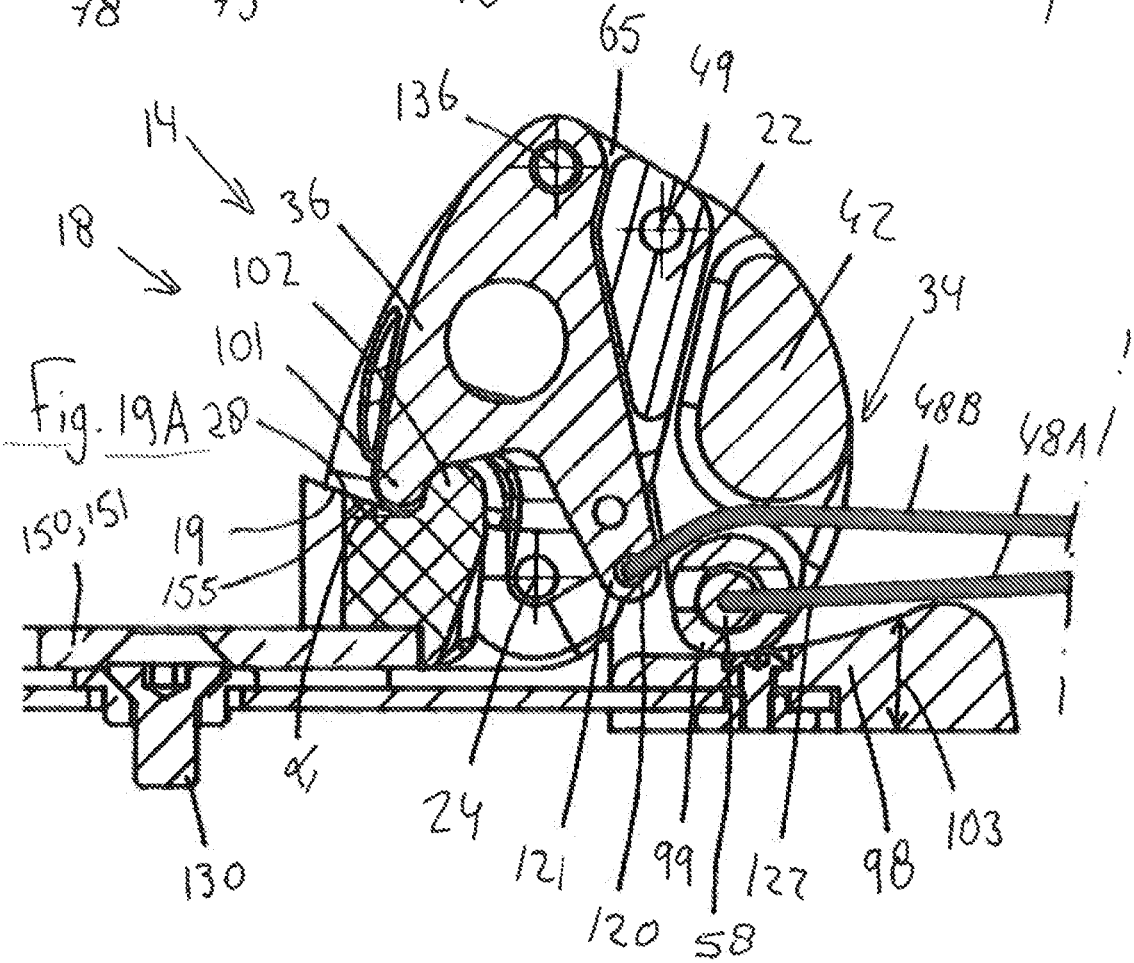
FIGS. 19A, 19B, 19C show detailed sectional side views of the inner receiving unit of the $2^{nd}$ embodiment in various positions.
Figure 19C:
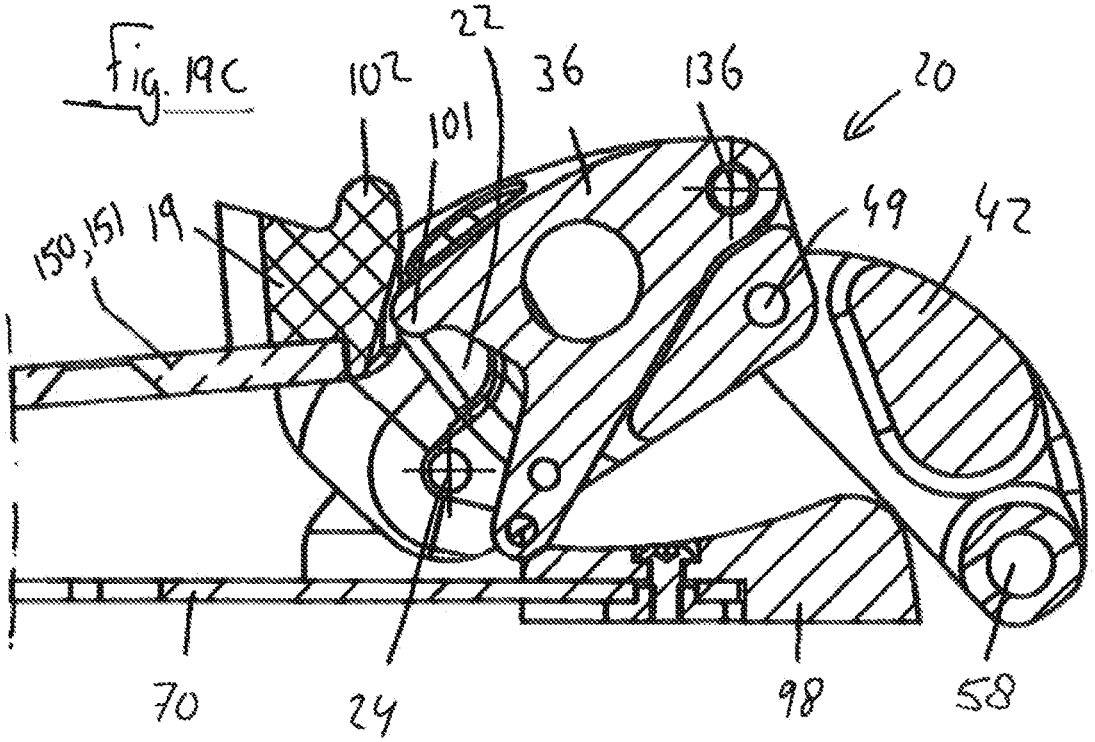
Figure 19B:
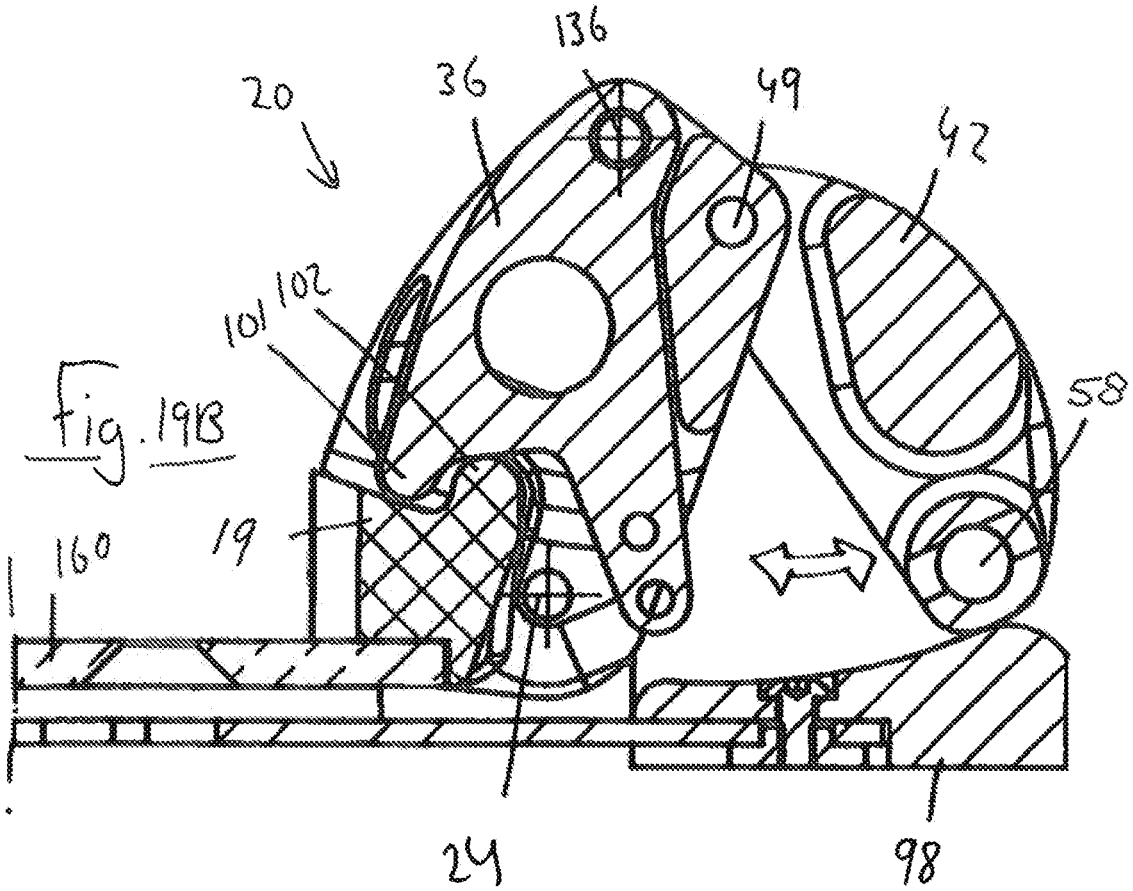
Figure 20:
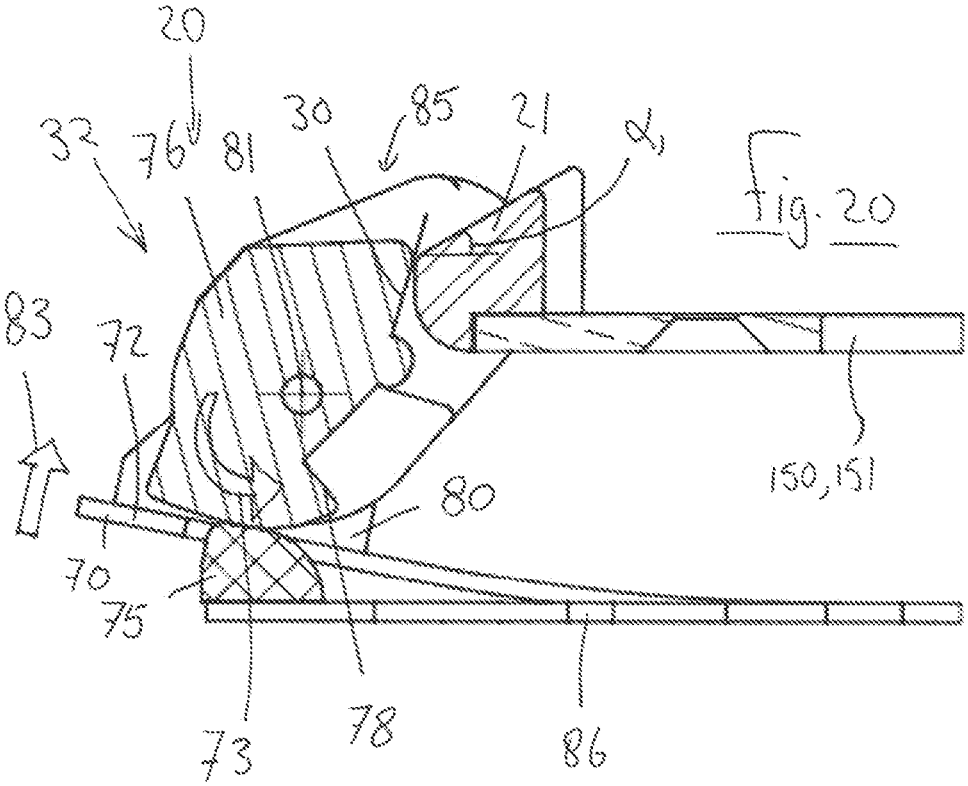
FIGS. 20 and 21 show sectional side views of the releasing outer receiving unit.
Figure 21:
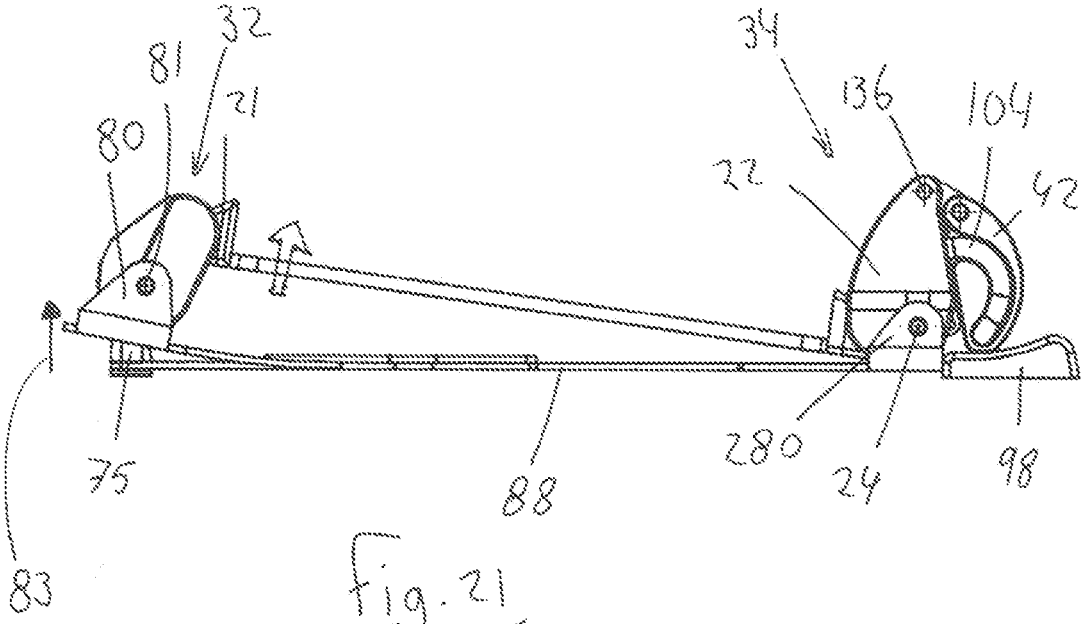
Figure 24:
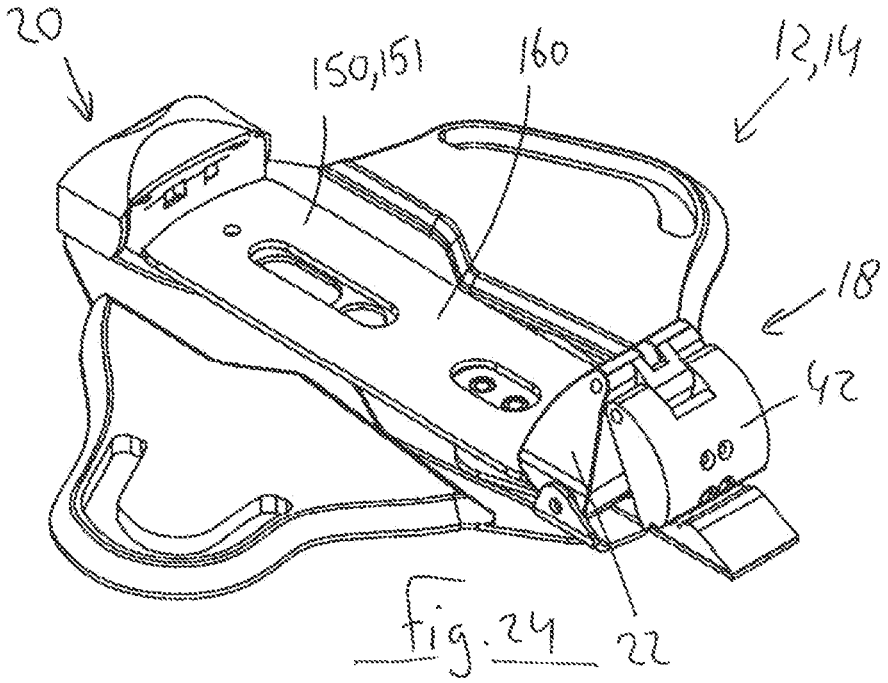
FIG. 24 shows an isometric view of a third embodiment.
Figure 25:
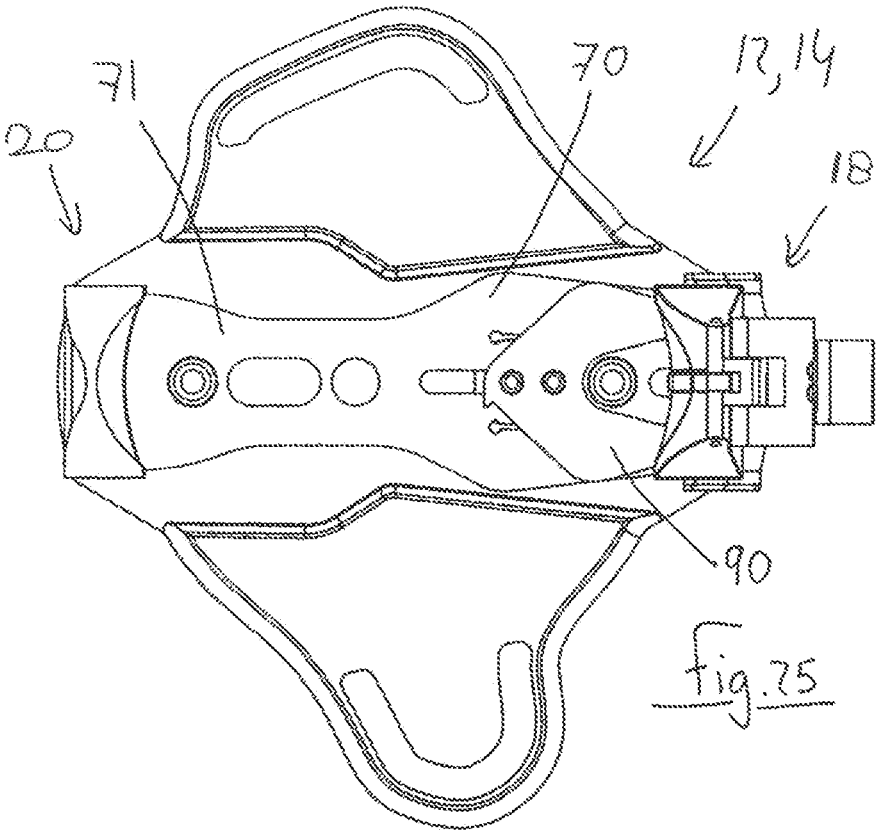
FIG. 25 shows a top view of the third embodiment.
Figure 26:
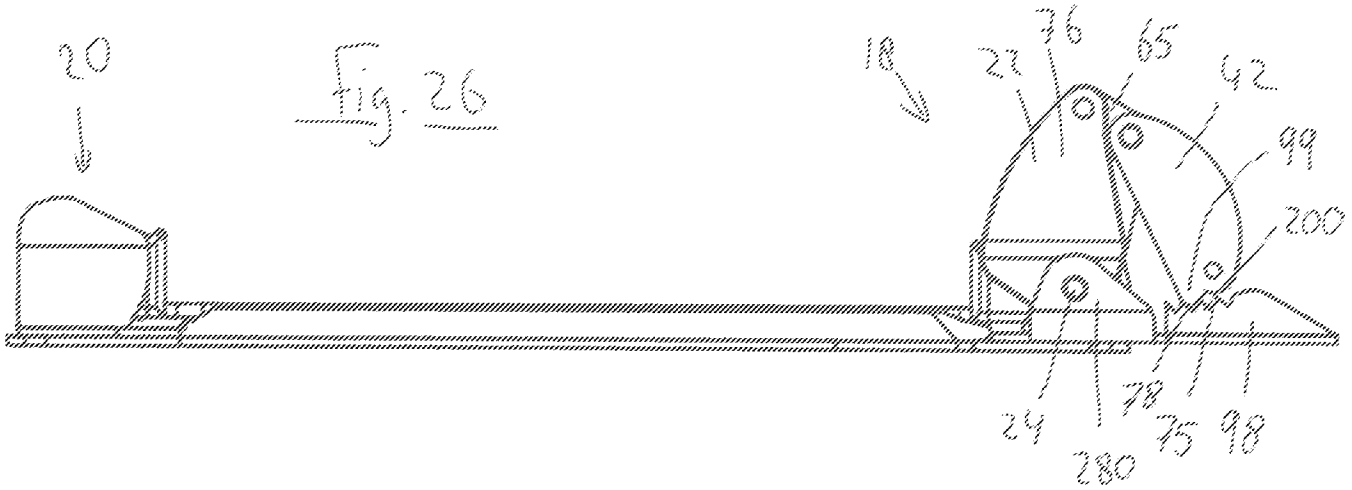
FIGS. 26, 27 show respectively a side view and a sectional side view of the third embodiment.
Figure 27:
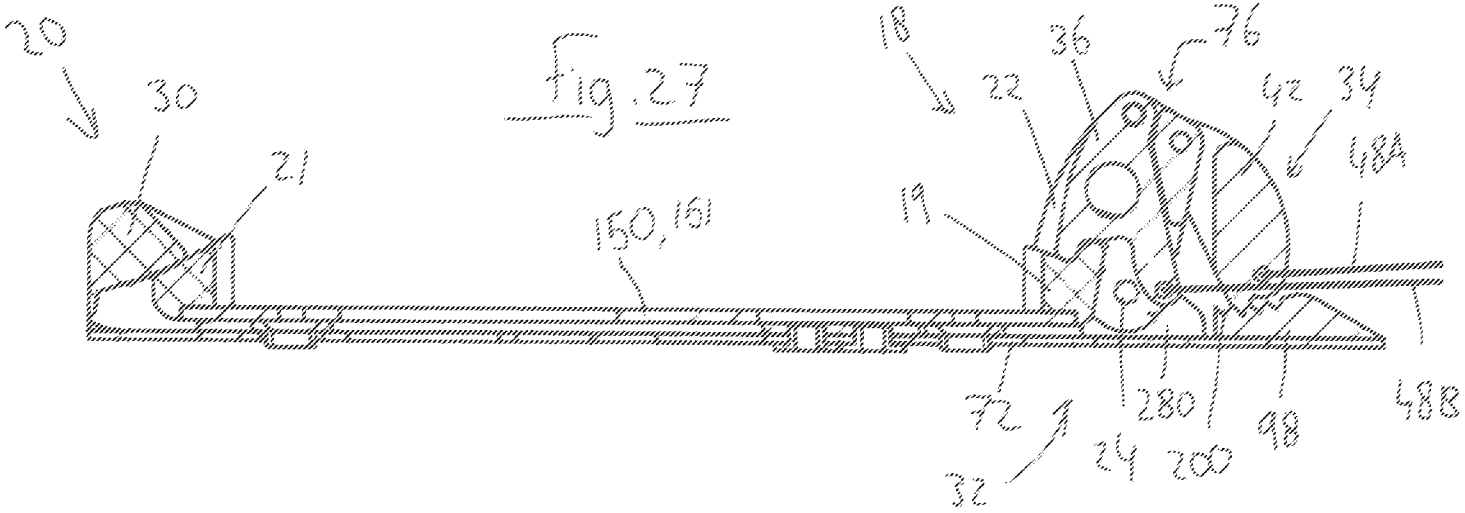
Figure 28:
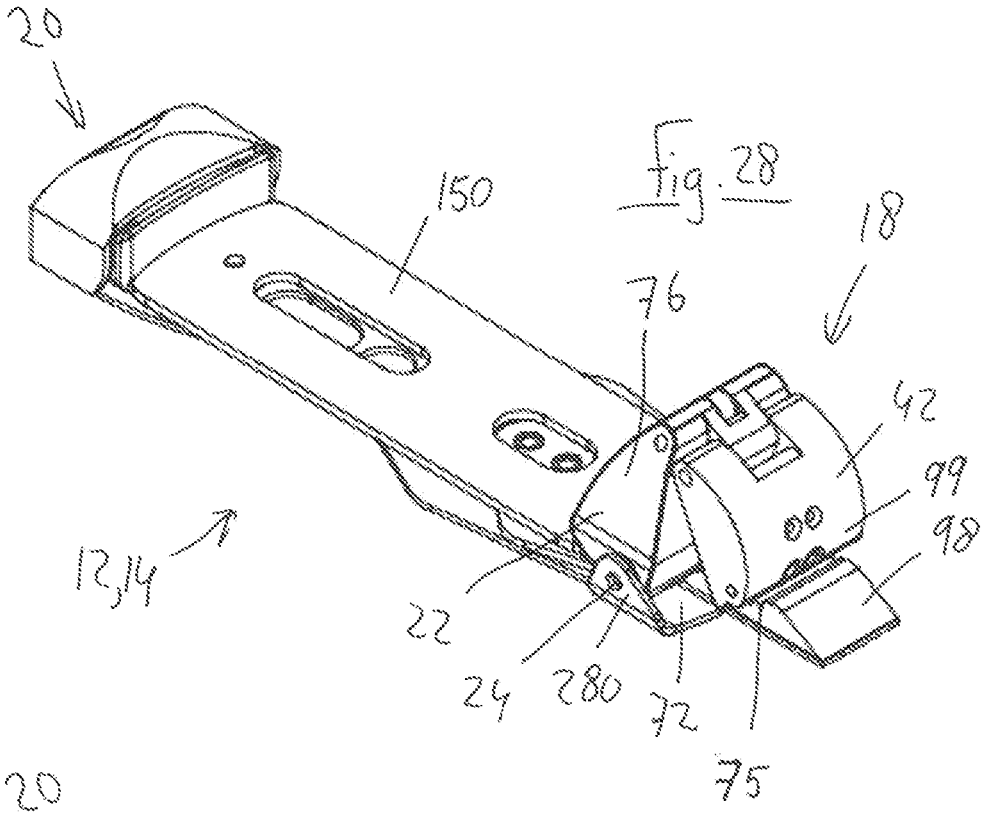
FIGS. 28, 29 show isometric views of the third embodiment with and without a boot adapter.

Turning to FIGS. 15A, 15B, 15C the coupling assembly comprises an adjustment member 90 for adjusting the stiffness of the leaf spring 70. The adjustment member 90 is in particular configured to adjust the length of the movable part 72. The adjustment member 90 can be a plate which can be mounted on top of the leaf spring 70 and fixed to the leaf spring at a number of different positions via bolts 91, 92. By varying the position of the adjustment member 90, the length L of the movable part 72 is adjusted, thereby adjusting the stiffness of the leaf spring. FIG. 15A shows the leaf spring 70 with the adjustment member in a "flexible" position. FIG. 15A shows the leaf spring 70 with the adjustment member 90 in a "rigid" position. FIG. 15C shows an embodiment wherein the adjustment member is slidable in a stepless manner.

In top view the adjustment member 90 is positioned between the inner receiving unit 18 and the outer receiving unit 20. The adjustment member 90 is movable in a direction substantially parallel, in particular parallel, to a main coupling axis 60 which extends between the inner receiving unit and the outer receiving unit.

The adjustment member 90 may also be a rotary unit. Other variants are also conceivable.

As an alternative to the adjustment member 90, the leaf spring 70 may be exchangeable. In this embodiment the set 10 comprising at least one additional leaf spring (typically at least two) having a different stiffness. For instance the leaf springs of the replacement set may have a different thickness or be made of a different material which is less or more resilient.

In an embodiment, the movable part 72 of the leaf spring comprises a right section 94 and a left section 95 wherein when seen in top view the fixed part 71 extends between the right and left section 94,95. The hold and release component is connected to an end of the leaf spring 70 via the outer struts 80. In top view the stop 75 may be positioned in a space between the projections.

The leaf spring 70 comprises a longitudinal axis 96 which is intended and configured to be oriented parallel to a longitudinal axis 97 of the board 16. To this end the longitudinal axis 96 of the leaf spring is oriented substantially parallel, in particular parallel, to the main coupling axis 60 which extends between the inner receiving unit 18 and the outer receiving unit 20.

Turning to FIGS. 12-23, each inner receiving unit 18 has a number of parts which are similar to the embodiment of FIGS. 1-11B. In particular the pivotable locking arm 22 having an inner locking cam 28 and the pivotable release arm 42 are also present.

In this embodiment, the inner receiving unit 18 comprises a ramp 98 which faces upwards. The ramp 98 is curved in a concave manner, and a height 103 of the ramp increases when traveling away from inner receiving unit.

The release arm 42 comprises a second end 99 (also referred to as the free end) being configured to slide toward and away from the locking arm 22 over the ramp and to a position beyond the ramp between a release arm secured position and a release arm released position. In the release arm secured position the release arm 42 is located relatively close to the locking arm 18 and secures the locking arm in the locked position. In the release arm released position the release arm is located beyond the ramp and releases the locking arm, allowing the locking arm to pivot to its released position.

In this embodiment, the link pull member 36 of each inner receiving unit 18 is pivotably connected to the locking arm 22, in particular via a link pull member axis 136 at the upper end 65 of the locking arm 22.

The link pull member 36 of each coupling assembly 12,14 comprises a pull protrusion 101 configured to be pulled by a projection 102 on the inner boot coupling part 19 over a distance, in particular in a direction away from the locking arm 22. To this end the projection 102 comprises a surface which in use faces the boot (or boot position). The pull protrusion 101 comprises a surface which faces away from the boot (or boot position).

The projection 102 and the pull protrusion 101 have a shape which bears some resemblance to a hook, but is very rounded in order to ensure that after the link pull member 36 has been pulled the pull protrusion 101 comes loose from the projection 102. This is important, because otherwise the boot would stay attached to the board.

The or inner boot coupling part comprises a projection 102 which projects upward from the inner or outer contact surface and which is configured to pull on a pull mechanism of a coupling assembly when the boot is released from the coupling assembly.

Each inner receiving unit 18 comprises a biasing member 104, in this embodiment an elastic band, configured to bias the release arm 42 toward the locking arm when the release arm is in the locked position. The elastic band is connected at one end to the locking arm 22 and at the other end to the release arm 42.

When seen in top view the coupling assembly 12, 14 has a toe side 106 and a heel side 107. When seen in top view the locking arm 22 including the inner locking cam 28 comprises a toe side part 108 located on a toe side of the link pull member 36 and a heel side part 109 located on a heel side of the link pull member 36. The link pull member 36 is located between the toe side part 108 and the heel side part 109.

In the locked position, the inner locking cam 28 faces downward and holds the inner boot coupling part 19 down under pretension, thereby holding the boot 40 down against the coupling base.

The link pull member 36 and the release arm 42 are both pivotably coupled to the locking arm 22.

The link pull member 36 is pivotably connected to the locking arm at a link pull member axis 136. The main inner pivot axis 24, the release arm pivot axis 49 and the link pull member axis 136 are parallel to one another.

The sliding end 99 of the release arm 42 is further configured to be manually movable across and beyond the ramp 98 toward and away from the locking arm 22 and can be used to manually release the inner receiving unit. A hand grip 110 is provided on the release arm to allow manual uncoupling.

The set 10 comprises a first elongate interlink member 48A and a second elongate interlink member 48B. The first elongate interlink member 48A is connected at one end 120 to an end 121 of the link pull member 36 of the right coupling assembly 12 and connected at the opposite end 122 to the free end 99 of the release arm 42 of the left coupling assembly 14. The second elongate interlink member 48B is connected at one end 120 to an end 121 of the link pull member 36 of the left coupling assembly 14 and connected at the opposite end 122 to the free end 99 of the release arm 42 of the right coupling assembly 12.

Second Embodiment—Boot Adapter

Figure 46:
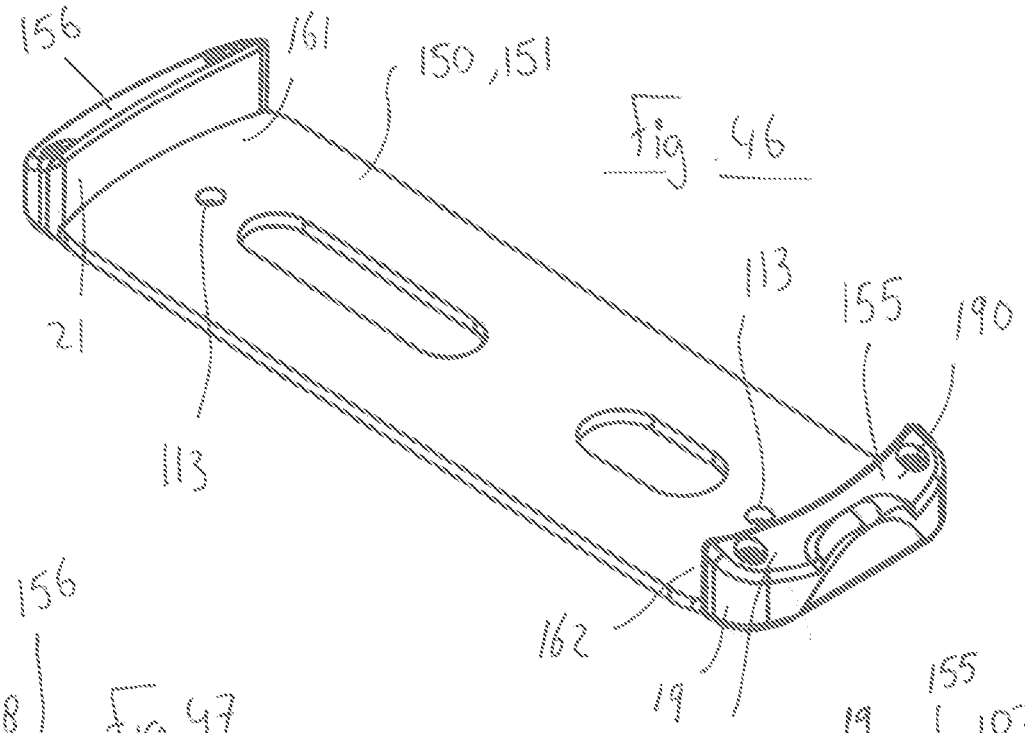
FIGS. 46-48 show another embodiment of the boot adapter.
Figure 47:
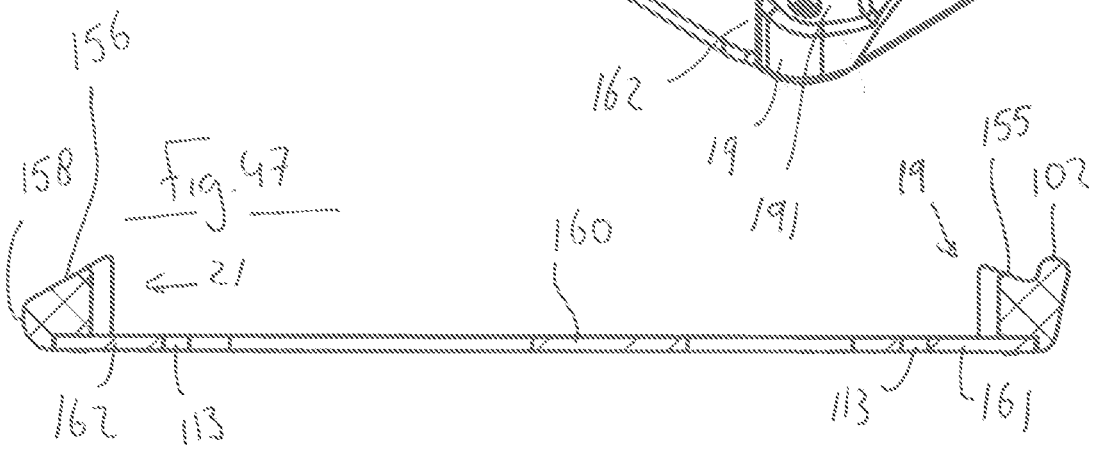
Figure 48:
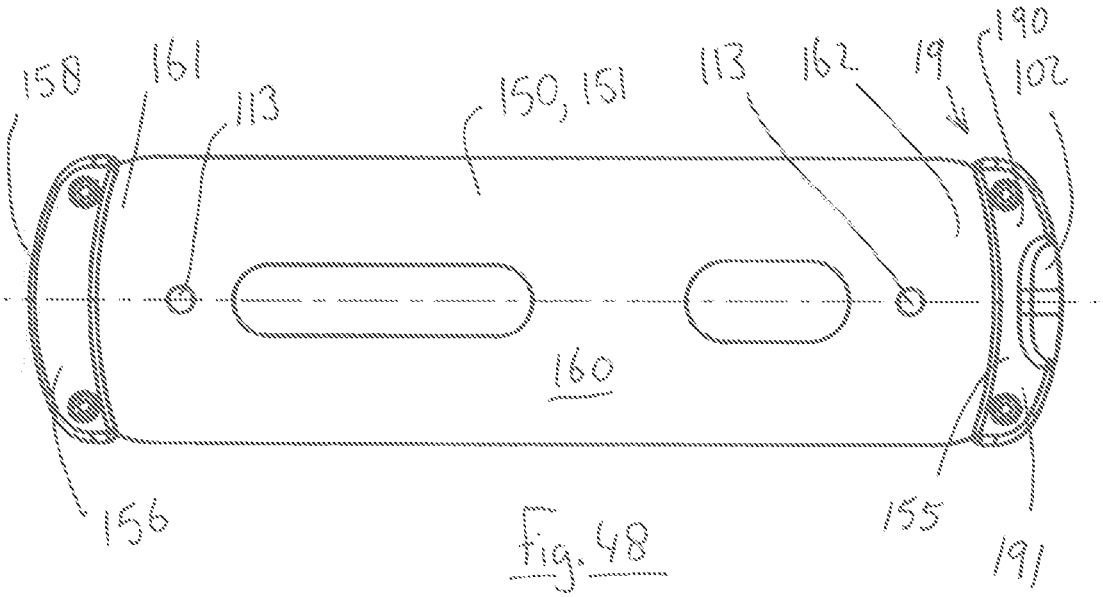

Turning to FIGS. 46-48, each boot adapter 150, 151 comprises a rigid plate 160 which interconnects the outer and inner boot coupling parts 19, 21. The rigid plate comprises a slot 165. The slot 165 allows access to the spring leaf and the adjustment member below the slot. Bolts 166 extend through the rigid plate 160. The bolts are configured to connect each boot adapter 150,152 to a boot 40R, 40L.

The inner boot coupling part 19 comprises a projection 102 which projects upward from the inner contact surface 155 and which is configured to pull on the pull protrusion 101 of the inner receiving unit 18 when the boot is released from the coupling assembly.

A side 158 of the inner boot coupling part and outer boot coupling part is curved.

The outer contact surface 156 and the inner contact surface 155 extend at an angle α1 to the horizontal between 0 and 50 degrees, in particular about 20-40 degrees.

The contact surface 155 of the inner boot coupling part comprises a forward part 190 and a rear part 191, the forward part being located at a toe side of the coupling assembly and the rear part being located at a heel side of the coupling assembly, wherein the pull projection 101 is located between the forward part and the rear part.

Operation of Second Embodiment

Turning in particular to FIGS. 20-23, in use the set 10 of coupling assemblies is mounted on a board 16 for instance with the bolts 130.

A user puts on boots 40. Generally the right and left boot coupling parts 19, 21 will already be connected to his boots (or be integral with his boot). If not the user also has to connect the right and left boot coupling parts to his boots. The user then steps on the boot positions 89 with his boots and couples the boots 40 to the board with the coupling assemblies 12,14. The user positions the outer boot coupling part 21 under the outer locking element 30 of the outer receiving unit 20 and positions the inner boot coupling 19 part under the inner locking cam 28 of the inner receiving unit 18. The inner receiving unit 18 is then secured by pivoting the locking arm 22 to the locked position and pivoting the release arm 42 to the locked position by sliding the end 65 of the release arm over the ramp 98 toward the locking arm 22. The biasing member 104 urges the release arm 42 in this direction. When both feet are secured, the user is ready to go.

When in use the user falls with his front edge into the water, a pull force will be created as a result of the board decelerating by the force of the water while the body of the user continues to move forward, due to its inertia. The leaf spring 70 will deform as a result. In FIGS. 22, 23 this is the left coupling assembly 14 but obviously it may also be the right coupling assembly 12. When the pull force on the coupling assembly 14 exceeds the threshold force, the force release mechanism 32 on the outer receiving unit 20 releases. The boot is now no longer held by the coupling assembly 14.

The foot of the user with the boot 40 and the boot coupling parts 19, 21 starts to move away from the coupling assembly 14. During this movement, the projection 102 on the inner boot coupling part 19 pulls on the pull protrusion 101 of the link pull member 36 and pull this pull protrusion 101 over a distance D. Because the link pull member 36 is connected to the release arm 42 of the other coupling assembly via the elongate link member 48B, the release arm 42 of the other coupling assembly is pulled to its released position. The release arm in turn pulls the locking arm 22 of the right coupling assembly to its released position. This releases the other coupling assembly 12. Now both feet (and boots 40) of the user are released from the board.

The second embodiment shares with the first embodiment the principle that the boot 40 or the coupling part 19 pulls on the link pull member 36 and pulls the link pull member 36 over a distance. The link pull member 36 pulls on the release arm 42 of the other coupling assembly via the elongate link member 48. The release arm 42 of the other coupling member pulls associated the locking arm 18 to the released position. There is a continuous (or uninterrupted pull action) from the boot or boot coupling part which is first released to the locking arm 18 of the other coupling assembly in both embodiments.

Also both the first and second embodiment have the pivotable locking arm 22 and the pivotable release arm 42 which is pivotably connected to the locking arm.

Third Embodiment

Turning to FIGS. 24-28, in a third embodiment, both the force release mechanism 32 and the pull mechanism 34 are associated with the inner receiving unit 18. The inner receiving unit comprises both the force release mechanism 32 and the pull mechanism 34.

This embodiment also comprises the leaf spring 70, but the movable part 72 of the leaf spring 70 is positioned at the inner receiving unit 18. In this embodiment the outer receiving unit does not have a force release mechanism 32.

The locking arm 22 is pivotably connected to the movable part 72 of the leaf spring. To this end the outer struts 280 are fixed to the movable part of the leaf spring. The movable part of the leaf spring is forked and comprises a separate right and separate left section. The ramp 98 is connected to 71 fixed part 71 of the leaf spring. The leaf spring extends between the inner and outer receiving unit.

The ramp 98 comprises ramp indentations 200 or ramp protrusions. The end 99 of the release arm 42 forms the threshold part 78 and is configured to engage these ramp indentations or ramp protrusions. The ramp indentations or ramp protrusions form the stop 75 which holds the force release mechanism 32 in the locked position.

The movable part 72 of the leaf spring is located at the inner receiving unit. The locking arm 22 and the release arm 42 together form the hold and release component 76.

The stop 75 is mounted to the fixed part of the leaf spring.

The outer receiving unit 20 has a relatively simple construction and comprises the outer locking element 30 which is fixed.

Figure 29:
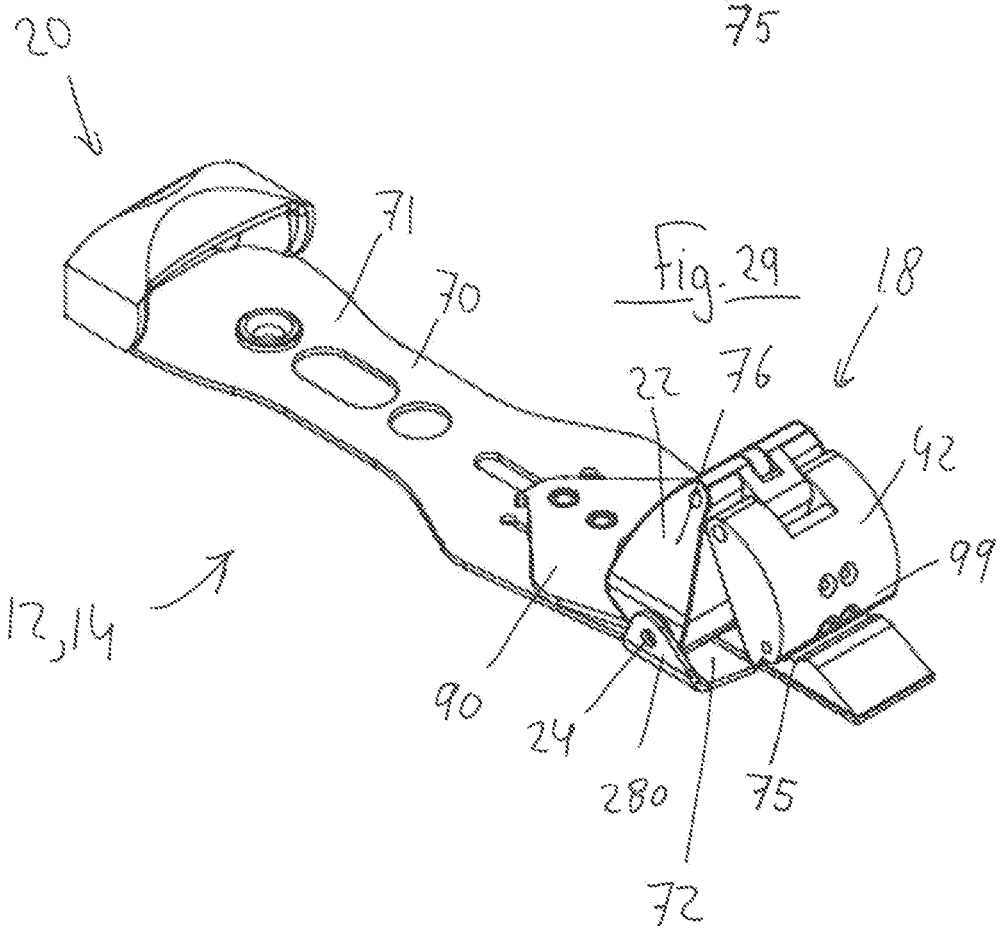
Figure 30A:
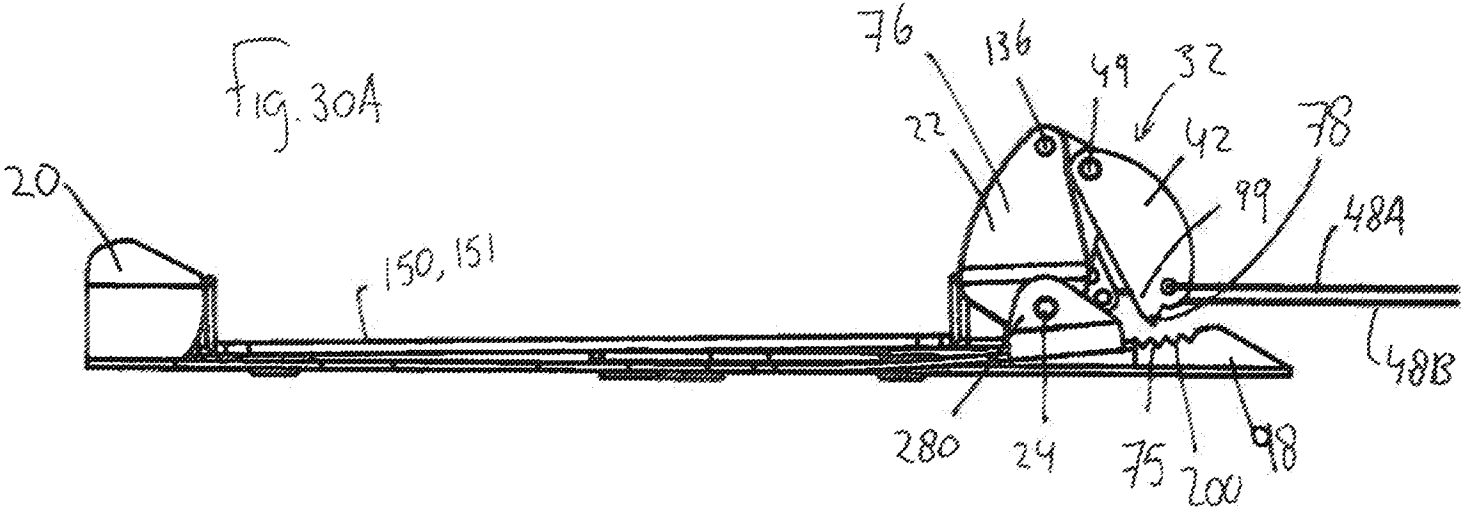
FIGS. 30A, 30B show side views of the third embodiment at the moment of release.
Figure 30B:
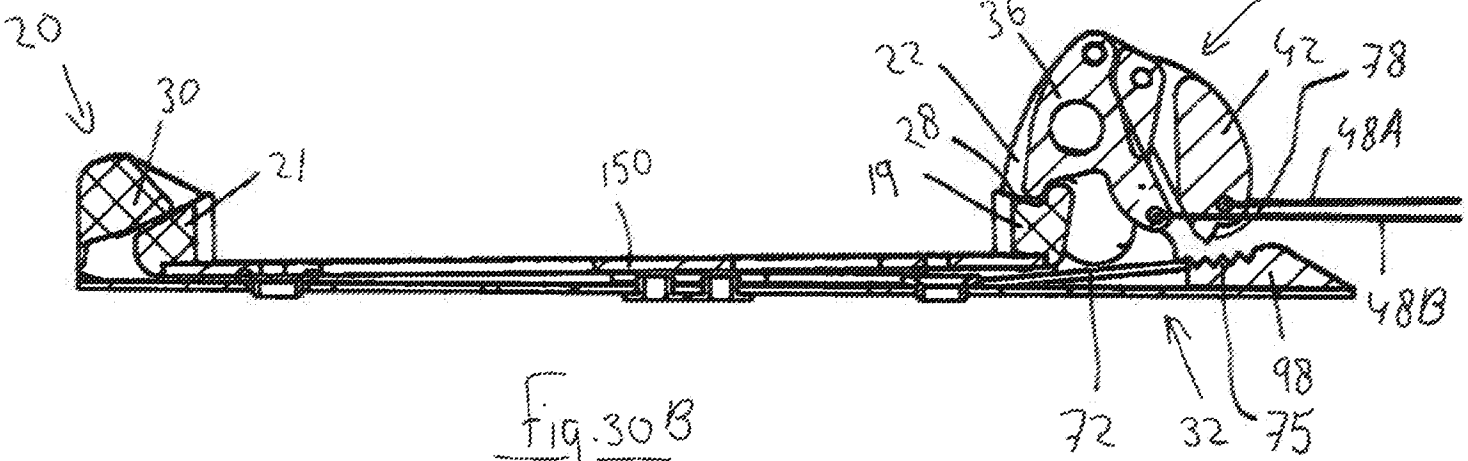
Figure 31:
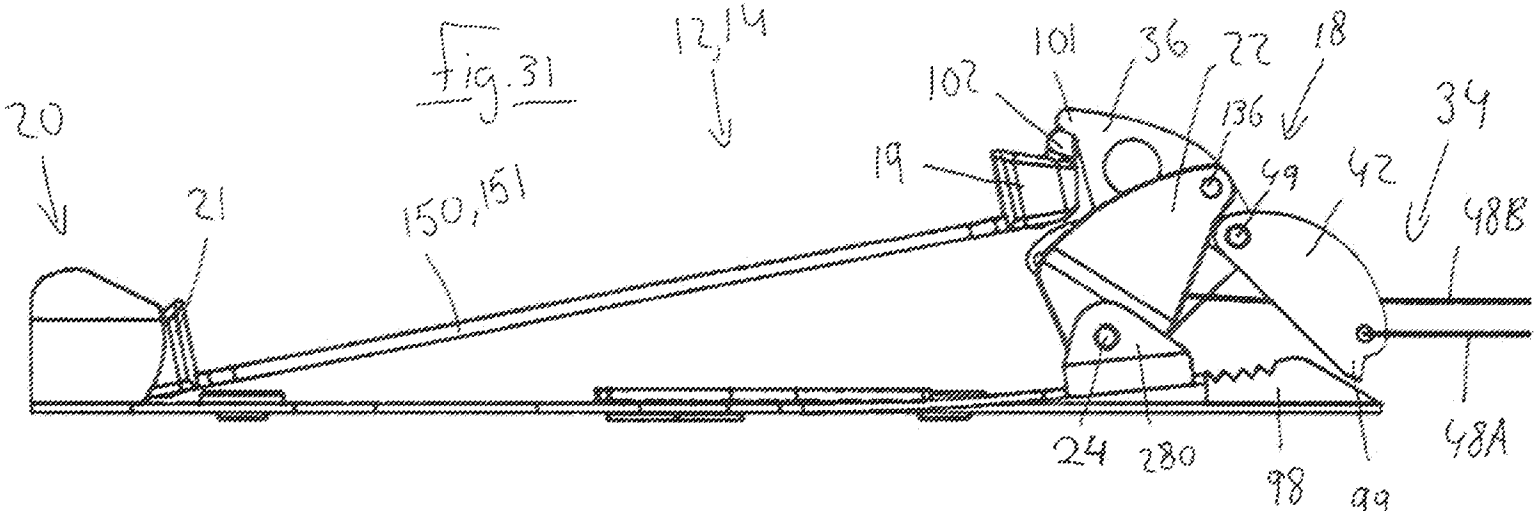
FIGS. 31, 32, show side views of the third embodiment in the released state.
Figure 32:
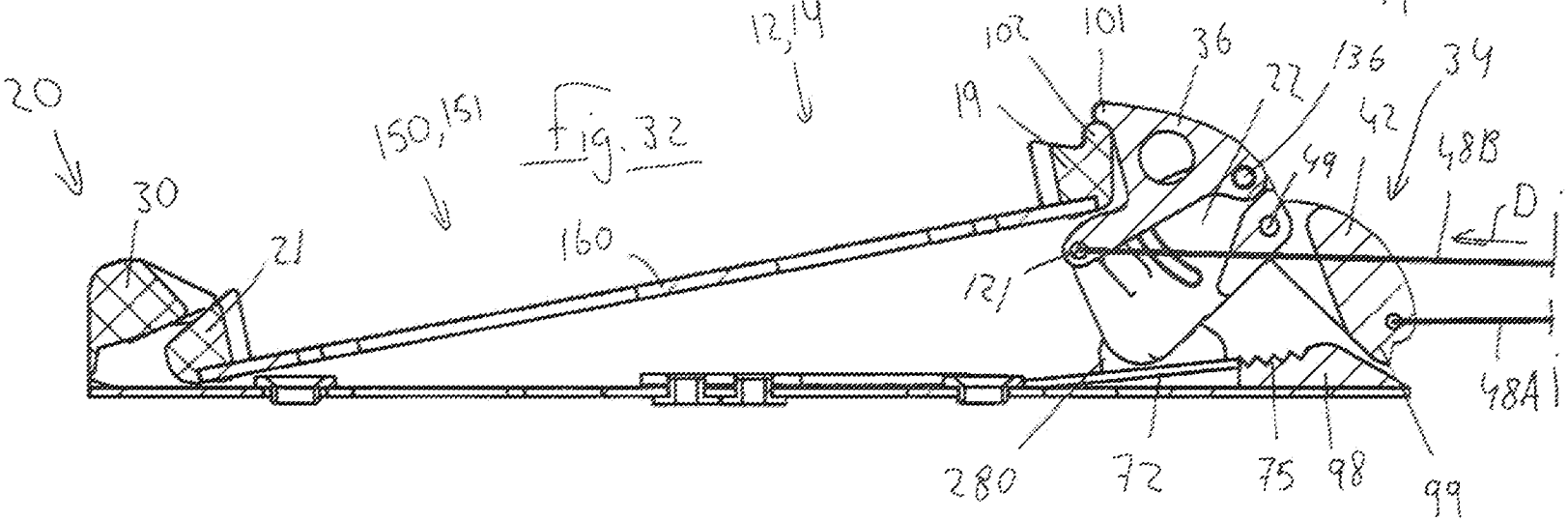
Figure 33:
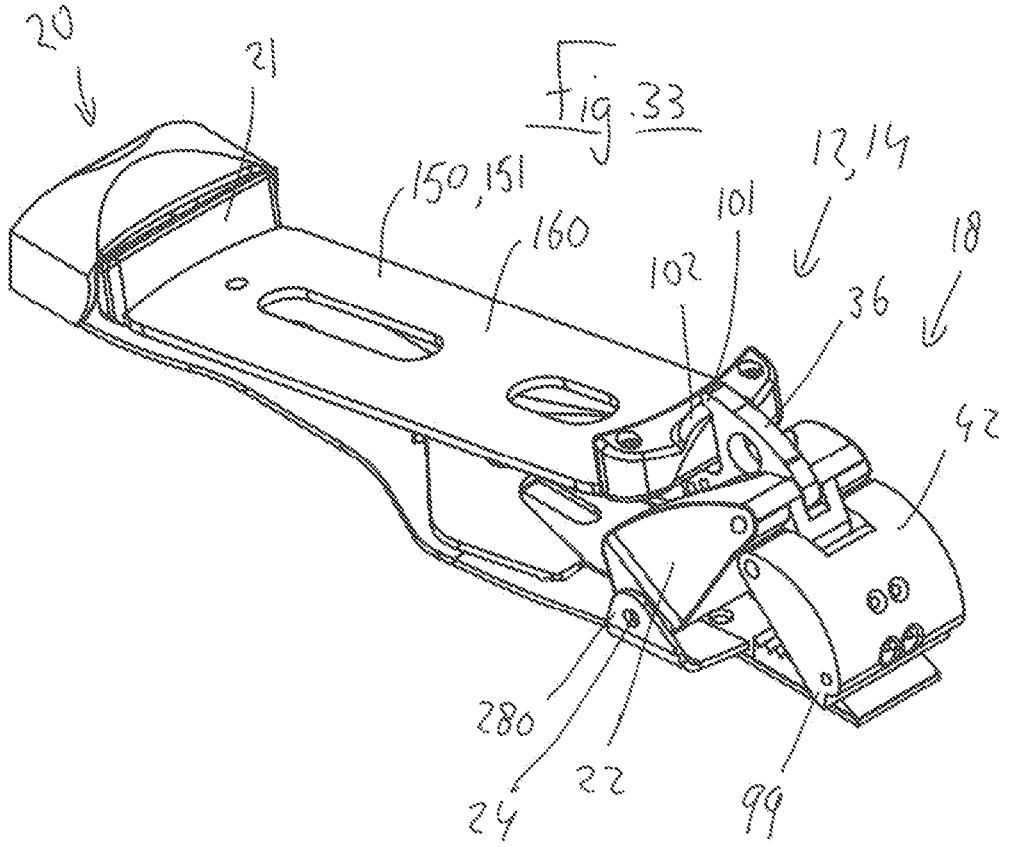
FIGS. 33, 34, show isometric views of the third embodiment in the released state.
Figure 34:
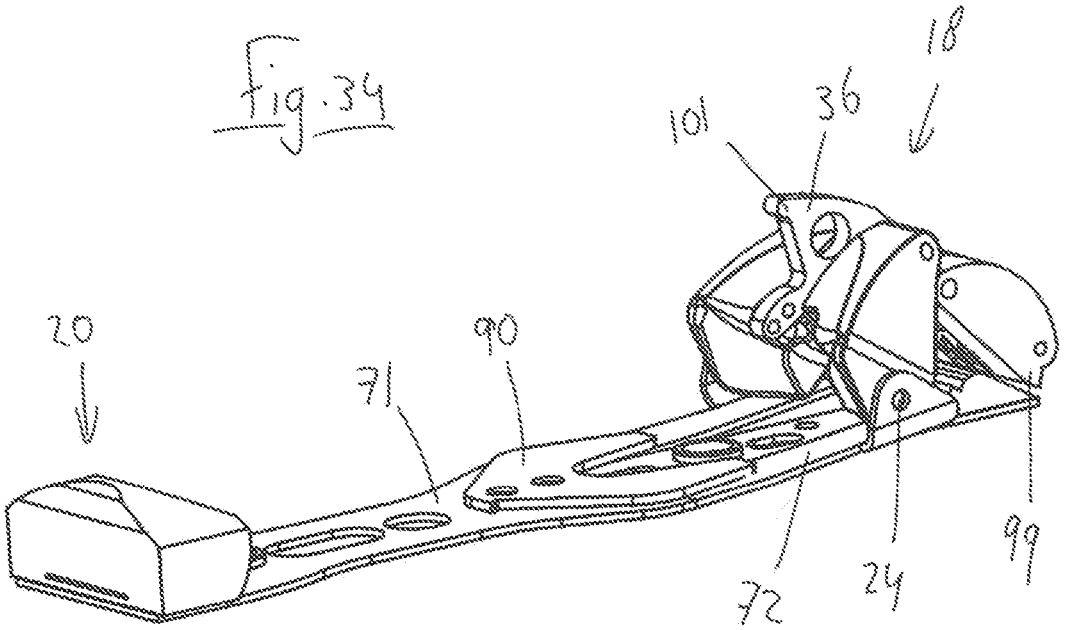

Turning to FIGS. 29 and 30A, 30B, when the force exerted by the inner boot coupling part 19 on the inner locking cam 28 is present, the movable part 72 of the leaf spring flexes upward. The locking arm and the release arm also move upward, because the outer struts 280 move upward. As long as the force is lower than the threshold force, the end 99 of the release arm 42 remains locked by the indentations or protrusions 200. Once the force exceeds the threshold force, the end 99 of the release arm disengages from the stop 75 formed by the indentations. The force release mechanism 32 is now released. The outer boot coupling part 19 is no longer held down by the inner locking cam 28, and starts to move upward.

Turning to FIGS. 31-34, when the outer boot coupling part 19 moves upward, it pulls on the link pull member 36. The projection 102 pulls on the pull protrusion 101 of the link pull member 36. The link pull member 36 pivots about the link pull member axis 136. The end 121 of the link pull member 36 to which the elongate link member 48B (in this example) moves over a distance D away from the other coupling assembly and pulls the release arm of the other coupling assembly over a distance D. This releases the other coupling assembly 12. Both coupling assemblies have now released the boot adapters 150.

Fourth Embodiment

Turning to FIGS. 49-61 a fourth embodiment of a coupling assembly 12, 14 of the set 10 is shown. The inner receiving unit 18 comprises a downward slope 208. The downward slope is connected to the ramp 98 at an apex 209 thereof and extends downwards from said apex (FIG. 61). The downward slope 208 is configured to guide the second end 99 of the release arm 42 between the locked position and the released position.

The inner receiving unit 18 has a vertical restraining member 210 which is configured to restrain a vertical movement, or a movement away from the board, of the second end of the release arm when the release arm moves between the locked position and the release position. This has as advantage that during locking of the boot to the board the release arm corresponding to the opposite boot is not accidently released.

The vertical restraining member 210 has at least one cam track 211 extending substantially parallel to the ramp 98 and downward slope 208. In the shown embodiment two cam tracks 211 are provided at each side of the downward slope 208, as well as on each side of the ramp 98. The second end 99 of the release arm comprises a cam 212 (FIG. 59) on each side of the second end 99 for following the cam tracks 211 when the release arm moves between the locked position and the release position.

The release arm of the inner receiving unit comprises an interlink adjusting member 215 for adjusting a length of the elongate interlink member. The interlink adjusting member can also be provided on other parts, like for example the link pull member. The length of the elongate interlink member 48 between the release arm of the left inner receiving unit 18 and the link pull member 36 of the right inner receiving unit 18 is such that the distance traveled by the link pull member 36 can be transferred substantially proportionally to the opposing release arm 42.

When doing tricks with the board like sliding over rails or boxes the board tends to bend in a direction opposite to the natural flex of the board, i.e. negative flex. A consequence of such negative flex may be that the elongate interlink member 48 undesirably pulls on the release arm 42, because the negative flex induces a pulling force on the elongate interlink member. In order to mitigate the undesirable release of the release arm an initial gap 224 (FIG. 57) is provided between the pull projection 102 and the pull protrusion 101. This way there is some play for the pull protrusion 101 in case the board experiences the negative flex. The pull protrusion 101 is still configured to be pulled by the projection 102 on the inner boot coupling part.

Figure 53:
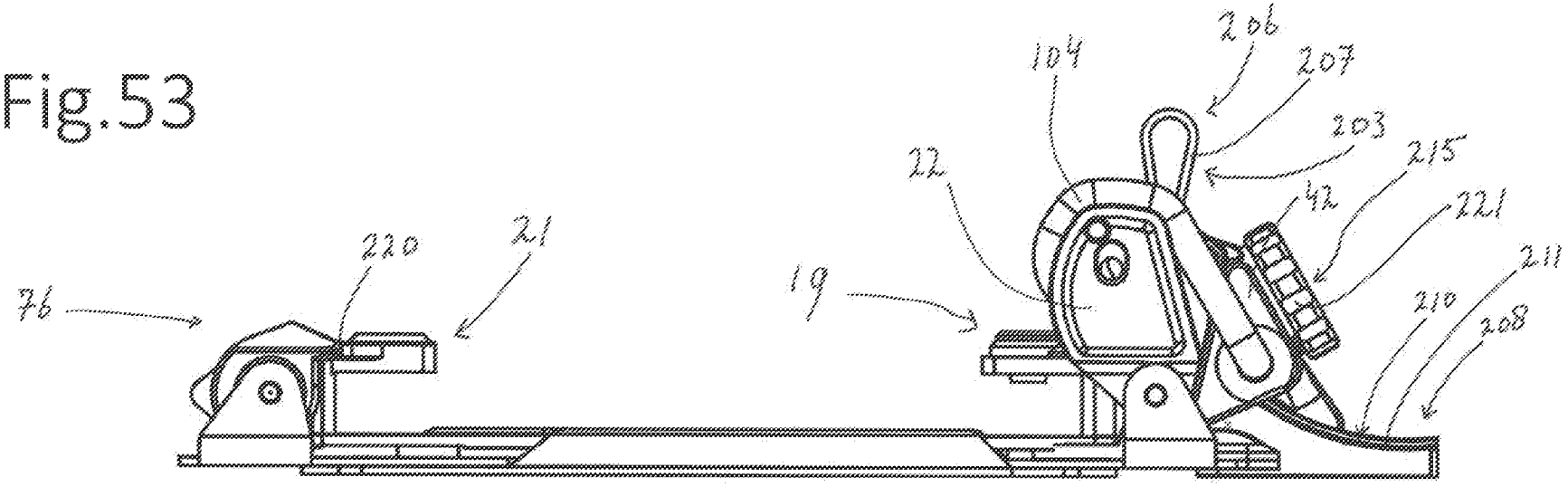
FIGS. 53, 54 show respectively a side view and a sectional side view of the fourth embodiment.
Figure 54:
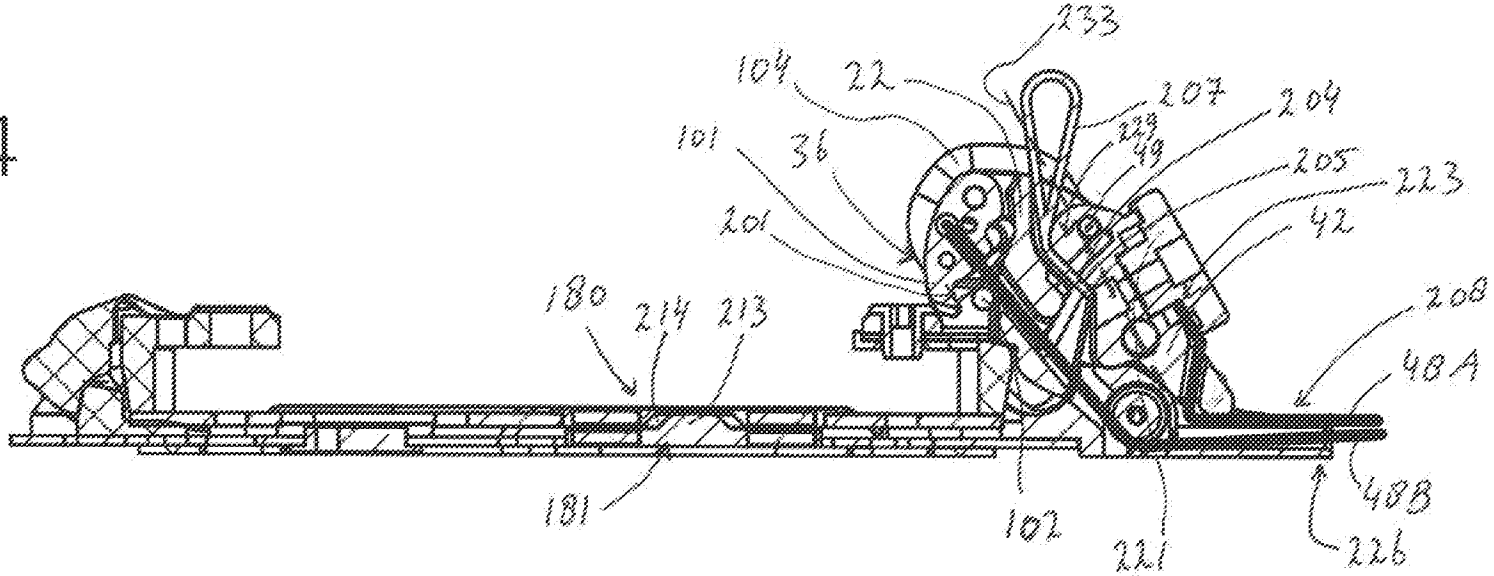

The initial gap 224 can for example be achieved by providing a simple resilient member in the form of an elastic band 225 between the link pull member 36 and the locking arm 22, as shown in FIGS. 53 and 54. The elastic band 225 extends along the width of the locking arm 22.

The interlink adjusting member 215 comprises a rotatable knob 221 to which an end 223 of the elongate interlink member 48A is connected, see FIG. 54. The rotatable knob 221 is configured to adjust the length of the elongate interlink member 48A by rotating. The end 223 of the elongate interlink member can be connected to the rotatable knob 221 for example via the hole 222. By rotating the knob 221 both ways the length can be easily lengthened or shortened, such that the desired tension is obtained.

Figure 51:
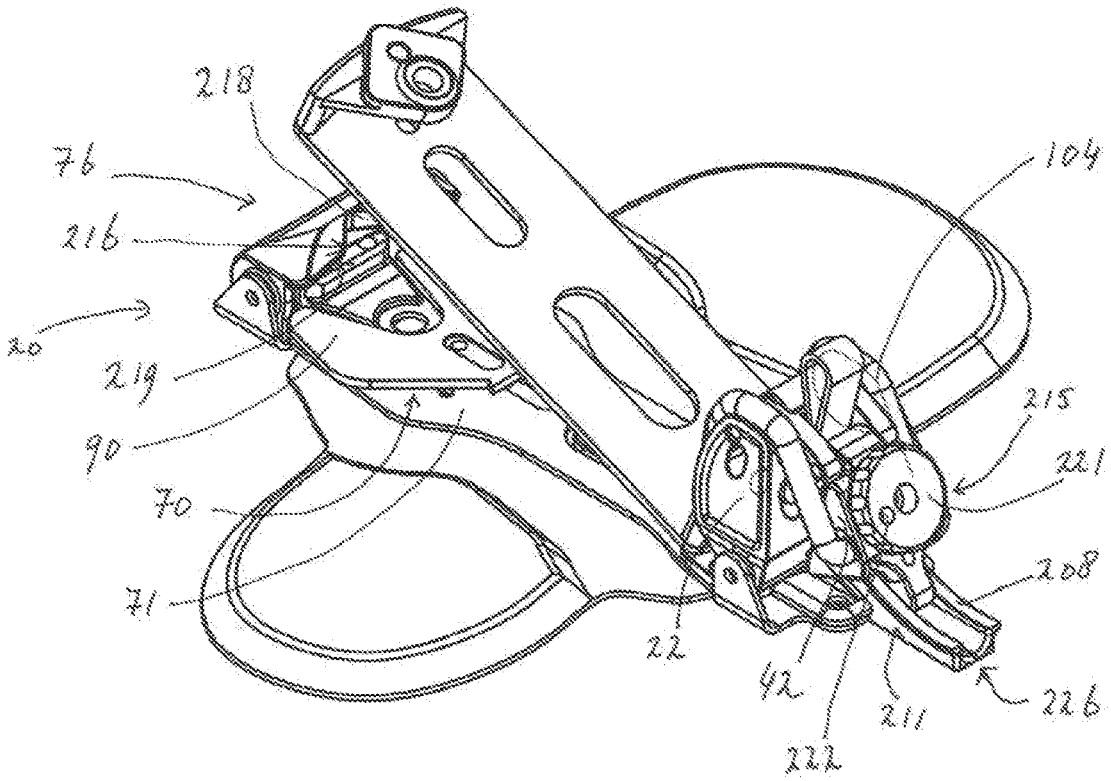
FIG. 51 shows an isometric view of the releasing coupling assembly of the fourth embodiment.
Figure 52:
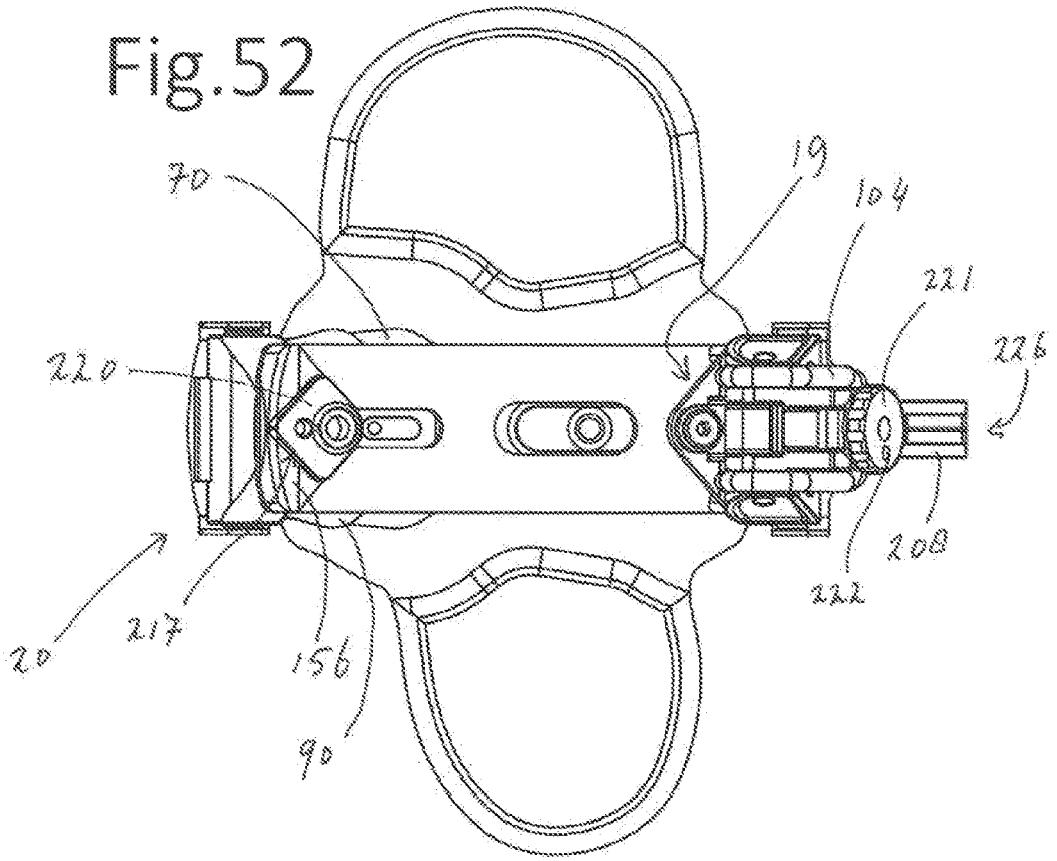
FIG. 52 shows a top view of the releasing coupling assembly of the fourth embodiment.
Figure 55:
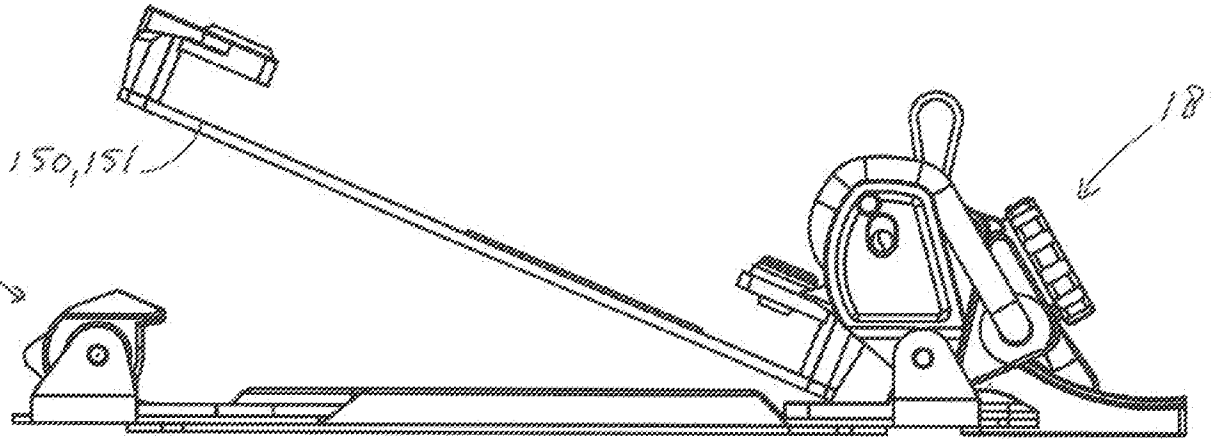
FIGS. 55, 56 show respectively a side view and a sectional side view of the fourth embodiment during release.
Figure 56:
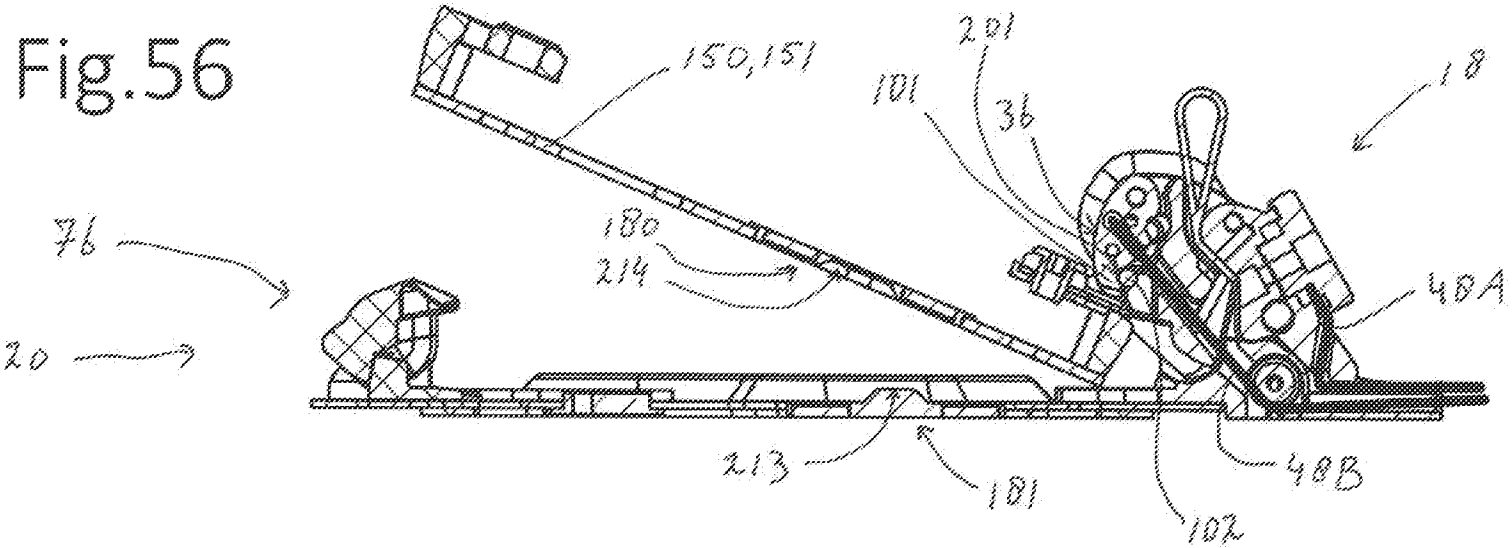
Figure 57:
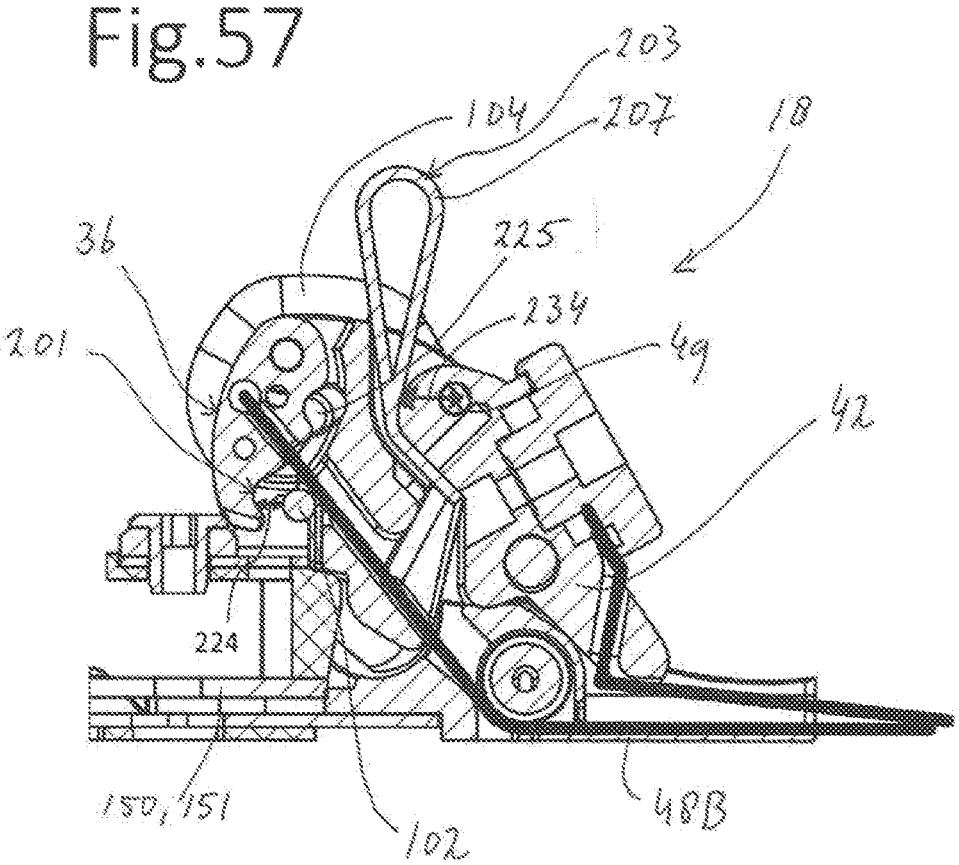
FIGS. 57, 58 show sectional side views of the inner receiving unit in respectively a locked configuration and during release.
Figure 58:
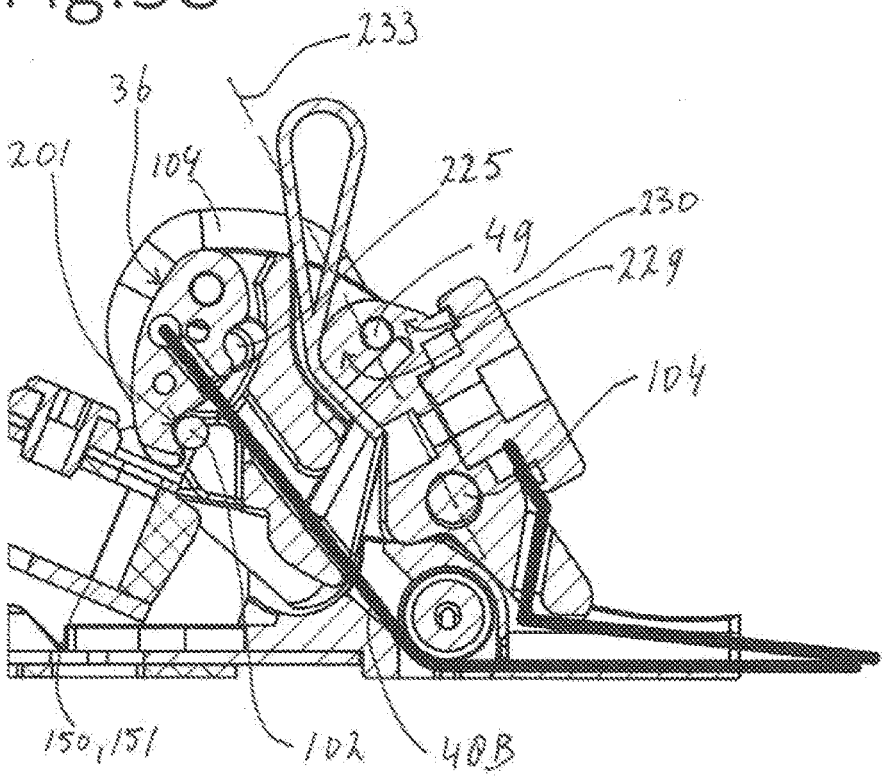

When the boot is first released at the outer receiving unit 20, as shown in FIGS. 51, 55, 56, the second release point will be at the inner receiving unit 18. In order to improve the coupled release between the left inner receiving unit and the right inner receiving unit in such case, the pull protrusion 101 of the link pull member may be provided with a hook shaped part 201. The hook shaped part 201 is, just as the pull protrusion 101, configured to be pulled by the inner boot coupling part, in particular in a direction away from the locking arm 22.

The inner receiving unit 18 comprises a pulling member 203 for moving the locking arm 22 and release arm 42 from the release position to the locked position by an upward pulling action from the user. This improves the user experience when the user wants to lock his boot to the coupling assembly, as the locking of the boot becomes easier.

The pulling member 203 has a first end 204 which is connected to an inner side 205 of the release arm, extending between and to above the locking arm and the release arm. This connection helps to pull the release arm 42 both up and towards the locking arm 22. The puling member 203 pulls the release arm toward and over the apex 209 of the ramp.

When the release arm is in the release position as shown in FIG. 61 the pulling member 203 has a lifting point 232 which is located substantially straight above the pivot axis 49. The first step of positioning the release arm towards the locked position is lifting the pulling member upwards such that the release arm moves towards the apex 209 between the ramp 98 and the downslope 208.

In order to position the release arm 42 in the locked position, the pulling member 203 is lifted further such that the release arm 42 moves over the apex 209 and down the ramp 98 towards the locking member 22. The distance 234 (FIG. 57) between the pivot axis 49 and the pulling member 203 functions as an arm for pulling the release arm to the locked position, over the apex 209.

A biasing member 104, e.g. an elastic band, biases the release arm 42 toward the locking position when the release arm is in the locked position. The release arm is biased by the elastic band 104 towards the locking member 22.

Figure 59:
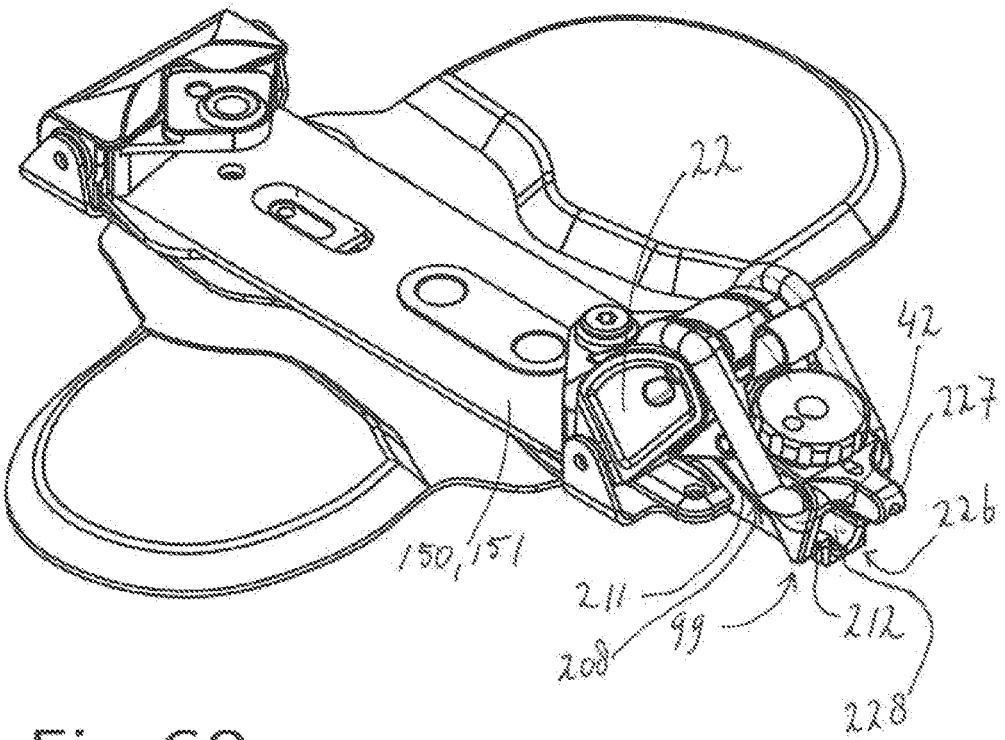
FIGS. 59-61 show different views of the coupling assembly according to the fourth embodiment in a released position.

The biasing member 104 also biases the second end 99 of the release arm towards a downslope end 226 of the downslope 208 when the release arm is in the release position, such that the release arm remains in the release position (FIG. 59). So the biasing member biases the release arm to the release position when the release arm is in the release position.

The biasing member 104 exerts a force on an inner side 229 relative to the pivot axis 49 when the release arm is in the locked position. This can be seen in for example FIG. 54, wherein a central axis 233 of the elastic band is located between the pivot axis 49 and the locking member 22.

The biasing member exerts a force on an outer side 230 relative to the pivot axis when the release arm is in the release position. This can be seen in for example FIG. 60, wherein the elastic band is located at a distance 231 away from the pivot axis at an opposite side 230 thereof.

A second end 206 of the pulling member is a loop 207. This way the user only has to use one finger to move the release arm from the release position to the locked position.

Turning to the outer receiving unit 20, wherein the hold and release component 76 comprises a first horizontal restraining member 216 configured to accommodate a second corresponding horizontal restraining member 217 of the boot adapter.

The horizontal restraining members 216, 217 prevent undesired movements of the boot in a longitudinal direction thereof.

The first horizontal restraining member 216 comprises a triangular shaped recess 218 extending from an inner side 219 of the hold and release component 76. Other recess shapes are also possible. The recess 218 is configured to accommodate the second horizontal restraining member, in the form of a protrusion 220, of the boot adapter, or boot.

Looking at the boot adapter 150,151 the outer boot coupling part 21 comprises the second horizontal restraining member 217 configured to be accommodated by the first horizontal restraining member 216 of the hold and release component 76 of the outer receiving unit 20.

The second horizontal restraining member 217 comprises a triangular shaped protrusion 220 provided above the outer contact surface 156.

The recess 218 and protrusion 220 assist the user when positioning the boot in the coupling assembly.

Figure 60:
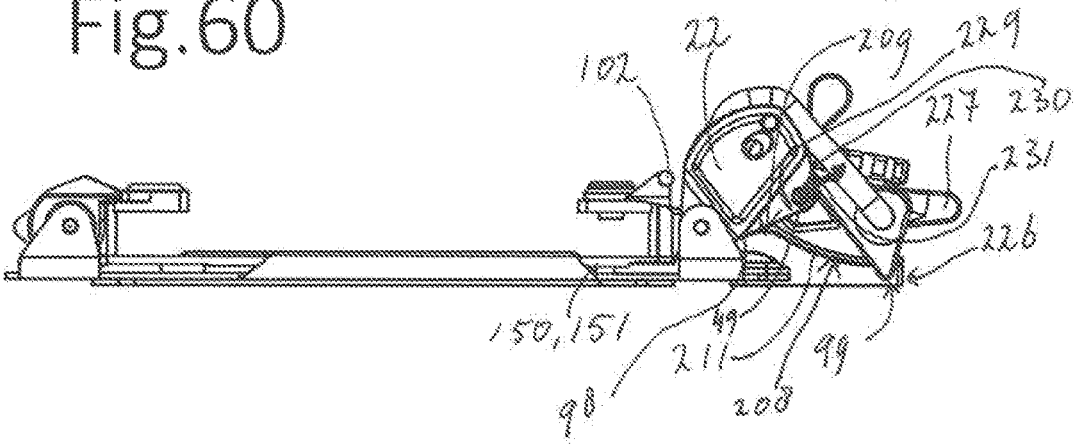
Figure 61:
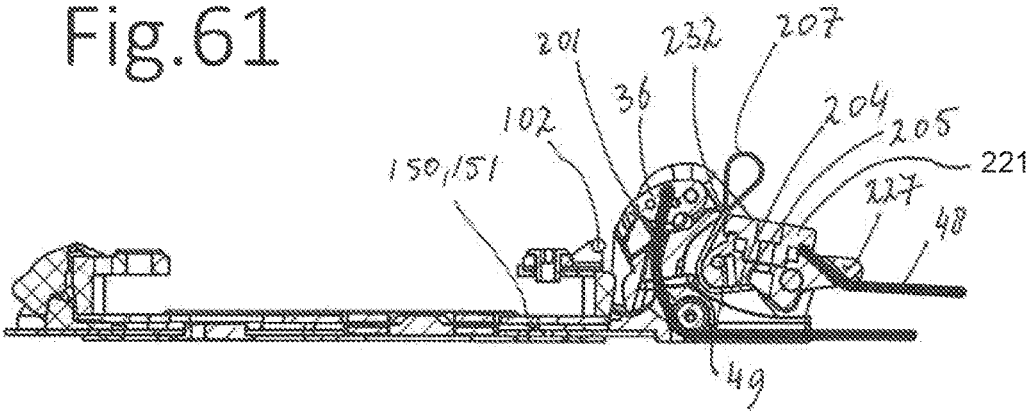

FIGS. 59-61 show the coupling assembly in the released position. The second end 99 of the release arm 42 is positioned at the downslope end 226 of the downslope 208. The cam 212 and the cam track 211 prevent the release arm from moving away from the board.

In these three figures extension 227 has moved through and out of gutter 228. FIG. 61 shows the elongate interlink member 48 extending from the rotatable knob 221 through the extension 227 towards the opposite inner receiving unit (not shown). When the release arm is in the locked position, the extension functions as a lever when the elongate interlink member 48 is pulled.

The projection 102 of the boot coupling part is free from the link pull member 36 such that the boot adapter 150,151, and the attached boot, can be released from the coupling assembly.

Boot Adapter

The manufacturer ensures that the boot can be connected to the board, often with a part which is called a binding. Different kinds of bindings exist.

A first kind of binding uses a baseplate having holes. The baseplate is permanently attached to the boot. Bolts connect the baseplate to the board.

A second kind of binding fits around the boot and comprises a baseplate of its own. In such a binding the boot does not comprise a baseplate. Hyperlite bindings are an example of the second kind.

In a third kind of binding, serrated edges extend along the side of the boot. Separate connectors are connected to the board and engage the serrated edges. Slingshot RAD is an example of such a binding.

The present invention is intended to be placed between the board on the one hand and the boot and its connectors on the other hand. The present invention is not intended to be limited to wakeboards only, but is also suitable for kitesurfboards and, with a small modification, for snowboards.

In a first way, the boot adapter 150 comprises a plate 160 which is configured to extend underneath the boot from the right side of the boot to the left side. The boot coupling parts 19, 21 are rigidly connected to the plate 160 and extend upward from the plate 160. The plate 160 itself is connected to the boot, for instance via bolts 166. This embodiment is shown in FIGS. 1, 2, 3 and 16, 17 and FIGS. 46-48.

Turning to FIGS. 37-40 in another embodiment, the outer boot coupling part and the inner boot coupling part are separate parts and are each are configured to be mounted on top of the baseplate of the boot.

Figure 41:
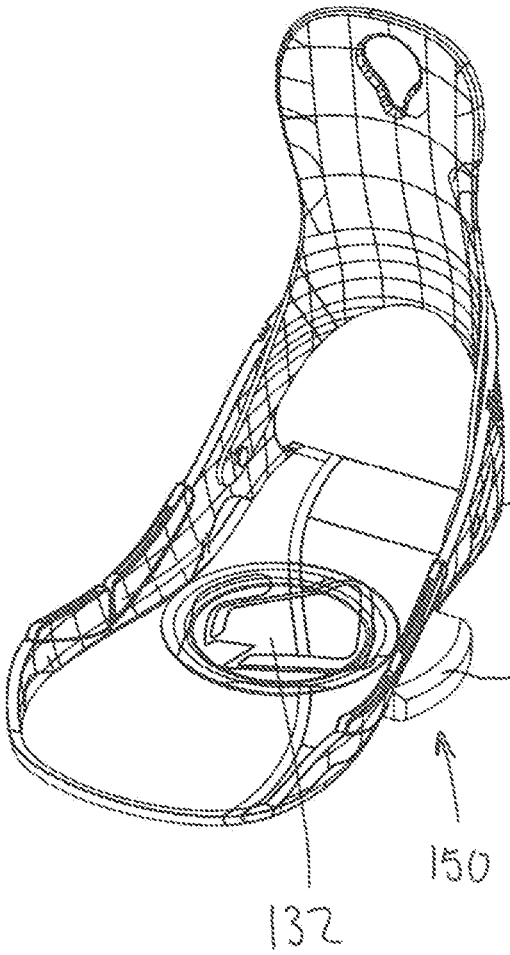
FIG. 41 shows another embodiment of the boot adapter.

Turning to FIG. 41, in a second embodiment, the boot coupling parts 19, 21 are connected to a binding 130 which is connected to the boot 40. The binding itself comprise a baseplate construction 132 which is configured to connect the binding to a board in a conventional way. This embodiment of the invention is a further development of a binding 130 produced by the company Hyperlite. The boot coupling parts can be connected to the binding which in turn is connected to the boot.

Figure 42:
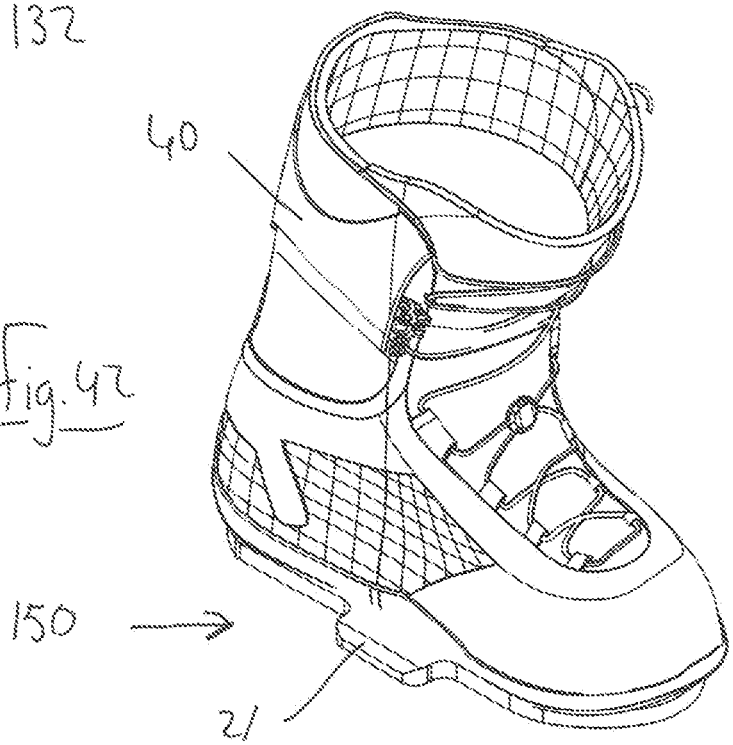
FIG. 42 shows another embodiment of the boot adapter.

Turning to FIG. 42 in a third embodiment, the boot coupling parts 19,21 are directly and permanently connected to a boot 40, without a separate base plate extending underneath the boot. The baseplate which is integrated in the boot is used. The boot coupling parts 19,21 may be integrated with this baseplate.

Figures 43, 44, 45:
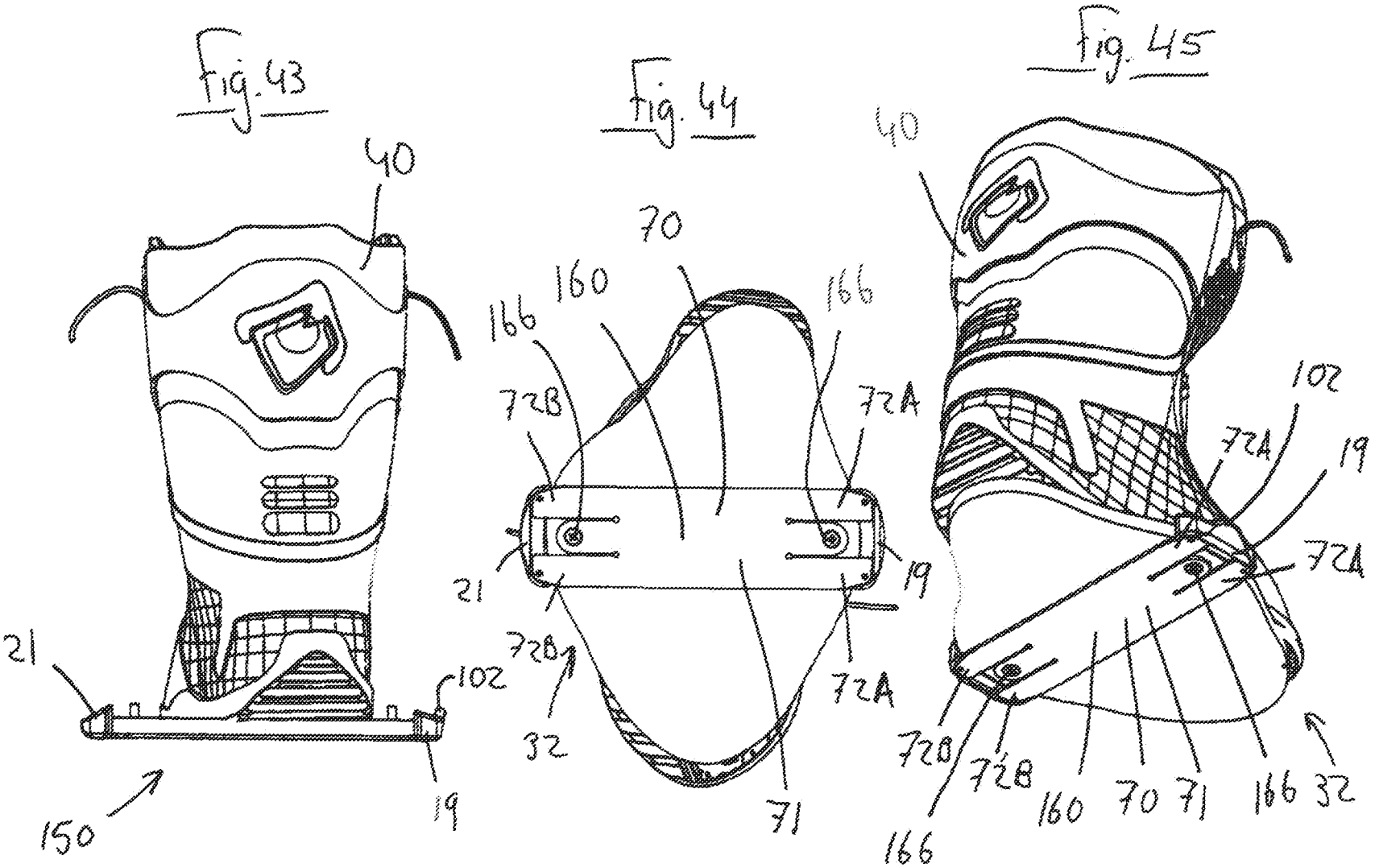
FIGS. 43-45 show another embodiment of the boot adapter.

Turning to FIGS. 43, 44 and 45, in another embodiment, the boot adapter 150 comprises the force release mechanism 32. The force release mechanism 32 comprises a spring leaf 70. The spring leaf forms part of the plate 160 extending under the boot from the right side to the left side. The leaf spring comprising a first part 71 which is integral with the boot or configured to be fixed to the boot and at least one movable part 72 configured to deform by the force.

The leaf spring comprises a first movable part 72A and a second movable part 72B, wherein the first movable part 72A is associated with the inner boot coupling part 19 and the second movable part 72B is associated with the outer boot coupling part.

When seen in top view the first and second movable part 72A, 72B of the leaf spring 70 are configured to extend outwardly to respectively a right and left side of a boot to which the boot adapter is connected or with which the boot adapter is integral.

Figure 35:
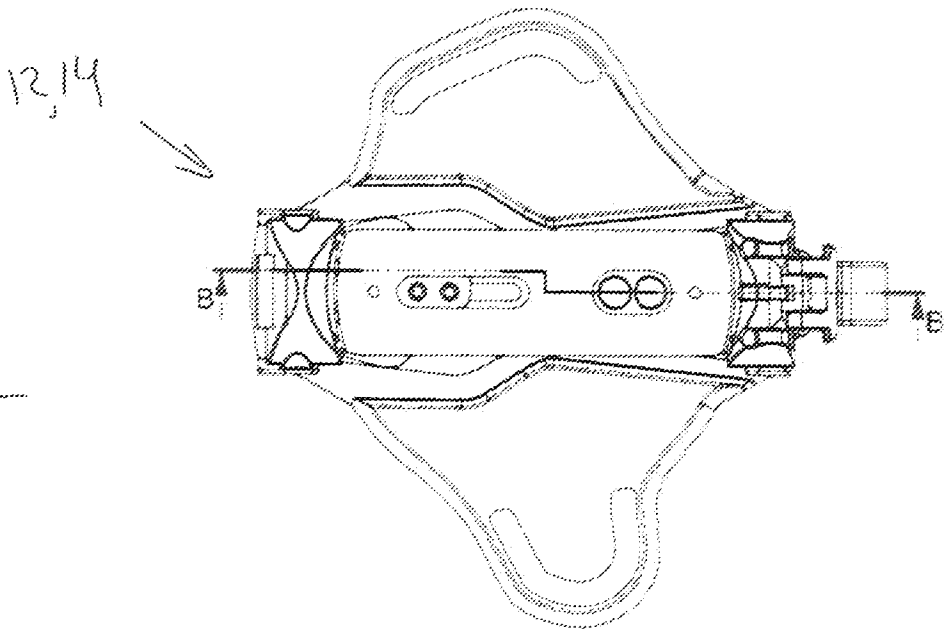
FIGS. 35 and 36 show a further embodiment having magnetic parts.
Figure 36:
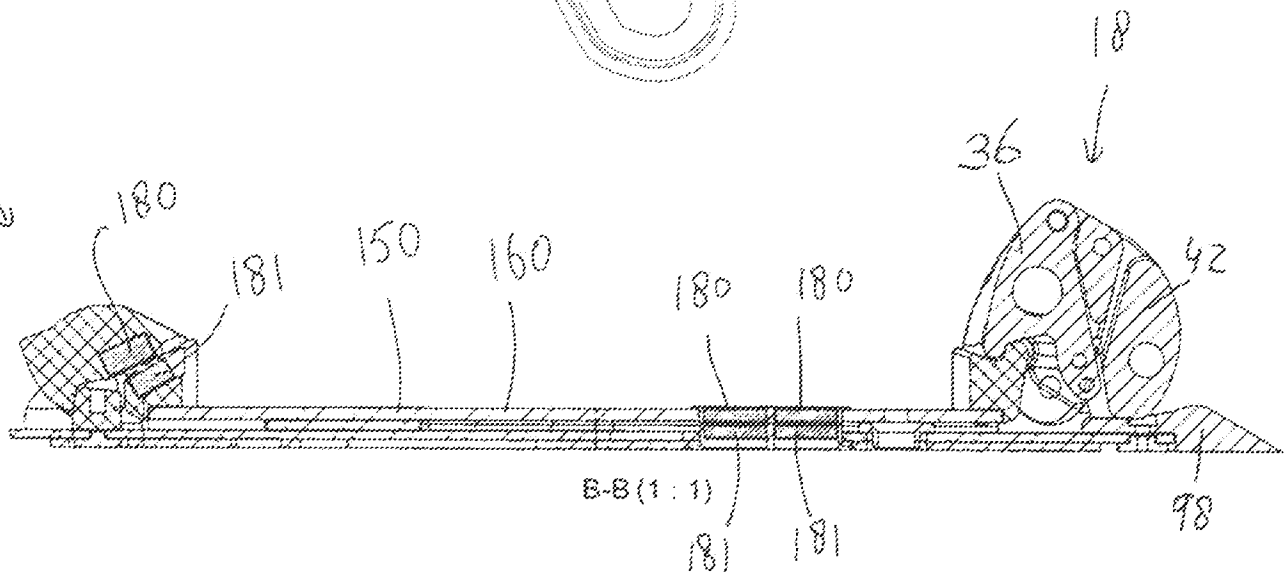
Figure 40:
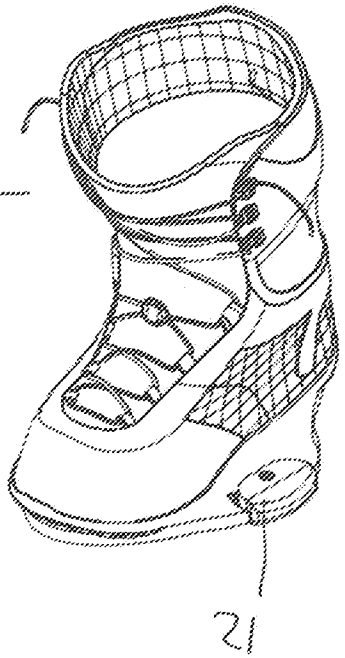
FIGS. 37-40 show an embodiment of the boot adapter.
Figure 37:
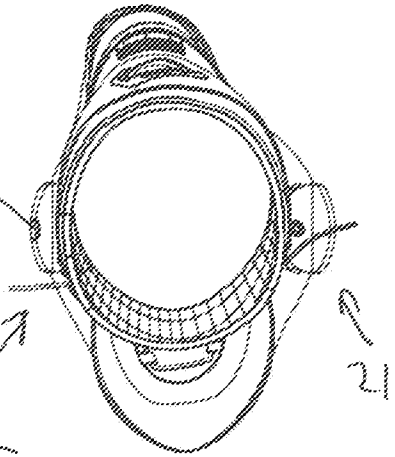
Figure 39:
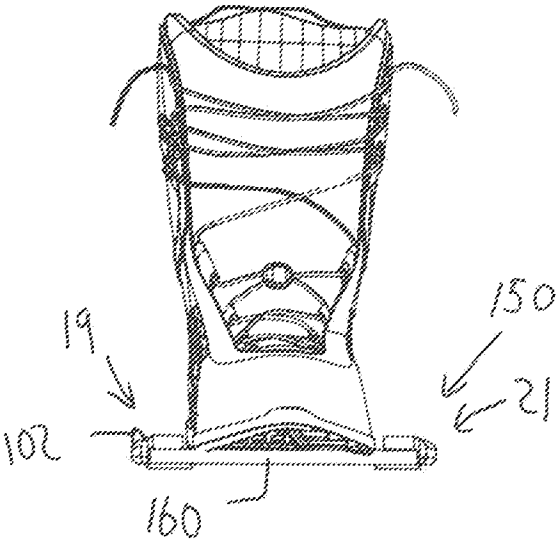
Figure 38:
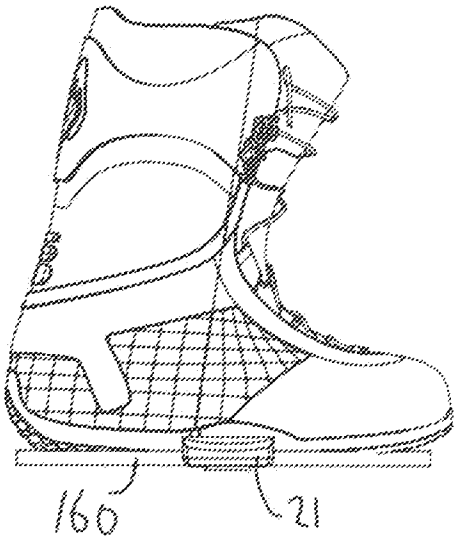

Turning to FIGS. 35 and 36, in a variant of the second embodiment the right and left coupling assembly and the right and left boot adapter 150, 151 comprise at least one first magnetic part 180 and one second magnetic part 181 which engage with one another. The magnetic parts make it easier to click the boots in the coupling assemblies, in particular in the water. The magnetic part(s) 180 on the boot adapter 150 may be fixed to the rigid plate 160 or to the inner or outer boot coupling part 19, 21. The magnetic parts on the coupling assembly may be integrated in the leaf spring or in the inner or outer receiving unit.

Figure 49:
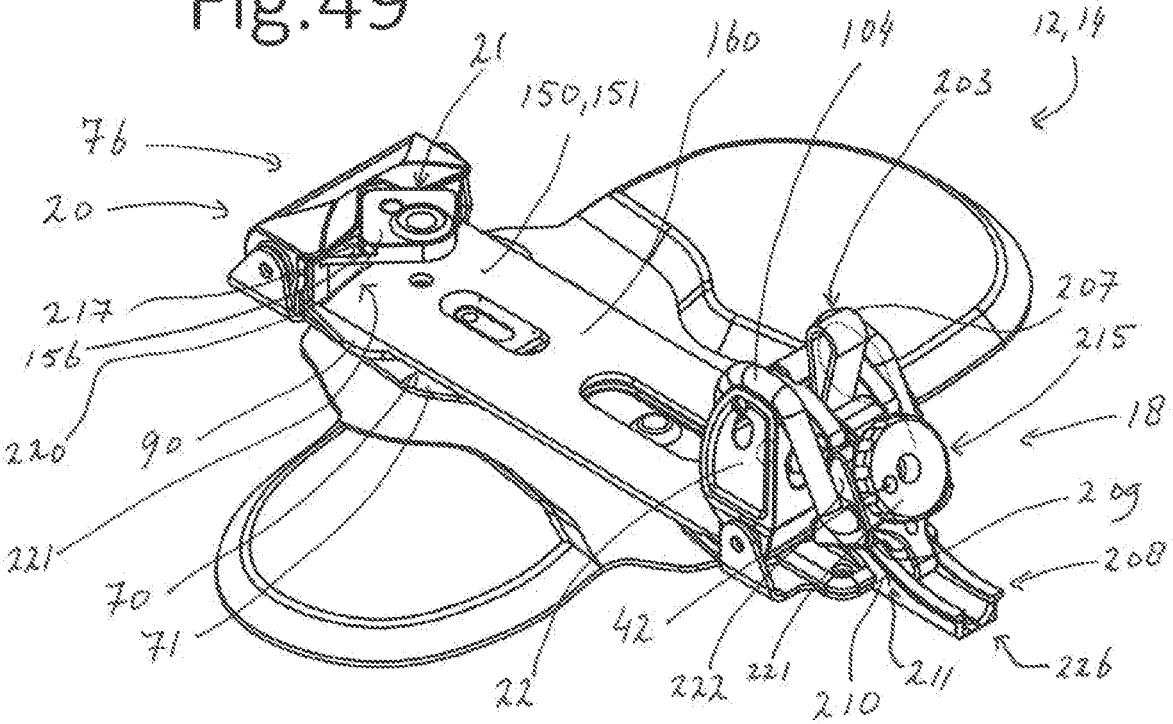
FIG. 49 shows an isometric view of a coupling assembly according to a fourth embodiment of the invention.
Figure 50:
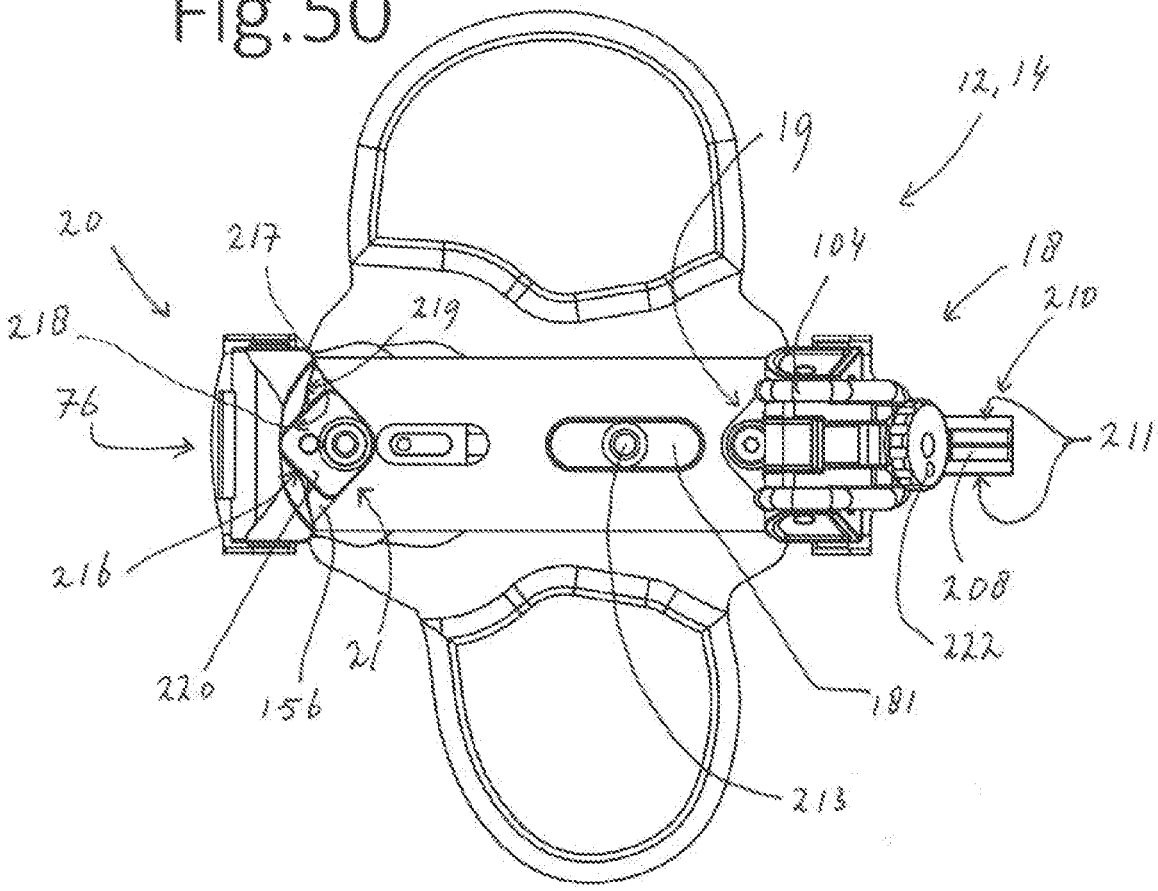
FIG. 50 shows a top view of the fourth embodiment.

Another embodiment of the set first and second magnetic part 180, 181 is shown in FIGS. 49, 50 and 54, wherein the second magnetic part comprises a centering protrusion 213 and the first magnetic part comprises a mating centering recess 214. In FIGS. 49 and 50 only the second magnetic part 181 and centering protrusion 213 are shown. The protrusion 213 and recess 214 mate with each other, and may, of course also be provided vice versa. It is more convenient to provide the mating centering recess 214 on the boot or boot adapter, because then no protrusion extends from the bottom thereof. Said protrusion 213 and recess 214 are configured to further facilitate easier positioning and/or engagement of the coupling assemblies with the boots, in particular in the water.

The terms "a" or "an", as used herein, are defined as one or more than one. The term plurality, as used herein, is defined as two or more than two. The term another, as used herein, is defined as at least a second or more. The terms including and/or having, as used herein, are defined as comprising i.e., open language, not excluding other elements or steps.

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

White lines between text paragraphs in the text above indicate that the technical features presented in the paragraph may be considered independent from technical features discussed in a preceding paragraph or in a subsequent paragraph.

The invention claimed is:

1. A set of coupling assemblies comprising a right coupling assembly and a left coupling assembly, the set of coupling assemblies being configured to be mounted on a board for board sports in which both feet of a user are connected to a single board, wherein the right coupling assembly is configured to receive a right boot and comprises:

a right inner receiving unit configured to receive and engage an inner boot coupling part which is positioned on a left side of the right boot, a right outer receiving unit configured to receive and engage an outer boot coupling part which is positioned on a right side of the right boot, wherein the left coupling assembly is configured to receive a left boot and comprises:

a left inner receiving unit configured to receive and engage an inner boot coupling part which is positioned on a right side of the left boot, a left outer receiving unit configured to receive and engage an outer boot coupling part which is positioned on a left side of the left boot, wherein each outer receiving unit comprises an outer locking element configured to engage the outer boot coupling part and to hold the outer boot coupling part in place, each inner receiving unit comprises a locking arm which is pivotable about a main inner pivot axis from a locked position to a released position and vice versa, wherein the locking arm comprises an inner locking cam configured to engage the inner boot coupling part and to hold the inner boot coupling part in place, wherein each inner receiving unit comprises a pull mechanism connected to the locking arm, the pull mechanism comprising:

at least one elongate interlink member which extends between the two inner receiving units and interlinks the two inner receiving units, and a link pull member configured to engage the boot or the inner boot coupling part and to receive a pull force from the boot or boot coupling part when the boot or boot coupling part is no longer held by the coupling assembly and moves away from the coupling assembly, and to be pulled over a pull distance by said boot or by the boot coupling part, wherein the pull mechanism is configured to transfer the pull force and the pull distance to the at least one elongate interlink member, and to convert the pull distance in an interlink pull distance of the elongate interlink member, and wherein said interlink pull distance pivots the locking arm of the other coupling assembly from the locking position to the released position, thereby releasing the other boot.

2. The set according to claim 1, wherein each inner receiving unit comprises a release arm pivotably connected to the locking arm and being pivotable relative to the locking arm about a release arm pivot axis, wherein each release arm comprises a cable connector to which an end of an elongate interlink member is connected.

3. The set according to claim 2, comprising a first elongate interlink member and a second elongate interlink member, wherein the first elongate interlink member is connected at one end to the link pull member of the right coupling assembly and connected at the opposite end to the release arm of the left coupling assembly and wherein the second elongate interlink member is connected at one end to the link pull member of the left coupling assembly and connected at the opposite end to the release arm of the right coupling assembly.

4. The set according to claim 2, wherein an opposite end of that elongate interlink member is connected to the release arm of the inner receiving unit of the other coupling assembly, and wherein the pull force exerted by the elongate interlink member pivots the release arm of that other inner receiving unit relative to the associated locking arm, and wherein the release arm in turn pulls the locking arm of that other inner receiving unit from the locked position to the released position.

5. The set according to claim 2, wherein the link pull member is pivotably connected to the locking arm at a link pull member axis, wherein the main inner pivot axis, the release arm pivot axis and the link pull member axis are parallel to one another.

6. The set according claim 1, wherein the inner or outer receiving unit of each coupling assembly comprises a force release mechanism configured to release the inner locking cam or outer locking element when a force on the locking cam or the outer locking element exceeds a threshold force.

7. The set according to claim 6, wherein the force release mechanism of the inner or outer receiving unit comprises:

a leaf spring, the leaf spring comprising a fixed part which is configured to be fixed to the board and a movable part, wherein the movable part is not fixed to the board, wherein the movable part of the leaf spring is configured to move in a direction away from the board when a force is exerted on the movable part of the leaf spring, said force flexing the leaf spring, a stop configured to be fixed to the board, wherein the outer or inner receiving unit comprises:

a hold and release component being connected to the movable part of the leaf spring, the hold and release component comprising the locking cam configured to engage the outer or inner boot coupling part and to hold the outer boot coupling part in place, a threshold part configured to engage the stop, and wherein when the force on the movable part of the leaf spring is below the threshold force the hold and release component is held in place by the stop which acts on the threshold part, and when the force on the movable part of the leaf spring exceeds the threshold force, the threshold part disengages from the stop and the hold and release component releases the inner or outer boot coupling part.

8. The set according to claim 7, wherein the leaf spring is part of the coupling base and interconnects the inner and outer receiving unit.

9. The set according to claim 7, wherein the hold and release component is pivotable between a secured position and a released position, and wherein:

in the secured position the threshold part engages the stop, thereby preventing the hold and release component from pivoting, and wherein in said secured position the locking cam holds the inner or outer boot coupling part in place, and in the released position the threshold part is located above the stop and is no longer engaged with the stop, allowing the hold and release component to pivot and to release the boot coupling part by the pivoting movement.

10. The set according to claim 7, wherein the leaf spring comprises a longitudinal axis which is intended and configured to be oriented parallel to a longitudinal axis of the board and wherein to this end the longitudinal axis of the leaf spring is oriented substantially parallel, in particular parallel, to the main coupling axis which extends between the inner receiving unit and the outer receiving unit.

11. The set according to claim 1, wherein the pull mechanism is incorporated in the inner receiving unit.

12. The set according to claim 1, wherein each of the right and left coupling assembly comprises a coupling base via which at least the inner receiving unit can be connected to the board, wherein the locking arm is connected to the coupling base via the main inner pivot axis.

13. The set according to claim 1, wherein the inner receiving unit comprises a pulling member for moving the locking arm and release arm from the release position to the locked position by an upward pulling action from the user.

14. The set according to claim 1, wherein the inner receiving unit comprises an interlink adjusting member for adjusting a length of the elongate interlink member, wherein the interlink adjusting member is in particular provided on the release arm.

15. A coupling assembly for a ski or board for board sports, the coupling assembly comprising at least one receiving unit for receiving a boot coupling part connected to a boot or integrated with a boot, the coupling assembly comprising a force release mechanism comprising:

a leaf spring, the leaf spring comprising a fixed part which is configured to be fixed to the board and a movable part, wherein the movable part is not fixed to the board, wherein the movable part of the leaf spring is configured to move in a direction away from the board when a force is exerted on the movable part of the leaf spring, said force flexing the leaf spring, a stop configured to be fixed to the board, wherein the at least one receiving unit comprises:

a hold and release component being connected to the movable part of the leaf spring, the hold and release component comprising the locking cam configured to engage the boot coupling part and to hold the boot coupling part in place, a threshold part configured to engage the stop, and wherein when the force on the movable part of the leaf spring is below the threshold force the hold and release component is held in place by the stop which acts on the threshold part, and when the force on the movable part of the leaf spring exceeds the threshold force, the threshold part disengages from the stop and the hold and release component releases the boot coupling part.

16. The coupling assembly according to claim 15, wherein the leaf spring is part of the coupling base and interconnects the inner and outer receiving unit.

17. The coupling assembly according to claim 15, wherein the hold and release component is pivotable about a hold and release pivot axis, wherein the hold and release pivot axis extends in particular substantially parallel to a main surface of the leaf spring and extends transverse to a main longitudinal direction of the leaf spring.

18. The coupling assembly according to claim 15, wherein the hold and release component is pivotable between a secured position and a released position, and wherein:

in the secured position the threshold part engages the stop, thereby preventing the hold and release component from pivoting, and wherein in said secured position the locking cam holds the inner or outer boot coupling part in place, and in the released position the threshold part is located above the stop and is no longer engaged with the stop, allowing the hold and release component to pivot and to release the boot coupling part by the pivoting movement.

19. The coupling assembly according to claim 15, comprising an adjustment member for adjusting the stiffness of the leaf spring, wherein the adjustment member is in particular configured to adjust the length of the movable part.

20. The coupling assembly according to claim 19, wherein in top view the adjustment member is positioned between the inner receiving unit and the outer receiving unit.

* * * * *